US008692101B2

(12) United States Patent
Ryle et al.

(10) Patent No.: US 8,692,101 B2
(45) **Date of Patent: *Apr. 8, 2014**

(54) STRINGED INSTRUMENT FOR CONNECTION TO A COMPUTER TO IMPLEMENT DSP MODELING

(75) Inventors: Marcus Ryle, Westlake Village, CA (US); Michel A. Doidic, Westlake Village, CA (US); Peter J. Celi, Agoura Hills, CA (US); Alan Zak, Woodland Hills, CA (US)

(73) Assignee: Line 6, Inc., Calabasas, CA (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/858,714

(22) Filed: Aug. 18, 2010

(65) Prior Publication Data

US 2010/0313740 A1 Dec. 16, 2010

Related U.S. Application Data

(60) Division of application No. 11/786,925, filed on Apr. 13, 2007, now Pat. No. 7,799,986, which is a continuation-in-part of application No. 10/933,653, filed on Sep. 3, 2004, now Pat. No. 7,279,631, which is a continuation-in-part of application No. 10/197,363, filed on Jul. 16, 2002, now Pat. No. 6,787,690.

(51) Int. Cl.
*G10H 3/00* (2006.01)

(52) U.S. Cl.
USPC ..... 84/723; 84/622; 84/626; 84/726; 84/735; 84/736; 84/737

(58) Field of Classification Search
None
See application file for complete search history.

(56) References Cited

U.S. PATENT DOCUMENTS

| | | | | |
|---|---|---|---|---|
| 4,653,376 | A | | 3/1987 | Allured et al. |
| 4,794,838 | A | * | 1/1989 | Corrigau, III ..... 84/600 |
| 4,817,484 | A | | 4/1989 | Iba et al. |
| 5,025,703 | A | | 6/1991 | Iba et al. |
| 5,308,916 | A | | 5/1994 | Murata et al. |
| 5,367,120 | A | | 11/1994 | Hoshiai |
| 5,541,354 | A | | 7/1996 | Farrett et al. |

(Continued)

OTHER PUBLICATIONS

Julius O. Smith III, "Commuted Synthesis of Strings," Physical Audio Signal Processing, Digital Waveguide Modeling of Musical Instruments and Audio Effects (2004).

(Continued)

*Primary Examiner* — Marlon Fletcher
(74) *Attorney, Agent, or Firm* — Blakely, Sokoloff, Taylor & Zafman LLP

(57) ABSTRACT

Disclosed is a stringed instrument that includes a plurality of strings and a pickup to which each of the plurality of strings is respectively coupled that is connectable to a computer to implement DSP modeling. A serial interface circuit is coupled to the pickup and to a digital connector that formats each digital string vibration signal received from the pickup into a digital serial protocol. A computer is coupled by a serial link to the digital connector such that the computer receives each serially formatted digital string signal (SFDSS). The computer operates at least one audio DSP-based software module to process each received SFDSS wherein each SFDSS is processed in order to emulate a corresponding string tone of one of a plurality of stringed instruments to create an emulated digital string tone signal (EDSTS). Each EDSTS is then transmitted back over the serial link to the stringed instrument for playback.

26 Claims, 22 Drawing Sheets

(56) References Cited

U.S. PATENT DOCUMENTS

| | | | | |
|---|---|---|---|---|
| 5,723,802 | A | 3/1998 | Johnson et al. | |
| 5,731,533 | A | 3/1998 | Hoshiai | |
| 5,763,803 | A | 6/1998 | Hoshiai | |
| 5,789,689 | A | 8/1998 | Doidic et al. | |
| 6,111,186 | A | 8/2000 | Krozack et al. | |
| 6,259,015 | B1 | 7/2001 | Takahashi et al. | |
| 6,320,113 | B1 * | 11/2001 | Griffin et al. | 84/738 |
| 6,353,169 | B1 | 3/2002 | Juszkiewicz et al. | |
| 6,448,488 | B1 * | 9/2002 | Ekhaus et al. | 84/735 |
| 6,610,917 | B2 | 8/2003 | Ludwig | |
| 6,686,530 | B2 | 2/2004 | Juszkiewicz et al. | |
| 6,787,690 | B1 | 9/2004 | Celi et al. | |
| 6,888,057 | B2 | 5/2005 | Juszkiewicz et al. | |
| 6,995,311 | B2 * | 2/2006 | Stevenson | 84/737 |
| 7,145,070 | B2 | 12/2006 | Barry | |
| 7,241,948 | B2 | 7/2007 | Cummings | |
| 7,799,986 | B2 * | 9/2010 | Ryle et al. | 84/737 |
| 7,935,876 | B1 * | 5/2011 | West | 84/304 |
| 7,952,014 | B2 * | 5/2011 | Juszkiewicz et al. | 84/742 |
| 2001/0045153 | A1 * | 11/2001 | Alexander et al. | 84/609 |
| 2003/0000370 | A1 | 1/2003 | Kuroki | |
| 2004/0187673 | A1 * | 9/2004 | Stevenson | 84/737 |
| 2007/0227344 | A1 * | 10/2007 | Ryle et al. | 84/723 |
| 2008/0163736 | A1 | 7/2008 | Demsey et al. | |
| 2008/0276794 | A1 * | 11/2008 | Juszkiewicz et al. | 84/742 |
| 2010/0313740 | A1 * | 12/2010 | Ryle et al. | 84/735 |

OTHER PUBLICATIONS

Karajalainen, M. et al. "More Acoustic Sounding Timbre From Guitar Pickups", Proceedings of the 2nd Cost G-6 Workshop on Digital Audio Effects (Dec. 9-11, 1999).

* cited by examiner

STRINGED INSTRUMENT FOR CONNECTION TO A COMPUTER TO IMPLEMENT DSP MODELING

This application is a Divisional of application Ser. No. 11/786, 925, filed Apr. 13, 2007, now issued as U.S. Pat. No. 7,799,986 which is a Continuation-in-Part of U.S. Ser. No. 10/933,653 filed Sep. 3, 2004 and now issued as U.S. Pat. No. 7,279,631, which is a Continuation-in-Part of U.S. Ser. No. 10/197,363 filed Jul. 16, 2002 and now issued as U.S. Pat. No. 6,787,690.

BACKGROUND

1. Field of the Invention

This invention relates to stringed musical instruments. In particular, the invention relates to a stringed musical instrument for connection to a computer to implement DSP modeling to allow for the emulation of a wide variety of selectable instruments.

2. Description of Related Art

Stringed instruments utilize vibrating strings to generate different tones, and more specifically, notes, which are simply particular tones. Tones or notes are sounds that repeat at a certain specific frequency and, when played in a particular order, create music.

Throughout the world, various cultures have created a multitude of different stringed instruments such as: guitars, mandolins, banjos, basses, violins, sitars, ukuleles, etc., to create music. Moreover, with the advent of electronics, many of these stringed instruments have now been electrified to operate in conjunction with an amplifier and speaker. One of the most common stringed instruments in use today is the guitar—in both its electric and acoustic forms. The guitar is one of the most popular musical instruments in use today, and it spans a huge range of musical styles—e.g. rock, country, jazz, folk, etc.

As previously discussed, the vibrating string of a stringed instrument generates a musical tone or note, which is in turn a function of: the length of the string; the amount of tension on the string; the weight of the string; the shape and thickness of the body of the stringed instrument, etc. Generally, stringed instruments, and the guitar in particular, include a body having a bridge to which each of the strings are respectively mounted, a neck having frets and a nut or 'zero' fret, and a head having tuning pegs to which each of the strings are also respectively mounted. The length of the string is the distance between the bridge and the nut or 'zero' fret. The amount of tension on the string is determined by the winding of the tuning peg, which tightens and loosens the string (i.e. imparting tension) in order to tune the string to a certain note. In playing a stringed instrument, when a musician presses down on a string at a fret, the length of the string is changed and therefore its frequency is changed as well. The frets are spaced out so that the proper frequencies are produced when a string is held down at a given fret (and therefore the proper note is produced).

Looking at electrical stringed instruments, and utilizing an electric guitar as a particular example, to produce sound an electric guitar electronically senses the vibration of a string and generates an associated electrical signal and then routes the associated electric signal to an amplifier. The sensing generally occurs by utilizing electromagnetic pickups mounted under each of the strings of the guitar, respectively, in the guitars' body and neck, at different locations.

These electromagnetic pickups typically consist of a bar magnet wrapped with a coil of thousands of turns of fine wire.

The vibrating steel strings of the electric guitar produce a corresponding vibration in the magnetic field of the electromagnetic pickup and therefore a current in the coil. This current represents the sound of the string at the location of the pickup and can be routed to an amplifier. Many electric guitars have two or three different magnetic pickups located at different points of the body and neck. Each magnetic pickup will have a distinctive sound, and multiple pickups can be paired, either in-phase or out, to produce additional variations. Thus, the electromagnetic pickup locations for particular types of electric guitars are a major factor in determining the "sound" associated with the particular electric guitar along with other factors.

Continuing with the guitar as an example, to recreate the full spectrum of classic guitar sounds, each with its own particular characteristics and nuances, a guitarist has traditionally been required to use many different guitars along with various classic amplifiers and different sound-effects processors. Alternatively, a guitarist may use one guitar equipped with a variety of preamps and/or signal-processing equipment that allows for varying degrees of compromised approximations of the desired classic sounds.

Guitars have been produced that, by various means, perform modeling functions to model the sounds of various other guitars. For example, previous modeling guitars have processed the individual strings of a guitar by means of outboard processing gear or by means of embedded processing electronics built into the guitar itself. Unfortunately, many of these previous attempts to provide a modeling guitar require the use of exotic cabling and/or specialized electronic processing equipment.

BRIEF DESCRIPTION OF THE DRAWINGS

The features and advantages of the present invention will become apparent from the following description of the present invention in which.

DETAILED DESCRIPTION

In the following description, the various embodiments of the present invention will be described in detail. However, such details are included to facilitate understanding of the invention and to describe exemplary embodiments for implementing the invention. Such details should not be used to limit the invention to the particular embodiments described because other variations and embodiments are possible while staying within the scope of the invention. Furthermore, although numerous details are set forth in order to provide a thorough understanding of the present invention, it will be apparent to one skilled in the art that these specific details are not required in order to practice the present invention. In other instances details such as, well-known methods, types of data, protocols, procedures, components, processes, interfaces, electrical structures, circuits, etc. are not described in detail, or are shown in block diagram form, in order not to obscure the present invention. Furthermore, aspects of the invention will be described in particular embodiments but may be implemented in hardware, software, firmware, middleware, or a combination thereof.

Figure 1:
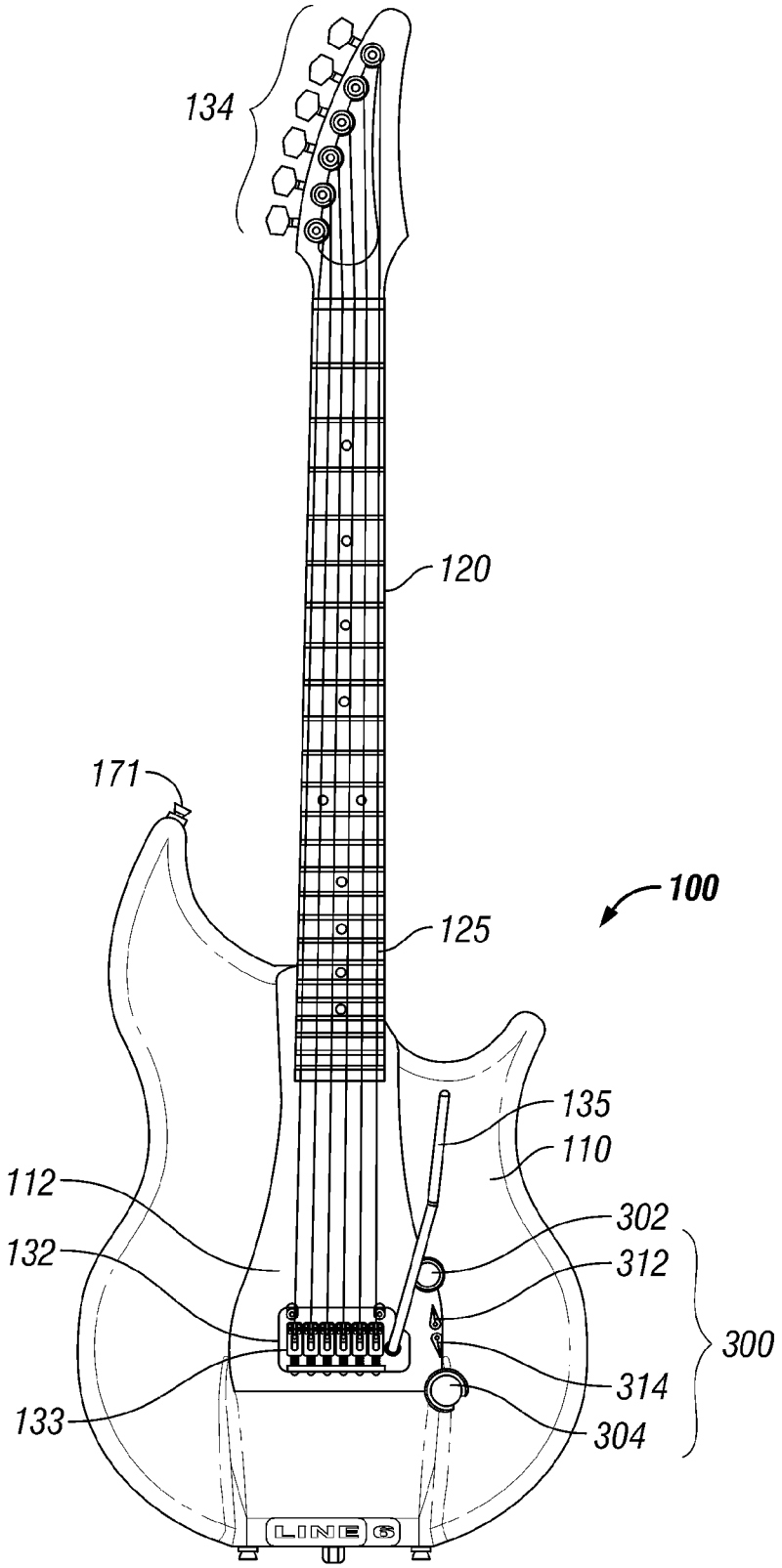
FIG. 1 is a front view of an electric stringed instrument, according to one embodiment of the present invention.

Embodiments of the invention relate to a stringed instrument, and more particularly, to electric stringed instruments, such as an electric guitar. With reference to FIG. 1, FIG. 1 is a front view of an electric stringed instrument 100, such as an electric guitar, according to one embodiment of the present invention.

It should be appreciated that, in this embodiment, the stringed instrument is described as being an electric guitar 100 having six strings, but that the teachings of the invention to be hereinafter described may be applied to any stringed instrument and the stringed instrument may be any type of stringed instrument (e.g. mandolin, banjo, bass, violin, sitar, ukulele, etc.) and should not be limited only to an electric guitar.

As can bee seen in FIG. 1, the electric guitar 100 includes a conventional design having a standard body 110 including a playing front face 112 and an opposite back face (not shown). A neck 120 may be fixedly attached to the body.

Also, as is well known, strings 125 are respectively connected between a bridge 132 and conventional tuning pegs 134 at the distal end of the neck 120—each string 125 being respectively captivated at the bridge 132 and the tuning peg 134. The tuning pegs 134 may be turned to keep the strings 125 under tension, maintain sufficient string pressure along the bridge 132, and to tune the guitar.

In one embodiment, bridge 132 includes a plurality of transducers 133 (e.g. six transducers 133) into which each string 125 is captivated and each transducer is pressed upon with a certain degree of pressure imparted by the string by the turning of a corresponding tuning peg 134 such that bridge 132 functions as a polyphonic pickup. However, transducers 133 may also be located away from the bridge as well, such that the polyphonic pickup functionality may be located at the bridge or at other locations. When a string 125 is played, a transducer 133 detects a vibration signal of the string. Thus, transducers 133 perform the function of a pickup and will hereinafter be referred to as transducer pickups. In one embodiment, these transducer pickups may be piezoelectric pickups. It should be appreciated that when a transducer 133 detects a string vibration signal that this signal is a "raw" string signal, which, by itself, isn't useable from a tonal point of view, without further processing. However, as will be described later, this tonal processing may be implement by a computer.

Additionally, a conventional vibrato bar 135 may be attached to the bridge to allow a musician to move the bridge and change the pitch of the strings in order to produce this type of desired sound effect.

Thus, each of the plurality of strings 125 is respectively coupled to a transducer pickup 133 of a polyphonic pickup 132. The polyphonic pickup 132 is used to detect a vibration signal for each string 125 (e.g. when a string is played by a musician). In the example shown, the polyphonic pickup 132 is a hexaphonic pickup to accommodate the six strings 125.

The polyphonic pickup 132 may be a piezoelectric type of pickup to detect the vibration signal for each string 125 or any other type of suitable sensor (e.g., magnetic, optical, etc.) to detect the vibration signal for each string. As previously described, these pickups and sensors may be integrated into the bridge assembly or may be placed at other locations. Thus, a polyphonic magnetic or optical pickup that is not attached to the bridge can also be used. Moreover, in other embodiments, the polyphonic pickup 132 may be of any suitable size to accommodate any number of strings for the desired string instrument to be emulated.

Although a particular embodiment of body 110 has been described, it should be appreciated that body 110 may be constructed in many different forms, with many different types of shapes and features, dependent upon design configurations, and this is just one example.

In one embodiment, the body 110 may be constructed from an ABS (Acrylonitrile Butadiene Styrene) plastic reinforced with graphite fibers for structural strength and electrical shielding properties. In another embodiment, the body 110 may be constructed primarily of wood. Neck 120 may be standard in terms of frets, neck attachment, truss rod, and fingerboard and may or may not include a headstock. Neck 120 may be constructed from standard materials for guitar necks such as wood with steel reinforcing components. Also, the neck and body could be a single piece, made of a single piece of plastic, or of composite construction.

As will be described in more detail later, electric stringed instrument 100 includes an analog to digital (A/D) converter to convert each detected vibration signal from each string 125 from each associated pickup transducer 133 to digital form and a digital connector allows for the coupling of the digitized string signals, as well as audio parameters selected by the user, as will be discussed, to be transmitted to a computer for processing. Particularly, as will be described in more detail later, a personal computer may be used to process each digital string vibration signal of each string, picked up by each pickup transducer of the polyphonic pickup, respectively, such that a corresponding string tone of one of a plurality of selectable stringed instruments may be emulated.

Also, a user interface 300 may be located on the body 110 of the electric guitar 100 to allow a user to select and modify audio parameters, according to embodiments of the invention.

In one embodiment, user interface 300 located on the body 110 of the electric guitar 100 includes a pair of rotary control knobs 302 and 304 and a pair of up/down select pushbuttons 312 and 314, respectively. The control knobs and pushbuttons may either be pre-defined or user-defined.

For example, the up/down select pushbuttons 312 and 314 may be used to allow the user to cycle through the various selectable types of guitars, synthesizers, and other instruments that may be emulated with the electric guitar 100. As one example, the instrument up/down selector buttons 312 and 314 may be utilized to select a variety of different types of solid body electric guitars, hollow body electric guitars, a variety of different types of acoustic guitars (steel or nylon string), as well as other types of guitars, other types of instruments or synthesizer configurations.

For example, one of the rotary control knobs 302 may be used to adjust the volume of the electric guitar 100. As another example, the other rotary control knob 304 may be utilized by a user to select a plurality of different tones for the previously-selected instrument chosen with the up/down selector buttons. These dialable user selected parameters include tone changes via different selectable: emulated pickups (e.g. rhythm, treble, standard, etc. [e.g. dual coil, thin single coil, wide single coil, etc.), pickup positions, voicings, filter resonance, and filter cut-off frequencies, different (series or parallel) wirings, etc.; to achieve different tones for the selected instrument.

Figure 2:
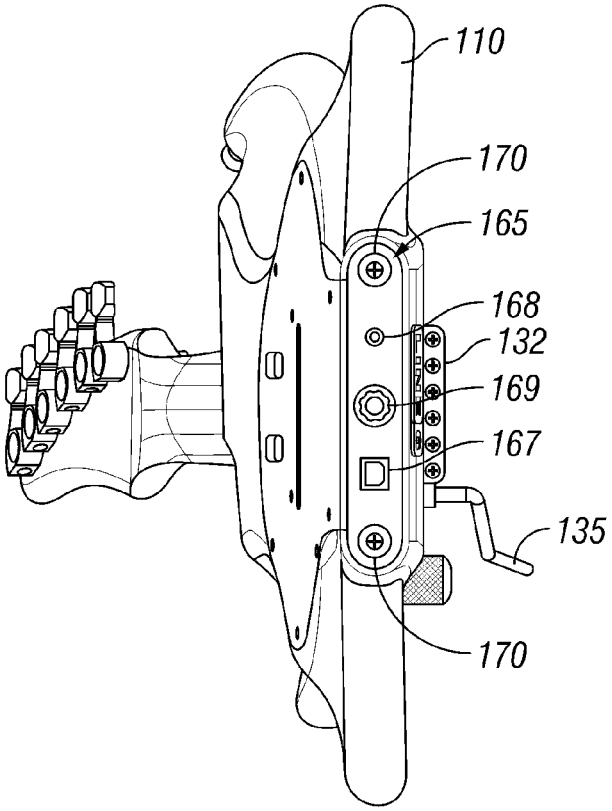
FIG. 2 is a side view of a bottom connector portion of the electric stringed instrument, according to one embodiment of the present invention.
Figure 3:
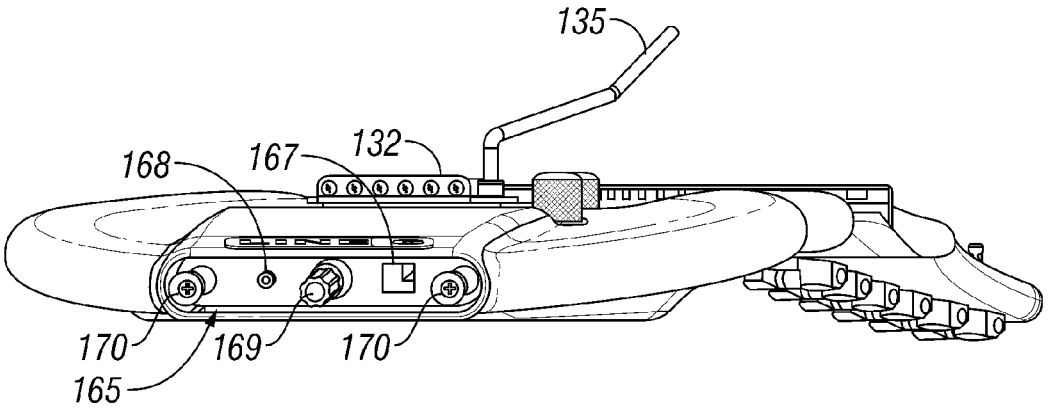
FIG. 3 is a perspective view of the bottom connector portion of the electric stringed instrument, according to one embodiment of the present invention.

With reference now to FIGS. 2 and 3, FIGS. 2 and 3 are side and perspective views, respectively, of a bottom connector portion 165 of the body 110 of the electric guitar 100, according to embodiments of the invention. The bottom connector portion 165 includes a digital connector 167, a processed audio connector 168, and an audio output level controller 169. Additionally, a pair of strap connectors 170 may be located on the bottom connector portion 165. A guitarist my connect his or her guitar strap to one of these strap connectors 170 and strap connector 171 (see FIG. 1) so that the guitar can be slung around the guitarist's body.

The digital connector 167 may be a serial connector such as a universal serial bus (USB) connector. In one embodiment, digital connector 167 may be a USB 2.0 compatible connector for carrying digital audio and control parameters (e.g. user selected audio parameters) to and from a computer that performs digital audio processing.

For example, as a user plays the electric guitar 100, the detected analog vibration signals from the transducer pickups are each converted to digital form by the A/D converter and digital connector 167 couples each of the digitized string signals, as well as the audio parameters of the user interface 300 selected by the user through a suitable serial cable, to a computer for processing.

After the digitized string vibration signals for each string played by a user are processed by the computer such that a user selected instrument (e.g. guitar) with user-selected parameters has been digitally emulated by the computer, the emulated digital tone signals are transmitted back via a suitable serial cable through the serial digital connector 167 to the electric stringed instrument 100 and are converted back to analog form (e.g. by a D/A converter) and transmitted through processed audio connector 168 to the headphones of a user or to an amplifier or another playback device. In one embodiment, processed audio connector 168 is an analog connector and outputs processed analog audio. A standard cable can be used to route the emulated analog signals to a player's headset or an amplification system such as an amplifier However, in other embodiments, processed audio connector may be a digital audio connector.

In addition to analog audio connector 168, in one embodiment, a digital connector may also be utilized with electric guitar 100. For example, a S/PDIF (Sony/Phillips Digital Interface Format) digital connector may be utilized. However, it should be appreciated that other types of digital connectors may also be used. The digital connector may be located near the processed audio connector 168 in the bottom connector portion 165 of the body 110 or at other locations on the guitar, such as the front or back face. As is known, the S/PDIF format provides a collection of hardware and low-level protocol specifications for carrying digital audio signals between devices and stereo components.

In this embodiment, the processed digital signals returned back from the computer through the serial cable and through the serial digital connector 167 to the electric stringed instrument 100, before being converted back to analog form (e.g. by a D/A converter), are outputted through the S/PDIF digital connector. The processed digital signals are outputted through the S/PDIF digital connector via a suitable cable to digital devices, such as digital recording devices, other computers to further process, record and/or playback the processed digitals signals, and other digital devices (e.g. a digital amplifier).

Figure 4:
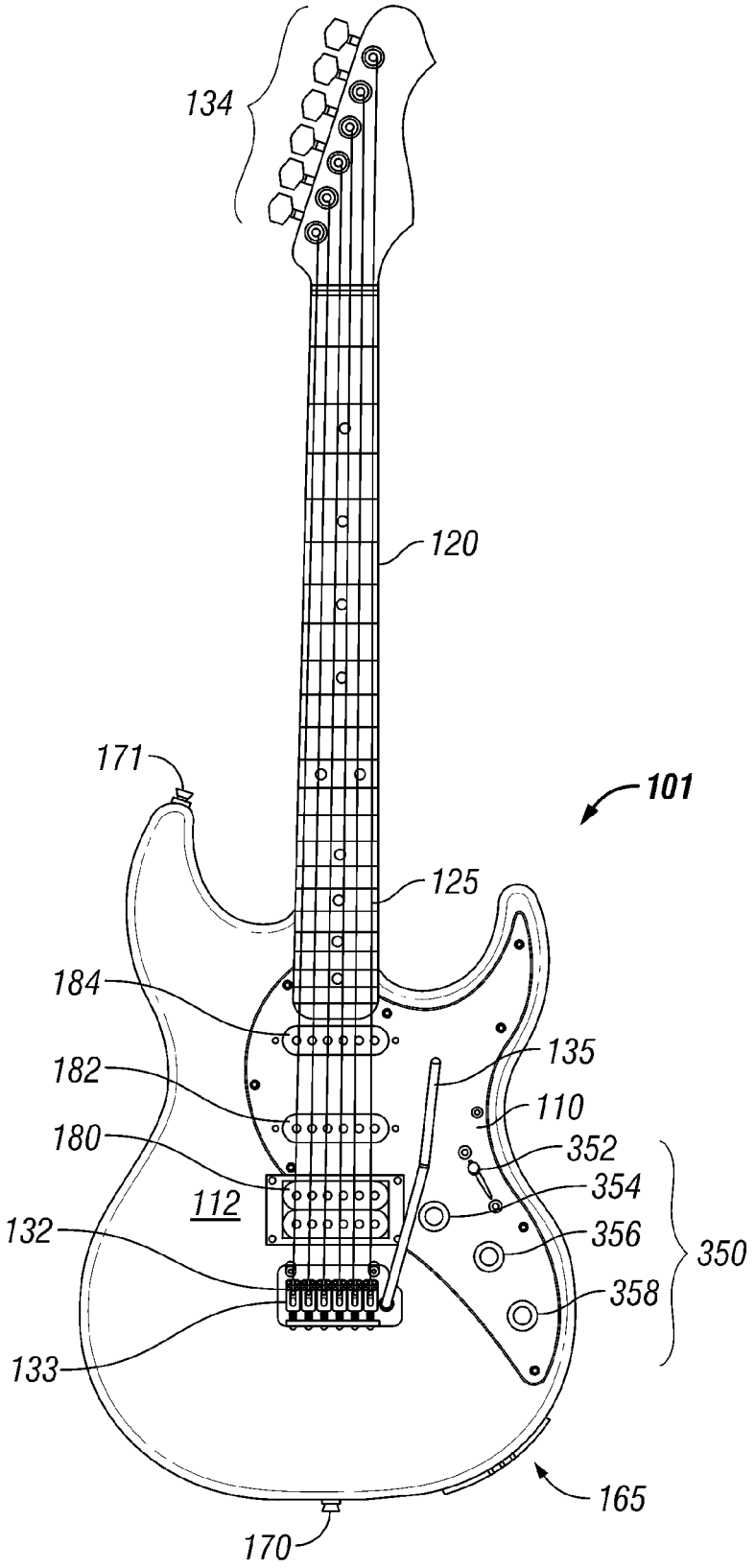
FIG. 4 is a front view of the electric stringed instrument including electromagnetic pickups, according to one embodiment of the present invention.

With reference now to FIG. 4, in another embodiment, electric guitar 101 may also include electromagnetic pickups, according to embodiments of the present invention. The electric guitar 101 of FIG. 4, except for the use of electromagnetic pickups, has many of the same components of the electric guitar 100 described in FIGS. 1-3, and therefore only the differences will be discussed, and the same components will not be discussed for brevity's sake.

Particularly, it should be appreciated that electric guitar 101 includes the same type of polyphonic pickup 132 having a plurality of transducers 133 (FIG. 1) and bottom connector portion 165 (FIGS. 2 and 3). The only difference, as to the bottom connector portion 165, being that the bottom connector portion 165 is off more to the side.

Electric guitar 101 may also include electromagnetic pickups in conjunction with the transducers 133 of polyphonic pickup 132. As shown in FIG. 4, a standard electromagnetic pickup arrangement may be utilized including a first set of humbucker pickups 180, a second set of single coil pickups 182, and a third set of single coil pickups 184. These pickups may be interconnected or utilized separately via standard and well-known electric guitar circuitry to create a standard mono analog signal source for output.

In this configuration, electric guitar 101 may produce a wide variety of different types of guitar output signals. In particular, electric guitar 101 may additionally produce an analog signal via the electromagnetic pickups (180,182, 184). The analog signal may be directly outputted through audio connector 168 to output devices (e.g. amplifier, headphones, etc.).

Additionally, the analog signal may be converted into a digital signal (via A/D conversion) or kept as a pure analog signal, for transmission alone or in conjunction with the digital signals directly measured from the transducers 133 of the polyphonic pickup (which are also converted via A/D conversion) through the digital connector 167 over a serial link to a computer for processing. During processing, the digitized analog signal from the electromagnetic pickups may be mixed with modeled digital signals based upon the transducer 133 sources of the polyphonic pickup. Alternatively, the pure analog signal from the electromagnetic pickups could be mixed.

Further, a standard electric guitar user interface 350 located on the body 110 of the electric guitar 101 may be utilized. This standard electric guitar user interface 350 may include a blade switch 352 that is moveable to select the different electromagnetic pickups (180,182, 184), and combinations thereof, for different types of sound (e.g. rhythm, normal, lead, etc.), as is known. Further, standard electric guitar user interface 350 includes rotary knobs such as a master volume rotary knob 354 and tone control knobs 356 and 358. Other types of rotary control knobs such bass, treble, middle, etc., may also be utilized dependent upon design considerations. It should be appreciated that this is just one example of a standard electric guitar user interface 350, and that many alternatives and variations are possible.

Thus, with electric stringed instrument 100 or 101, an electric guitar is provided that may be used with a personal computer, as will be hereinafter described, to emulate a wide variety of different guitars and/or other stringed instruments. It should be appreciated that the sound derived from present day electric guitars that provide a standard analog output or that utilize a polyphonic pickup to directly derive a sound (either in mono or hexaphonic form) is oftentimes too limited for today's musician. Therefore, although systems have previously existed that provide separate outputs for each string, these systems have not provided the full range of processing on a string-by-string basis, which may now be implemented by many present day computing devices with embodiments of the invention herein set forth, to emulate a wide variety of instruments, pickup types and configurations, amplifiers, effects, etc., in order have wide range of sounds that are desired by today's musician, as will be discussed.

Hereinafter, particular examples of the types of processing and emulation functions performed by the computer in conjunction with the electric guitar in order to emulate different guitars, stringed instruments and other instruments will now be described.

Embodiments of the invention also generally relate to a computer-enabled stringed instrument, such as a guitar, that will accurately simulate the sounds of electric and acoustic guitars, as well as other stringed instruments, and/or various synthesized instruments. The computer-enabled guitar may also provide a wide range of amplifier and cabinet sounds along with selectable audio effects. As will be described, the data acquisition, formatting, and data-transfer electronics are integrated into the stringed instrument itself, while computer software modules reside on a personal computer to enable audio modeling, audio effects, transposition, and automation.

Figure 5:
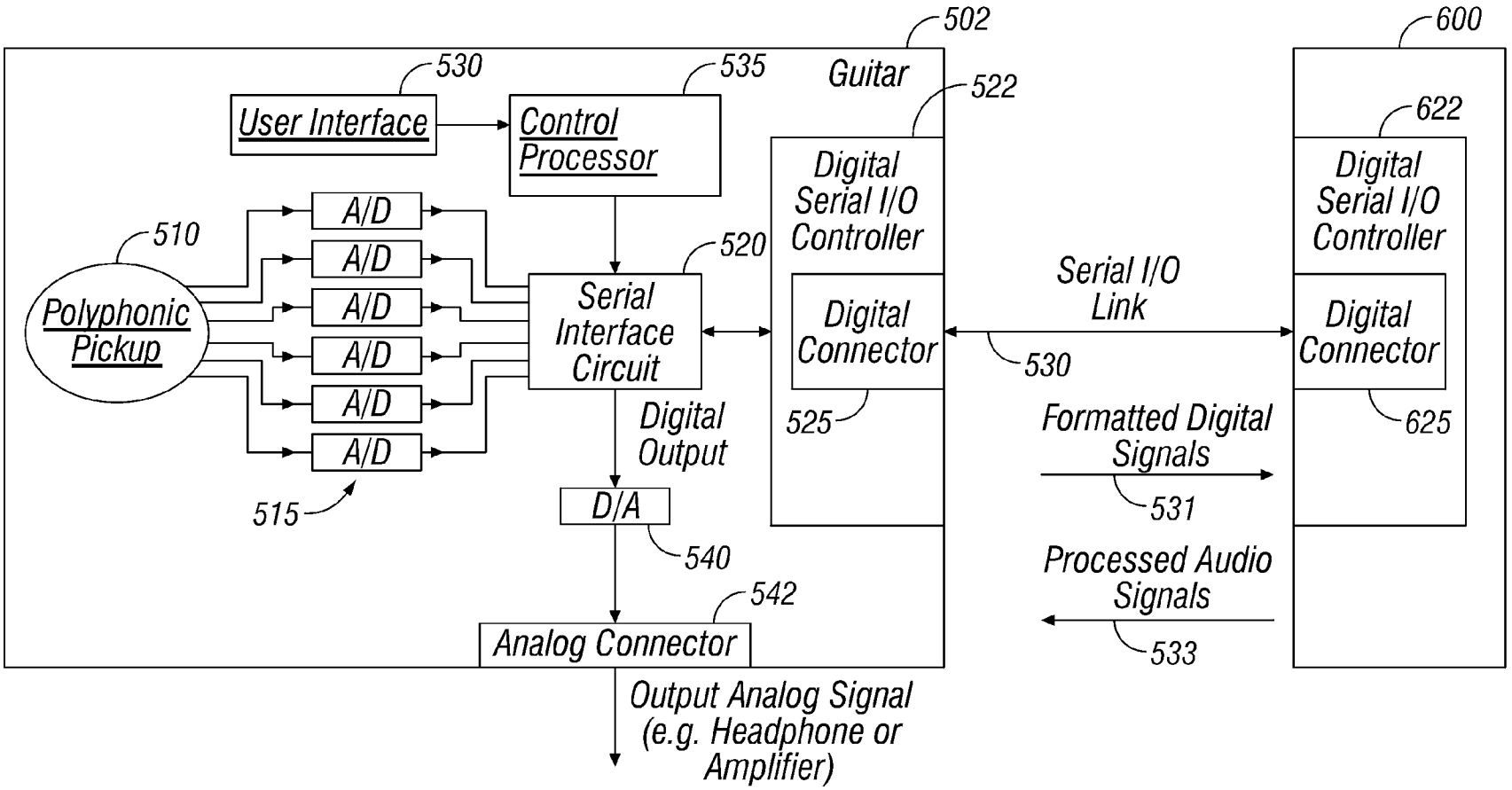
FIG. 5 is a block diagram illustrating an electric stringed instrument that includes data acquisition, formatting, and data-transfer functionality integrated into the stringed instrument itself coupled to a computer for DSP processing, according to one embodiment of the present invention.

Turning now to FIG. 5, FIG. 5 is a block diagram illustrating a stringed instrument 502 that includes data acquisition, formatting, and data-transfer functionality integrated into the stringed instrument itself, according to one embodiment of the present invention. In this example, stringed instrument 502 may be a guitar, such as the previously-discussed electric guitar discussed with reference to FIGS. 1-4. However, it should be appreciated that any type of stringed instrument or guitar configuration may be utilized. For ease of reference, stringed instrument 502 will hereinafter be referred to as guitar 502

As shown in FIG. 5, the guitar 502 include a polyphonic pickup 510, a plurality of analog-to-digital (A/D) converters 515, a serial interface circuit 520, a digital serial I/O controller 522 having a digital connector or port 525, a user interface 530, a control processor 535, a digital to analog (D/A) converter 540 and an analog connector 542.

As previously discussed, the guitar 502 may include a plurality of strings and a pickup to which each of the plurality of strings is respectively coupled. In this example, the pickup may be a polyphonic pickup 510 located at the bridge or at other locations. The polyphonic pickup 510 may be a piezoelectric type of pickup to detect the vibration signal for each string. Alternatively, any other type of suitable sensor to detect the vibration signal for each string may be utilized, such as a magnetic or optical pickup. The sensor also need not be integrated into the bridge assembly. For example, a polyphonic magnetic or optical pickup that is not attached to the bridge can also be used. Moreover, in other embodiments, the polyphonic pickup 510 may be of any suitable size to accommodate any number of strings for the desired string instrument to be emulated.

The polyphonic pickup 510 is utilized to detect a string vibration signal associated with each string as the string is played. The polyphonic pickup 510 is respectively coupled to A/D converters 515 and the A/D converters 515 are each respectively coupled to a serial interface circuit 520. By utilizing the polyphonic pickup 510 and the A/D converters 515, each of the detected string vibration signals is converted into a digital string vibration signal and is passed onto the serial interface circuit 520. Additionally, as previously described, an analog signal from magnetic pickups may be either digitized or sent in straight analog form to the computer for processing in addition to, or in lieu of, the digital string vibration signals.

It should be noted that in this example, there are six A/D converters 515, one for each string of the guitar. Thus, the polyphonic pickup 510 is used to detect a vibration signal for each of the six strings (e.g. when a string is played by a musician) and the detected vibration signal of the played string is coupled to the respective A/D converter 515, where it is converted into a digital string vibration signal, which is then passed onto serial interface circuit 520.

As previously discussed, guitar 502 may include a user interface 530 and a control processor 535. The user interface 530 of the guitar 502 may include a plurality of different types of interfaces to allow a user to select different types of guitars, stringed instruments, synthesized instruments, as well as user selections regarding the volume, tone, and other aspects of the sound. As previously discussed with respect to FIGS. 1-4, the user interface may include, for example, a rotary volume knob to adjust the volume of the guitar, a rotary selector knob, and a pair of up/down select buttons. The up/down select buttons may be used to allow the user to cycle through various selectable types of electric and acoustic guitars, synthesizers, and other instruments that may be emulated. As one example, the up/down selector buttons may be utilized to select a variety of different types of electric and acoustic guitars (e.g. steel or nylon string), as well as other types of stringed instruments, other types of general instruments or synthesizer configurations.

Further, as previously discussed, the rotary selector knob allows a user to select a plurality of different tones for the previously-selected instrument chosen. Selectable parameters may include tone changes via different selectable: emulated pickups (e.g. rhythm, treble, standard, etc.), pickup positions, voicings, filter resonances, filter cut-offs, different wirings, etc.; to achieve different tones for the selected instruments.

It should be appreciated that although a particular user interface has been previously described with reference to the exemplary guitar of FIGS. 1-4, that a wide variety of different types of user interfaces including LCDs, graphic displays, touch-screens, alphanumeric entry keys, etc., can be used to perform the function of the knobs and dials, previously discussed, and other functions as well.

Control processor 535 may be utilized to process and provide the selections from the user interface 530 to the serial interface circuit 520. The control processor 535 may also provide other functionality to the guitar 502 such as power-on, reset, power-off, and may be used to control the user interface 530 and the serial interface circuit 520, as will be hereinafter discussed.

Serial interface circuit 520 is coupled between the polyphonic pickup 510 and digital serial I/O controller 522. The serial interface circuit 520 is utilized to format each digital string vibration signal into a digital serial protocol and to transmit each serial formatted digital string signal to the digital serial I/O controller 522.

Computer 600 is coupled by a serial input/output (I/O) link 530 to the digital connector 525 of the guitar 502 such that computer 600 receives each serial formatted digital string signal over the serial link 530.

As will be discussed in more detail later, computer 600 operates at least one audio DSP-based software module to process each received serially formatted digital string signal. Each serially formatted digital string signal is processed by computer 600, utilizing one or more of the audio DSP-based software modules, in order to emulate a corresponding string tone of one of a plurality of selectable stringed instruments to create an emulated digital string tone signal. These emulated digital string tone signals are then transmitted back over the serial link 530 to guitar 502 for playback.

Particularly, these emulated digital string tone signals may be coupled back through the digital connector 525, through the serial interface 520, through D/A converter 540 which converts the emulated digital string tone signals into analog form and through an analog connector 542 of guitar 502 to headphones or an amplifier such that the musician can hear the outputted analog signal. It should be appreciated that suitable headphones with a suitable cable or a suitable amplifier with a suitable cable may be plugged into analog connector 542 such that a musician can hear the outputted analog signal that has been processed by computer 600 to emulate a desired instrument selected by the user such as a selected electric guitar, acoustic guitar, or other instrument.

It should be appreciated that control processor 535 and serial interface circuit 520 may be separate or integrated and may be any sort of suitable processor or microprocessor to process information in order to implement the functions of the embodiments of the invention. As illustrated examples, the "processor" may include a processor having any type of architecture such as complex instruction set computers (CISC), reduced instruction set computers (RISC), very long instruction word (VLIW), or hybrid architecture, a microcontroller, a state machine, a digital signal processor (DSP), an application specific integrated circuit (ASIC), or any suitable type of logic device.

These functions can be implemented as one or more instructions (e.g. code segments), to perform the desired functions or operations of the invention. When implemented in software (e.g. by a software or firmware module), the elements of the present invention are the instructions/code segments to perform the necessary tasks. The instructions which when read and executed by a machine or processor, cause the machine or processor to perform the operations necessary to implement and/or use embodiments of the invention. The instructions or code segments can be stored in a machine readable medium (e.g. a processor readable medium or a computer program product), or transmitted by a computer data signal embodied in a carrier wave, or a signal modulated by a carrier, over a transmission medium or communication link.

In continuing with this example, control processor 535 and serial interface circuit 520 may operate under the control of software or firmware modules that include programs that allow for the selection of a desired guitar to be emulated, various previously-described volume or tone effects, as well as to format the incoming detected digital string vibration signals from the polyphonic pickup into a particular serial protocol-based format for transmission over serial I/O link 530. Examples of suitable protocol-based serial interface protocols that the serial interface circuit may convert these digital string signals into include universal serial bus (USB), USB-2, IEEE 1394 (FireWire), IEEE 802.11 (WiFi), etc.

In this implementation, guitar 502 includes a digital serial I/O controller 522 with a digital connector 525 and computer 600 similarly includes a digital serial I/O controller 622 and a digital connector 625 and a serial I/O link 530 therebetween. These digital serial I/O controllers and connectors and links may be of a suitable serial protocol such as USB, USB-2, etc. Embodiments of the invention will be hereinafter described wherein the digital serial I/O protocol is a USB-2 protocol, however, as previously described, any high-speed serial protocol may be utilized.

Utilizing a common serial protocol, guitar 502 may communicate with computer 600 via serial I/O link 530 utilizing standard serial I/O controllers and serial connectors. More particularly, formatted digital signals 531 from guitar 502 may be transmitted across serial I/O link 530 to computer 600. At computer 600, various audio DSP-based software modules are utilized to process each of the received serially formatted digital string signals and these serially formatted digital string signals are processed in order to emulate a corresponding string tone of one of a plurality of selectable stringed instruments to create an emulated digital string tone signal. Processed audio signals 533 including these emulated digital string tone signals are transmitted back to the guitar 502 over serial link 530 to the stringed instrument for playback.

Due to the ubiquity of personal computers along with their affordability and ever expanding computational capabilities, personal computers provide low-cost easy to use processing machines to recreate any number of processing effects upon digital signals. Embodiments of the invention leverage the enormous processing power provided by the average personal computer to provide an elegant and fully integrated experience to any musician or guitarist.

Particularly, in the USB example, with a single USB connection, a musician can easily plug guitar 502 into personal computer 600 and obtain a variety of emulated guitars, instruments, amplifiers, and sound effects, as will be described. In addition to faithfully recreating all of these sonic nuances, the computer may also provide powerful music production capabilities, e.g., automated parameter changes, pitch transposition, streamlined automated music notation, unlimited post recorded editing, etc.

By utilizing the high-speed capabilities available to high speed serial protocols, such as USB-2, each string may be represented in high-resolution detail. Particularly, guitar 502 including the previously-described self-contained electronics that convert the analog signals from polyphonic pickup 510 into a high-resolution serial digital data format in conformance with USB-2 protocol allows each string to be streamed across the serial I/O link 530 as multi-channel audio data in conformance with the USB-2 protocol.

Figure 6:
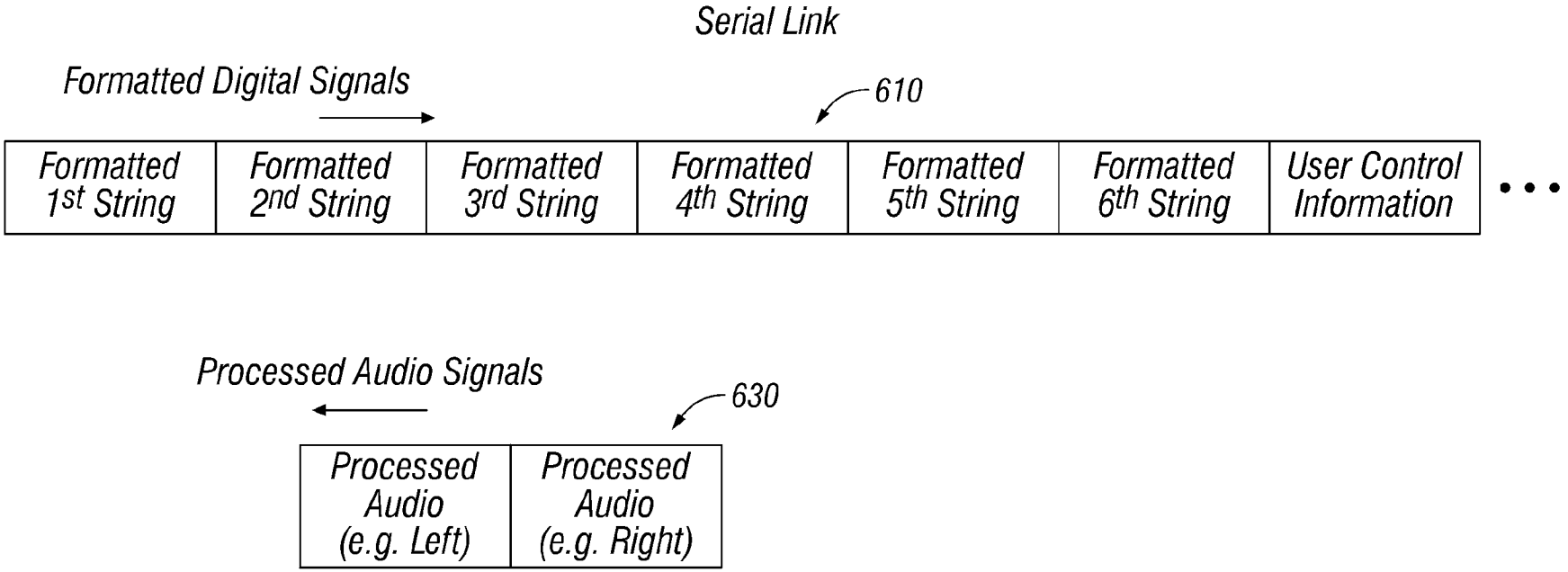
FIG. 6 is a diagram illustrating a serial stream that shows serially formatted digital signals divided into six different channels, one channel for each string, according to one embodiment of the present invention.

Turning now to FIG. 6, a serial stream 610 is illustrated which shows that the digital signals may be serially formatted in six different channels, one channel for each string. As particularly shown in FIG. 6, the stream includes: a formatted first string, a formatted second string, a formatted third string, a formatted fourth string, a formatted fifth string, a formatted sixth string, as well as user control information. Thus, each digital string signal may be represented in high resolution detail and transmitted at high speeds across serial link 530.

This allows for distributed processing of high resolution data. Each string is represented as an individual data channel in stream 610, and the high bandwidth protocol of USB-2 accommodates wide word widths as well as high audio sample rates. In this example, utilizing the USB-2 protocol, 24 bit-samples may be supported with a sample rate of 48 KHz. Although it should be appreciated that other communication protocols along with varying bit widths and sample rates may be utilized. Further, processed audio signals that have been processed by computer 600, as will be described, are sent back to the guitar across the serial link for playback.

In one particular embodiment, the serial link may provide separate channels for a separate stream 630 including a separate channel for a left serial mix of the emulated digital string tone signals and a separate channel for a right stereo mix of the emulated digital string tone signals, wherein both the left and right stereo mix of emulated digital stringed tone signals are transmitted back over the serial link to the guitar for playback. Thus, this implementation utilizes a protocol-based serial interface to provide bi-directional communication capabilities between a serial interface circuit 520 of guitar 502 and a personal computer 600. Thus, a self-contained computer-enabled guitar controller is connected to a computer by means of a standard USB port. In this particular example, everything is bus powered, and therefore the USB cable is the only connection required.

Further, the communication between the guitar 502 and the computer 600 is in a bi-directional format such that the guitar is more than just an input device to the computer. Each digital sample for each string is sent to the computer for processing, and processed audio is sent back to the guitar for low-latency stereo monitoring. This is an advantageous feature because this allows for a sub 10-millisecond delay, which is imperceptible to the vast majority of users. This low-latency feature is preferable in that it enables the guitar to take full advantage of a computer in a manner suitable for a discerning musician. For the sake of comparison, in a typical computer configuration, routing sound through an application and a sound card typically exceeds 50-milliseconds which makes for a non-responsive, sluggish, and awkward performance experience.

Also, as previously discussed, user control information is also transmitted in a channel along the serial link in addition to string data such that the controls on the guitar may manipulate the user interface of a computer application and likewise the computer application may manipulate aspects of the guitar.

The computer 600 acts as a processing engine, which affords a comparatively unlimited amount of DSP to authentically model a broad range of instruments and effects. The computer 600 may also provide a virtual user interface to accommodate any number of features.

Thus, guitar 502 may be connected to a personal computer 600 and powered by means of a standard USB cable and connector. The data may be processed by the computer to perform various modeling and signal processing operations. The processed data is subsequently available to other computer applications, and in addition, is routed back to the guitar for various user low-latency applications.

In particular, processed audio signals 630 include processed audio for a left channel and processed audio for a right channel. More particularly, along the serial link a separate channel for a left stereo mix of emulated digital string tone signals and a separate channel for a right stereo mix of emulated digital string tone signals are provided. Both the left and right stereo mix of emulated digital string tone signals may be transmitted back over the serial link to the stringed instrument for playback. It should be appreciated that the processed audio signals 533 could be one or more channels, providing, for example, a monophonic mix or a multi-channel surround sound mix. At the guitar, the left and right stereo mix of emulated digital string tone signals 630 may be converted by D/A converter 540 into a left and right stereo mix of emulated analog string tone signals and outputted from the guitar through an analog output connector 542 to one of headphones or an amplifier for low-latency playback.

It should be appreciated that the processed audio signals 533 could alternatively or additionally be routed out of any analog or digital output available on the personal computer 600 or any other connected audio interface for processing. Further, processed audio signals 533 could also remain within personal computer 600 for storage or processing by suitable software applications.

Figure 7A:
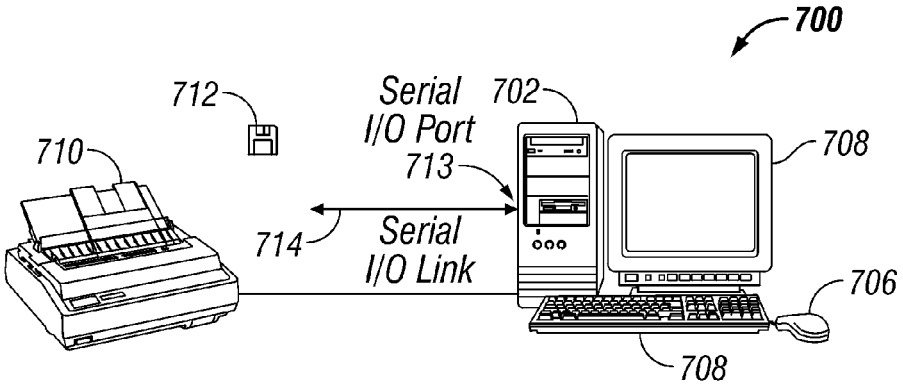
FIG. 7A is a diagram illustrating an example of a general computing system, such as a personal computer, in which various aspects of the present invention may be utilized.

With reference now to FIG. 7A, FIG. 7A illustrates a conventional data processing or personal computer system usable with embodiments of the present invention. More particularly, FIG. 7A illustrates an example of a general computing system 700 for use as an example of personal computer 600 in which various aspects of the present invention may be utilized.

As illustrated, personal computer 700 includes a system unit 702, output devices such as display device 708 and printer 710, and input devices such as keyboard 708, and mouse 706. Personal computer 700 receives data for processing by the manipulation of input devices 708 and 706 or directly from fixed or removable media storage devices such as disk 712 and network connection interfaces (not illustrated). Personal computer 700 then processes data and presents resulting output data via output devices such as display device 708, printer 710, fixed or removable media storage devices like disk 712 or network connection interfaces. It should be appreciated that the personal computer 700 can be any sort of computer system or computing device (e.g. personal computer (laptop/desktop), network computer, handheld computing device, server computer, cell phone, game console, portable multimedia device, digital home media center, or any other type of computer). Moreover, system unit 702 may include a serial I/O port 713 (e.g. a USB-2 port) to accommodate input and output data from the guitar serial I/O link 714 (e.g. a USB-2 link).

Figure 7B:
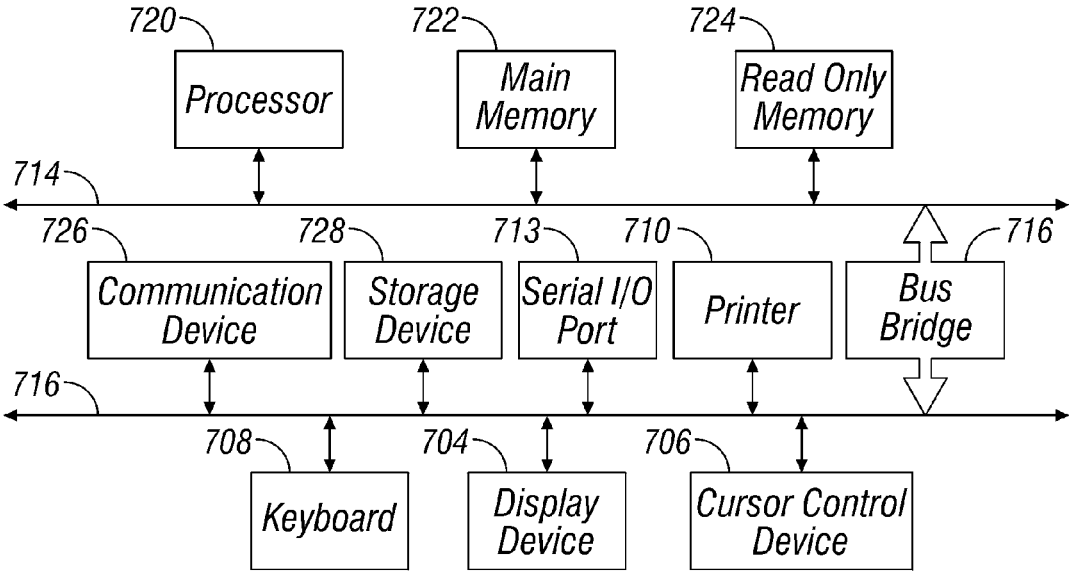
FIG. 7B is a high-level block diagram of the components of the personal computer illustrated FIG. 7A.

Referring now to FIG. 7B, there is depicted a high-level block diagram of the components of personal computer 700 such as that illustrated by FIG. 7A. In a conventional computer system, system unit 702 includes a processing device such as processor 720 in communication with main memory 722 which may include various types of cache, random access memory (RAM), or other high-speed dynamic storage devices via a local or system bus 714 or other communication means for communicating data between such devices. The processor processes information in order to implement the functions of the embodiments of the present invention. As illustrative examples, the "processor" may include a central processing unit (CPU) having any type of architecture such as complex instruction set computers (CISC), reduced instruction set computers (RISC), very long instruction word (VLIW), or hybrid architecture, or a digital signal processor, a microcontroller, a state machine, etc.

Main memory 722 is capable of storing data as well as instructions to be executed by processor 720 and may be used to store temporary variables or other intermediate information during execution of instructions by processor 720. Computer system 700 also comprises a read only memory (ROM) and/or other static storage devices 724 coupled to local bus 714 for storing static information and instructions for processor 720. Examples of non-volatile memory 724 include a hard disk, flash memory, battery-backed random access memory, Read-only-Memory (ROM) and the like whereas volatile main memory 722 includes random access memory (RAM), dynamic random access memory (DRAM) or static random access memory (SRAM), and the like.

System unit 702 of personal computer 700 also features an expansion bus 716 providing communication between various devices and devices attached to the system bus 714 via bus bridge 718. A data storage device 728, such as a magnetic disk 712 or optical disk such as a CD-ROM or DVD and its corresponding drive may be coupled to data personal computer 600 for storing data and instructions via expansion bus 716. Computer system 700 can also be coupled via expansion bus 716 to a display device 704, such as a cathode ray tube (CRT) or a liquid crystal display (LCD), for displaying data to a computer user such as generated meeting package descriptions and associated images. Typically, an alphanumeric input device 708, including alphanumeric and other keys, is coupled to bus 716 for communicating information and/or command selections to processor 720. Another type of user input device is cursor control device 706, such as a conventional mouse, trackball, or cursor direction keys for communicating direction information and command selection to processor 720 and for controlling cursor movement on display 704. Moreover, in the case of the personal computer 600, the system unit 702 includes a serial I/O port 713 (e.g. a USB-2 port) to accommodate input and output data from the guitar through serial I/O link 714 (e.g. a USB-2 link).

A communication device 726 is also coupled to bus 716 for accessing remote computers or servers, such as server 704, or other servers via the Internet, for example. The communication device 726 may include a modem, a network interface card, or other well-known interface devices, such as those used for interfacing with Ethernet, Token-ring, or other types of networks.

In continuing with the example of personal computer 700, personal computer 700 may operate under the control of an operating system that is booted into the memory of the device for execution when the device is powered-on or reset. In turn, the operating system controls the execution of one or more software modules or computer programs. These software modules typically include application programs that aid the user in utilizing the personal computer 700 and the various functions associated with providing a guitar player with selectable audio DSP-based modeling for a variety of electric and acoustic guitars, other instruments, as well as various other audio processing.

These functions can be implemented as one or more instructions (e.g. code segments), to perform the desired functions of the invention. When implemented in software (e.g. by a software module), the elements of the present invention are the instructions/code segments to perform the necessary tasks. The instructions which when read and executed by a machine or processor (e.g. processor 720), cause the machine or processor to perform the operations necessary to implement and/or use embodiments of the invention. The instructions or code segments can be stored in a machine readable medium (e.g. a processor readable medium or a computer program product), or transmitted by a computer data signal embodied in a carrier wave, or a signal modulated by a carrier, over a transmission medium or communication link. The machine-readable medium may include any medium that can store or transfer information in a form readable and executable by a machine (e.g. a processor, a computer, etc.). Examples of the machine readable medium include an electronic circuit, a semiconductor memory device, a ROM, a flash memory, an erasable programmable), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via networks such as the Internet, Intranet, etc.

Figure 8A:
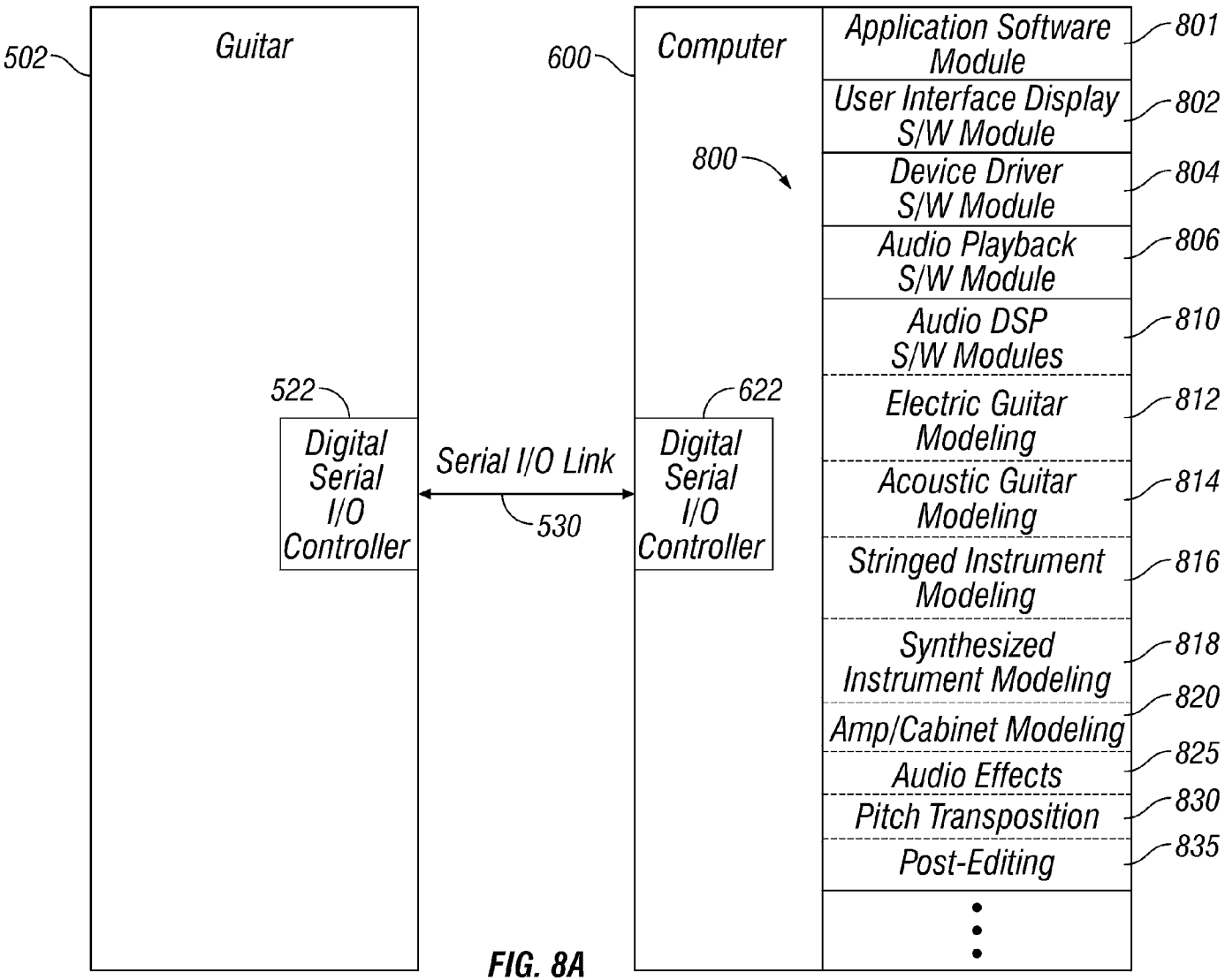
FIG. 8A is a diagram illustrating an example of the electric stringed instrument being coupled through a serial I/O link to a computer, and particularly, illustrates examples of software modules that may be implemented by a computer, according to embodiments of the present invention.

Turning now to FIG. 8A, FIG. 8A illustrates an example of guitar 500 being coupled through digital serial I/O controller 522 and serial I/O link 530 to the digital serial I/O controller 622 of computer 600 and particularly illustrates examples of software modules that may be implemented by computer 600.

As previously discussed, computer 600 is coupled by serial I/O link 530 to a digital connector of digital serial I/O controller 522 such that computer 600 through digital serial I/O controller 622 receives serially formatted digital string signals over the serial I/O link 530. The computer 600 operates a plurality of audio DSP-based software modules to process each received serially formatted digital string signal in order to emulate the corresponding string tone of one of a plurality of stringed instruments to create an emulated digital string tone signal. Each emulated digital string tone signal is then transmitted back over the serial link to the stringed instrument for playback.

Moreover, as previously discussed, a separate channel for each serially formatted digital string signal may be transmitted from guitar 502 over serial link 530 to the computer for processing. Each serially formatted string (e.g. string one, string two, string three, string four, string five, string six) may be individually transmitted over the serial link in its own channel in a high-speed serial protocol (e.g. USB-2) to the computer 600. Further, a separate channel for user control information selected at the guitar may also be transmitted to the computer. Additionally, a channel may be utilized for sending a digitized mono signal from additional electromagnetic pickups, or the straight analog signal, to the computer. This additional signal may be mixed with the otherwise processed signals.

Computer 600 may include a plurality of different software modules 800 to implement various functionality to a user of computer 600 and digital guitar 502. For example, as shown in FIG. 8A, computer 600 may operate software modules 800 such as: application software module 801, a user interface display software module 802, a device driver software module 804, an audio playback software module 806 and a plurality of different types of audio DSP software modules 810. These audio DSP software modules include software modules related to: electric guitar modeling 812, acoustic guitar modeling 814, general stringed instrument modeling 816, synthesized instrument modeling 818, amp/cabinet modeling 820, audio effects 825, pitch transposition 830, and post-editing 835.

After the string signals have been processed by one or more over the various software modules of computer 600, a left stereo mix of emulated digital string tone signals in a first channel and a right stereo mix of the emulated digital string tone signals in a second channel may be transmitted back over the serial link 530 to the guitar 502 for playback. More particularly, the left and right stereo mix of the emulated digital string tone signals received at guitar 502 may be converted by the D/A converter of the guitar into a left and right stereo mix of emulated analog string tone signals which are outputted through an analog output of the guitar to one of a headphones or an amplifier for playback.

Computer 600 may utilize the vast and ever-increasing computational resources of personal computers to support a broad range of guitar, general instrument, amplifier, and effects modeling. Particularly, modeling is provided by computer 600 for electric guitar modeling, acoustic guitar modeling, other stringed instrument modeling, and synthesized instrument modeling.

More particularly, as shown in FIG. 8, personal computer 600 includes a plurality of software modules that enable the functions of the embodiments of the present invention. These software modules typically include application programs that aid the user in utilizing personal computer 600, and the various functions associated with providing a user of guitar 502 with guitar modeling, other instrument modeling, amplifier modeling, effects modeling, as well as other functions Application software module 801 of personal computer 600 controls the interface with guitar 502, the user interface display software module 802, and all the other software modules (e.g. the audio DSP software module 810, the audio playback software module 806, and the device driver software module 804) to provide a user of guitar 502 with guitar modeling, other instrument modeling, amplifier modeling, effects modeling, as well as other functions.

In order to accomplish these functions, application software module 801 utilizes a conventional device driver software module 804, audio DSP software modules 810, and an audio playback software module 806. Audio DSP software module 412 processes the digitized audio signals from guitar 502 (e.g. utilizing DSP algorithms) such that the user can set the sound characteristics for the guitar. Audio DSP software modules 810 can be utilized by the application software module 801 to set the settings of the control panel graphical interface to user selected values to model the sound characteristics of any musical instrument selected by the user. Further, the application software module 801 controls an audio playback software module 806 to control the transmission of the digitally processed sounds of guitar 502 back to the guitar 502 where it is converted back to analog form and played back through amplified speakers or headphones to the user, as previously discussed.

Figure 25:
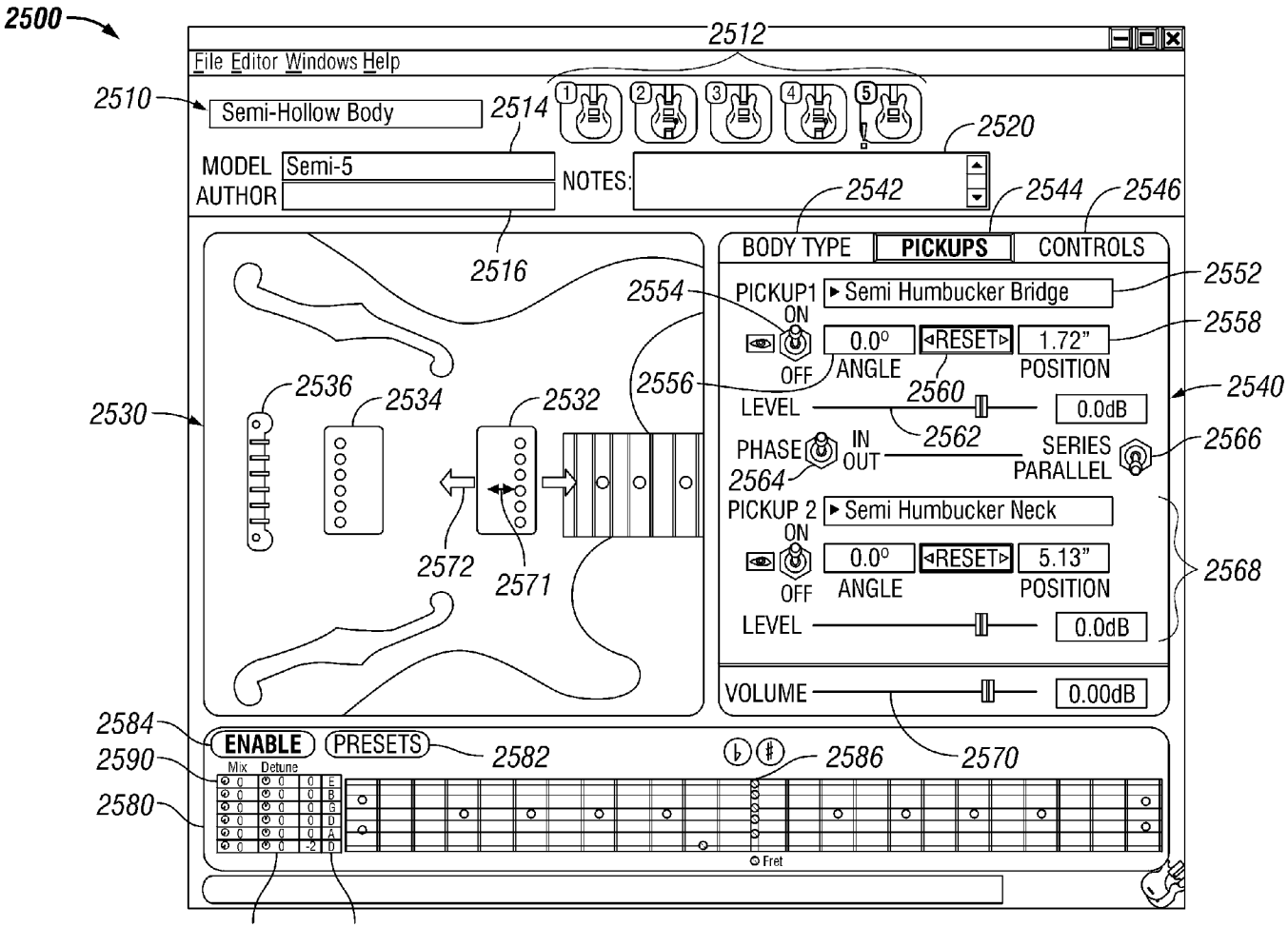
FIG. 25 is a screenshot particularly illustrating an example of control panel graphical interface for a guitar that may be utilized with embodiments of the invention.

Turning now to FIG. 25, FIG. 25 is a screen-shot particularly illustrating an example of a control panel graphical interface for a guitar that may be utilized with embodiments of the invention. This control panel graphical interface illustrates examples of guitar modeling functionality that may be selected by a user and that may be effectuated utilizing the previously-described audio DSP software modules. It should be appreciated that this is only one example of a control panel graphical interface and that a multitude of different types of graphical user interfaces may be utilized.

User interface display software module 802 may generate control panel graphical interface 2500, and in conjunction with audio DSP software modules 810, allows the user to change the settings of the control panel graphical interface such that the audio DSP software modules 810 process the digitized serially formatted audio signal from the guitar to match the selected settings on the graphical interface. Exemplary settings of a control panel graphical interface 2500 for a guitar will now be described.

A particular model of guitar to be emulated may be selected by a user. In this example, via scroll-down window 2510, a semi-hollow body guitar may be selected by a user. Further, with even more granularity, a particular configuration of a semi-hollow body guitar may be selected by the selection of one of a plurality of various selectable guitar configurations shown as selectable icons (1-5) 2512. In this example, body configuration type 5 for the semi-hollow body guitar has been selected. This selection of semi-hollow body configuration 5 is denoted in the model window 2514 as "Semi-5."

Additionally, under the model window 2514, an author window 2516 may be present. The author window 2516 may be a selectable scroll-down window to select a particular type of model and guitar configuration based upon a particular artist or author from a previous studio session. Also, a notes window 2520 may be present in which a user may input notes regarding a particular type of body and configuration of the selected guitar.

It should be noted that a wide variety of different types of guitars with different types of bodies and pickup configurations may be selected utilizing the graphical user interface 2500 and can be modeled utilizing audio DSP software modules 810 including particularly, electric guitar modeling 812 and acoustic guitar modeling 814. For example, for electric guitars different body type configurations may include different types of bodies, pickups, woods, shapes, sizes, hollow bodies, hard bodies, densities, etc. This also holds true for acoustic guitars which may likewise have different types of bodies, bridge configurations, sizes, densities, woods, shapes, etc. Additionally, different types of stringed instruments such as banjoes, sitars, etc., may be selectable and modeled.

Particularly, as shown in window 2530, a close-up view of a user-selected semi-hollow body guitar (configuration 5) is shown. As can be seen in window 2530, a semi-hollow guitar body is shown with two sets of pickups 2532 and 2534 and a bridge 2536.

Next to window 2530, is a window 2540. Window 2540 includes a user control panel graphical interface that allows a user to make a wide variety of different selections to create a given sound for a guitar based upon selectable features related to body type 2542, pickups 2544, and controls 2546. These types of alterable sounds are implemented using the audio DSP software modules 810 previously described.

Particularly, looking at an example for pickups 2544, when the pickups tab 2544 is selected, based upon the body type, a user may control and alter different features of the pickups. For example, based upon the semi-hollow body guitar (configuration 5) that has been selected, a dual-coil humbucker pickup located near the bridge is denoted as pickup 1 2552. However, other pickups may be selectable within the pickup 1 window 2552. Also, a selectable switch 2554 may be utilitized to turn the pickup 1 on or off. Further, the angle of pickup 1 may be changed and the position of pickup 1 in window 2558 relative to the neck may also be changed. Also, by button 2560 the original configuration of the pickups may be reset. Further, the level of pickup 1 via slider 2662 may also be altered.

A phase selection switch 2564 is also selectable to put the pickups 2534 and 2532 either in or out of phase. Similarly, a serial/parallel switch 2566 is also selectable to put the pickup 2534 and 2532 either in series or parallel. A second set of selectable features for the second pickup 2 via switches, selectable windows, and sliders as those previously-described for the first pickup 1 may also be present. The description thereof is similar and will not be repeated for brevity's sake. Additionally, a master volume slider 2570 may also be utilized by user to control the overall master volume.

It should also be appreciated that as indicated by the arrows 2571 and 2572 on the emulated guitar body itself in window 2530 that the pickup bridge and individual pickups of 2532 may also be selectable and moved by a user (such changes being reflected in pickup window 2540) to move both the position and angles of pickups 2532 relatively to the neck, bridge, body, and in terms of both position and angle. Pickups 2534 and bridge 2536 are also selectable and moveable.

Additionally, a selectable body type tab 2542 may be selected which includes selectable features via a user control graphical interface related to the features of the type of body associated with the electric or acoustic guitar or other stringed instrument. Selectable type of features with respect to the body type, as previously discussed, include the body-shape, body-size, type of wood, timbre, density, whether the body is hollow or solid, etc. Also, it should be appreciated that different types of bodies associated with different types of stringed instruments such as banjoes, sitars, mandolins, etc., may be selectable.

It should be appreciated that the emulated sound for the different types of bodies and pickup configurations that are alterable by a user, for a selected type of electric or acoustic guitar or other stringed instrument, via the graphical interface 2500, may be implemented by the audio DSP software modules 810 and, in particular, the electric guitar modeling and acoustic guitar modeling DSP software modules 812 and 814.

Controls tab 2546 of the control panel graphical interface 2500 may also be selected by a user to control the overall sound associated with the selected type of stringed instrument that has been emulated. A wide variety of software implemented controlled graphical interfaces for a multitude of different instruments are known.

One particular type of control panel graphical interface for a guitar that may be utilized for controls feature tab 2546 is the control graphical interface from U.S. Pat. No. 7,030,311. The contents of U.S. Pat. No. 7,030,311 are hereby incorporated by reference. This type of graphical user interface providing control features may be selected by control tab 2546 and, in conjunction with the audio DSP software modules 810, allows the user to change control settings such that the audio DSP software module 810 processes the digitized serially formatted audio signal from the guitar to match the desired settings selected by the user. Example settings of such a control panel graphical interface that may be utilized via the selection of control tab 2546 are analogous to those disclosed in U.S. Pat. No. 7,030,311, as will now be particularly described. Particularly, these setting include amplifier and cabinet modeling, as well as various other controls and effects.

For example, this type of control graphical interface may include standard control knobs for most guitar amplifiers including: a drive control knob, a bass control knob, a middle control knob, a treble control knob, a presence control knob and a master volume control knob. Further selectable features may include a boost switch to increase the level of the audio signal, a bypass button to turn off DSP processing such that the straight unprocessed audio signal from the guitar is used, as well as a mute guitar button which mutes the audio signal from the guitar.

Other types of controls include a master volume dial that controls both the volume of the audio signal guitar and the volume of other audio signals (e.g. from other audio files) currently being processed. A hum reducer button that allows the user to reduce the hum interaction between the guitar and the display device. A noise gate button that attenuates the input audio signal from the guitar if it is below a threshold level but does not attenuate the audio signal from the guitar if it is above a threshold level to get rid of such things a guitar handling noise. A guitar pan slider that may be used to pan the sound of the guitar between left and right speakers, etc.

Further, such a control panel may include well known selectable effects such as compression, delay, modulation (i.e. including chorus, flange, rotary, tremolo, reverb, etc.).

User graphical control interface 2500 may also include a window 2580 to provide selectable pitch transposition features. The pitch transposition features may utilize either presets by selection of preset button 2582 or pitch transposition may be enabled with the selection of enable button 2584.

Particularly, when enable is selected, movable fret 2586 allows a user to change the pitch of the stringed instrument to make the pitch of the strings either flatter or sharper.

Also, each string may be assigned a particular pitch by a user in column boxes 2588. Additionally, a mix box 2590 including a mixing dial may be utilized to allow the user to mix the original string tone of the string (e.g. original D) with a user assigned string tone (e.g. E) in order to create a desired string tone. Further, a detune box 2592 including a detune dial allows for the creation of string pitches that are not quite perfect octaves of one another. This effect is known in the art as "detuning" and permits the emulation of instruments, such 12-stringed guitars.

In this way, pitch-transposition can be accomplished utilizing the control graphical interface 2500 on a string-by-string basis. Further, after a user has already recorded a given session, which is stored digitally on the computer, after the fact during "post-editing," the user can then utilize these pitch transposition features along with different selectable body types, pickups, and other instruments, such that the guitar is effectively re-strung and a different musical instrument may be utilized to play the same session that was previously recorded by the user.

As above, personal computer 600 implements a user interface display software module 802 to provide a user control graphical interface 2500 to allow a user to take advantage of DSP-based stringed instrument modeling including: electric guitar modeling (via electric guitar modeling software module 812) to emulate electric guitars, acoustic guitar modeling (via acoustic guitar modeling software module 814) to emulate acoustic guitars, general stringed instrument modeling (via stringed instrument modeling software module 816) to emulate any stringed instrument, synthesized instrument modeling (via synthesized instrument modeling software module 818) to model a variety of synthesized instruments, amp/cabinet modeling (via amp/cabinet modeling software module 820) to emulate a variety of amplifier and cabinet configurations, audio effects modeling (via audio effects software module 825) to emulate various audio effects, pitch transposition modeling (via pitch transposition software module 830) to implement pitch transposition, and post-editing functionality (via post-editing software module 835) to implement post-editing features.

Thus, in one embodiment, personal computer 600 provides a dedicated computer application for audio modeling utilizing guitar 502 as the input. The application provides a control panel that provides for a high degree of user functionality. However, as previously discussed, the user interface is not limited to the computer application, because the guitar 502, as previously discussed, possesses a number of controls as well. The bidirectional communication protocol enables information to flow either direction so that guitar 502 can control personal computer 600 and vice versa.

In one particular embodiment, personal computer 600 includes an electric guitar DSP-based modeling software module 812 to process each received serially formatted digital string signal in order to emulate a corresponding string tone of one of a plurality of different electric guitars to create an emulated electric guitar signal string tone signal. After processing by personal computer 600, each emulated electrical guitar digital string tone signal is transmitted back over the serial link 530 to guitar 502 for playback.

In one embodiment, the emulation of the corresponding string tone of one of the plurality of different electric guitar includes implementing a finite impulse response (FIR) filter. Particular electric guitar modeling DSP techniques that may be implemented by electric guitar DSP-based modeling software module 812 will be discussed in great detail hereinafter.

Additionally, personal computer 600 may implement an acoustic guitar DSP-based modeling software module 814 to process each received serially formatted digital string signal in order to emulate a corresponding string tone of one of a plurality of different acoustic guitars to create an emulated acoustic guitar digital string tone signal. Each of the emulated acoustic guitar digital string tone signals may then be transmitted back over the serial link 530 to guitar 502 for playback. Particularly, as will be discussed hereinafter, the acoustic guitar DSP-based modeling software module 814 includes a variety of modeling techniques that will be hereinafter discussed to accurately emulate acoustic guitars.

Accordingly, personal computer 600 implements a user interface display software module 802 to provide a user interface as well as a variety of audio DSP software modules 810 including: an electric guitar modeling software module 812 to emulate electric guitars, an acoustic guitar modeling software module 814 to emulate acoustic guitars, a stringed instrument modeling software module 816 to emulate any stringed instrument, a synthesized instrument modeling software module 818 to model a variety of synthesized instruments, an amp/cabinet modeling software module 820 to emulate a variety of amplifier and cabinet configurations, an audio effects software module to emulate various effects, a pitch transposition software module 830 to implement pitch transposition, and a post-editing software module 835 to implement post-editing functionality. It should be appreciated that a wide variety of other software modules may also be utilized.

Further, in addition to the wide-ranging parametric control capabilities, previously discussed, personal computer 600 may also facilitate extensive automation capabilities and post-editing features. Parametric adjustments may be programmed to change as desired over time. Certain settings appropriate for one section of music can be automatically altered to suit specific artistic demands. In this environment any number of events, tonalities, effects, and specific model alterations can be easily programmed to occur with exact repeatability anywhere in the audio track. Functions and effects can also be combined to produce any super-set of models and/or sound effects desired. An example of this includes the ability to utilize pitch transposition through pitch transposition software module 830, on a string-by-string basis with specific models, any aspect of which can be changed during real-time playing or during post-editing. Each serially formatted digital string signal may be processed by the pitch-transposition software module 830 to alter the pitch of each received serially formatted digital string signal. For example, pitch transposition may be utilized to transpose string tones from an electric guitar to an acoustic guitar. Additionally, pitch transposition can used to effectuate various custom tunings and to facilitate particular musical effects. For example, pitch transposition can be utilized to produce custom de-tuning arrangements for strings and to mix particular string tones, on a string-by-string basis.

In one embodiment, the personal computer 600 allows for "post-editing" functionality. In particular, the personal computer 600 coupled by the serial link 530 to the digital connector 522 of the stringed instrument 502 receives each serially formatted digital string signal over the serial link. More particularly, personal computer 600 may store each serially formatted digital string signal and later in time, during post-editing processes, each serially formatted digital string signal may processed by the audio DSP software modules 810 in order to emulate a corresponding string tone of one of a plurality of stringed instruments to create an emulated digital string tone signal. In this way, after a user has recorded a particular session on his or personal computer, utilizing post-editing software module 835, the user can edit the sound to sound like any other stringed instrument, electric guitar, acoustic guitar, etc., utilizing the DSP software. In effect, a guitar can be re-strung to sound like any other guitar, stringed instrument, or any instrument.

These automation aspects allow for a complete and virtual "postediting" where the user can effectively "re-string" a given guitar to change one particular set of sonic characteristics to any other sonic characteristics as desired. In this case, the musician can virtually change instruments—hence the term "re-string" without the need to rerecord the track. For example, a beginning song may require a standard acoustic guitar sound but the musician/producer may want to change sounds throughout the track. Perhaps a banjo sound is desired for one verse while an electric twelve-string is desired for another verse. By means of post-editing software module 835, these types of changes can be implemented.

The various aspects of the previously described inventions can be implemented as one or more instructions (e.g. software modules, programs, code segments, etc.) to perform the previously described functions. The instructions which when read and executed by a processor, cause the processor to perform the operations necessary to implement and/or use embodiments of the invention. Generally, the instructions are tangibly embodied in and/or readable from a machine-readable medium, device, or carrier, such as memory, data storage devices, and/or remote devices. The instructions may be loaded from memory, data storage devices, and/or remote devices into memory for use during operations. The instructions can be used to cause a general purpose or special purpose processor, which is programmed with the instructions to perform the steps of the present invention. Alternatively, the features or steps of the present invention may be performed by specific hardware components that contain hard-wired logic for performing the steps, or by any combination of programmed computer components and custom hardware components.

After any of the previously-described modeling of string signals by the audio DSP software modules 810 occurs, a left and right stereo mix of emulated digital string tone signals may be sent back through digital serial I/O controller 622 in separate channels through serial I/O link 530 back to guitar 502 through the guitar's digital serial I/O controller 522 for playback. Particularly, the left and right stereo mix of emulated digital string tone signals received at the guitar 502 may be converted by the D/A converter of the guitar 502 into a left and right stereo mix of emulated analog string tone signals and outputted through an analog output of guitar 502 to one of headphones or an amplifier for playback. Alternatively, the emulated digital string tone signals may be played through the personal computer or through other devices attached to the personal computer.

Another embodiment of the invention relates to computer 600 processing digitized string vibration signals, whether received in real-time or from a pre-recorded file, in which a serial input/output link and/or a stringed instrument are not necessary.

Figure 8B:
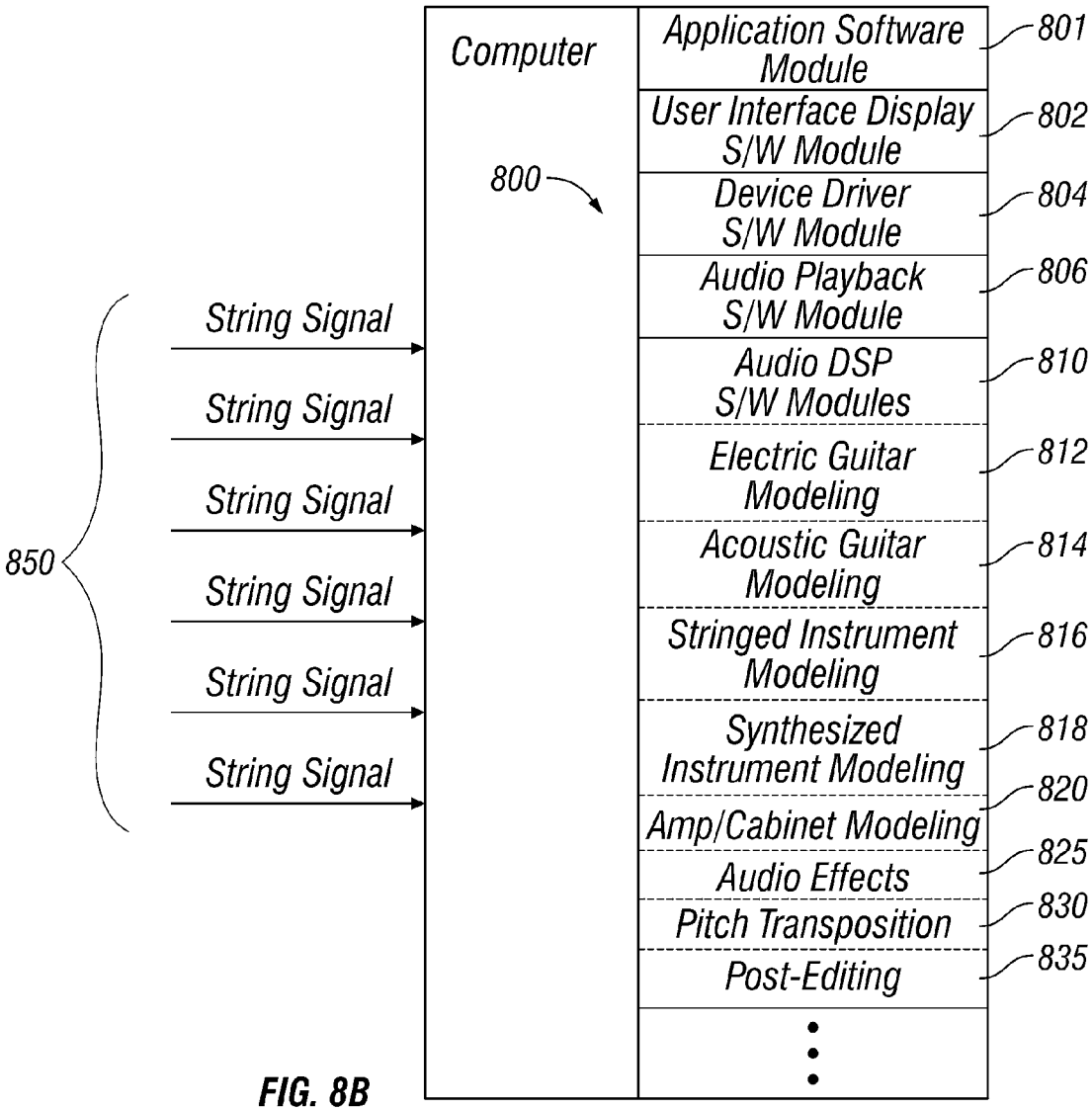
FIG. 8B is a diagram illustrating an example of software modules that may be implemented by a computer to process string signals, according to one embodiment of the present invention.

As can be seen in FIG. 8B, FIG. 8B is a block diagram illustrating computer 600 receiving a plurality of digitized string signals 850, according to one embodiment of the present invention. Computer 600 includes software modules 800, as previously discussed.

In one embodiment, computer 600 receives and processes each of the digitized string signals 850 in order to emulate a corresponding string tone of one of a plurality of stringed instruments in order to create an emulated digital string tone signal such that a complete stringed instrument is emulated. This can be accomplished utilizing the software modules 800 as previously discussed. It should be noted that this embodiment does not require a stringed instrument for input or a serial interface.

However, when a stringed instrument is used, the received digitized string signal may be transduced from a pickup of a stringed instrument such as guitar 100 or 101, previously discussed. In one embodiment, the received digitized string signals 850 may be received in real-time as the strings of the guitar are played and each digitized string signal is associated with the played strings and transduced as previously discussed.

In another embodiment, the digitized string signals 850 may be stored and transmitted from a pre-recorded file such that computer 600 may effectuate post-editing processing.

In the embodiment of FIG. 8B, computer 600 performs the previously-described types of processing without necessarily requiring a stringed instrument or any particular type of link, such as a serial link.

For example, in one embodiment, when computer 600 is emulating an electric guitar, electric guitar DSP-based modeling utilizing electric guitar modeling DSP software module 812 may be used to process each received digitized string signal 850 in order to emulate a corresponding string tone of one of a plurality of different electric guitars to create an emulated electric guitar, as previously described.

In another embodiment, computer 600 may perform acoustic guitar DSP-based modeling utilizing acoustic guitar modeling DSP software module 814 to process each received digitized string signal 850 in order to emulate a corresponding string tone of one of a plurality of different acoustic guitars to create an emulated acoustic guitar as previously described.

These processed digitized string signals may undergo further processing to emulate one of a plurality of amplifiers and/or cabinet setups to re-create an authentic electric or acoustic guitar sound, as previously described.

Further, computer 600 may further perform pitch transposition to process each digitized string signal 850 in order to alter the pitch of each received digitized string signal utilizing pitch transposition software module 830, as previously discussed. Pitch transposition typically involves extracting signal information, such as the pitch and volume of each digitized string signal, in order to perform pitch transposition. Additionally, this extracted signal information may also be useful in the use of a sound generator such as a synthesizer engine or a wave table playback engine.

In another embodiment, computer 600 may implement a synthesizer engine to create synthesized sounds utilizing synthesized instrument modeling software 818. Particularly, based upon extracted signal information, such as pitch and volume, associated synthesized sounds may be triggered and rendered for playback. Similarly, a wavetable playback engine may also be implemented to create a variety of sounds. This may be accomplished utilizing audio effects software module 825 or other software modules. In this embodiment, based on the extracted signal information, such as pitch and volume, associated pre-recorded sounds in an audio file format, such as a wave file format, may be triggered and rendered for playback.

Figure 8C:
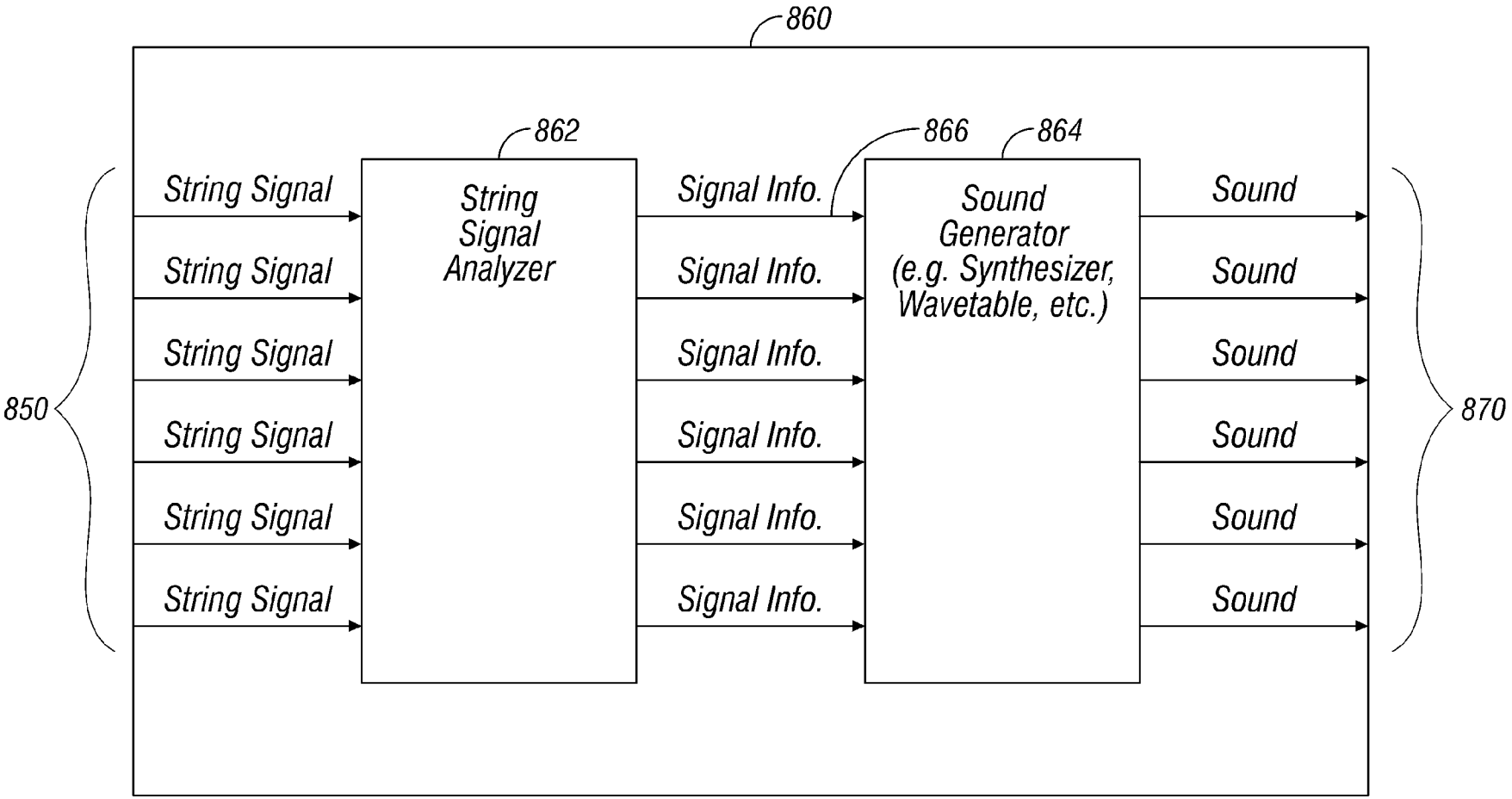
FIG. 8C is a diagram illustrating an example of a sound generator implemented by a computer, according to one embodiment of the present invention.

Turning now to FIG. 8C, FIG. 8C is a block diagram illustrating an example of the use of a sound generator such as a synthesizer engine or a wavetable playback engine implemented by computer 600, according to one embodiment of the present invention.

In this embodiment, computer 600 receives a plurality of digitized string vibration signals 850. Computer 600 extracts signal information from each of the digitized string vibration signals and implements a sound generator to create a plurality of different sounds, wherein based upon the extracted signal information, associated sounds are triggered and rendered for playback.

As can be seen in FIG. 8C, a plurality of digitized string signals 850 are received by string signal analyzer 862. String signal analyzer 862 extracts signal information 866 from each of the digitized string signals 850.

Extracted string signal information may include pitch, volume, velocity, attack time, as well as other attributes. In particular, string signal analyzer 862 may extract signal information that is in accordance with a variety of well known musical interface standards such as the MIDI protocol. The musical instrument digital interface (MIDI) standard, as well as other standards, may be utilized with embodiments of the present invention. Utilizing the extracted string signal information 866, computer 600 may implement a sound generator to trigger and render sounds based upon the extracted string signal information.

In one embodiment, sound generator 864 implemented by computer 600 may include a synthesizer engine to create synthesized sounds or it may implement a wavetable playback engine to create sounds. It should be appreciated that the sound generator 864 and the string signal analyzer 862 implemented in computer 600 may be implemented utilizing synthesized instrument modeling software module 818, audio effects software module 825, and pitch transposition software module 830, and/or combinations thereof.

For example, sound generator 864 may include a synthesizer engine to create synthesized sounds 870 in which, based upon the extracted signal information 866, associated synthesized sounds are triggered and rendered for playback. These sounds and their association characteristics may be pre-defined or user-defined. A variety of standard synthesizer engines are well known. Based upon the extracted string signal information 866, the synthesizer engine can trigger and render a wide variety of synthesized sounds such as those found on common musical keyboard synthesizers.

In another embodiment, sound generator 864 may implement a wavetable playback engine to create sounds. As is known, wavetables typically have a wide variety of looped pre-recorded sounds in audio or wave file formats that can be rendered. In this embodiment, based upon the extracted signal information 866, sound generator 864 implementing a wavetable may associate pre-recorded sounds in an audio format or wave file format that are triggered (based on certain attributes of the extracted signal information) and that are rendered for playback. These sounds and their association characteristics may be pre-defined or user-defined. Examples of these sounds may include horns, drums, orchestras, animal sounds, etc.

In one embodiment, the digitized string signals may be transduced from a pickup of a guitar in real time as the plurality of strings of the guitar are played wherein the digitized string signals are associated with the played strings. Alternatively, the digitized string signals 850 may be transmitted from a pre-recorded file and later used for post-editing processing.

In any event, by computer 600 implementing sound generation features such as a synthesizer engine and/or a wavetable playback engine, a wide variety of non-guitar and non-stringed instrument sounds may be utilized in addition to or in lieu of the previously-described electric and acoustic guitar modeling. Thus, computer 600 utilizing the various features of the invention provides a complete solution to render a variety of modeled stringed instruments, electric guitar, acoustic guitars, non-guitar sounds via a synthesizer engine and/or a wavetable playback engine, along with audio effects including a variety of amplifier and cabinet models to provide a very versatile music modeling system. Further, as previously described, all of this can be accomplished in either real-time or during post-editing.

Another embodiment of the invention relates to an interface device that includes many of the electronic features of the previously-described guitar 502. The interface device may be connected between a typical guitar and computer 600 such that almost any guitar (or other types of stringed instrument) can be connected to computer 600 via the interface device in order to take advantage of all the modeling features provide by computer 600, as previously described.

Figure 8D:
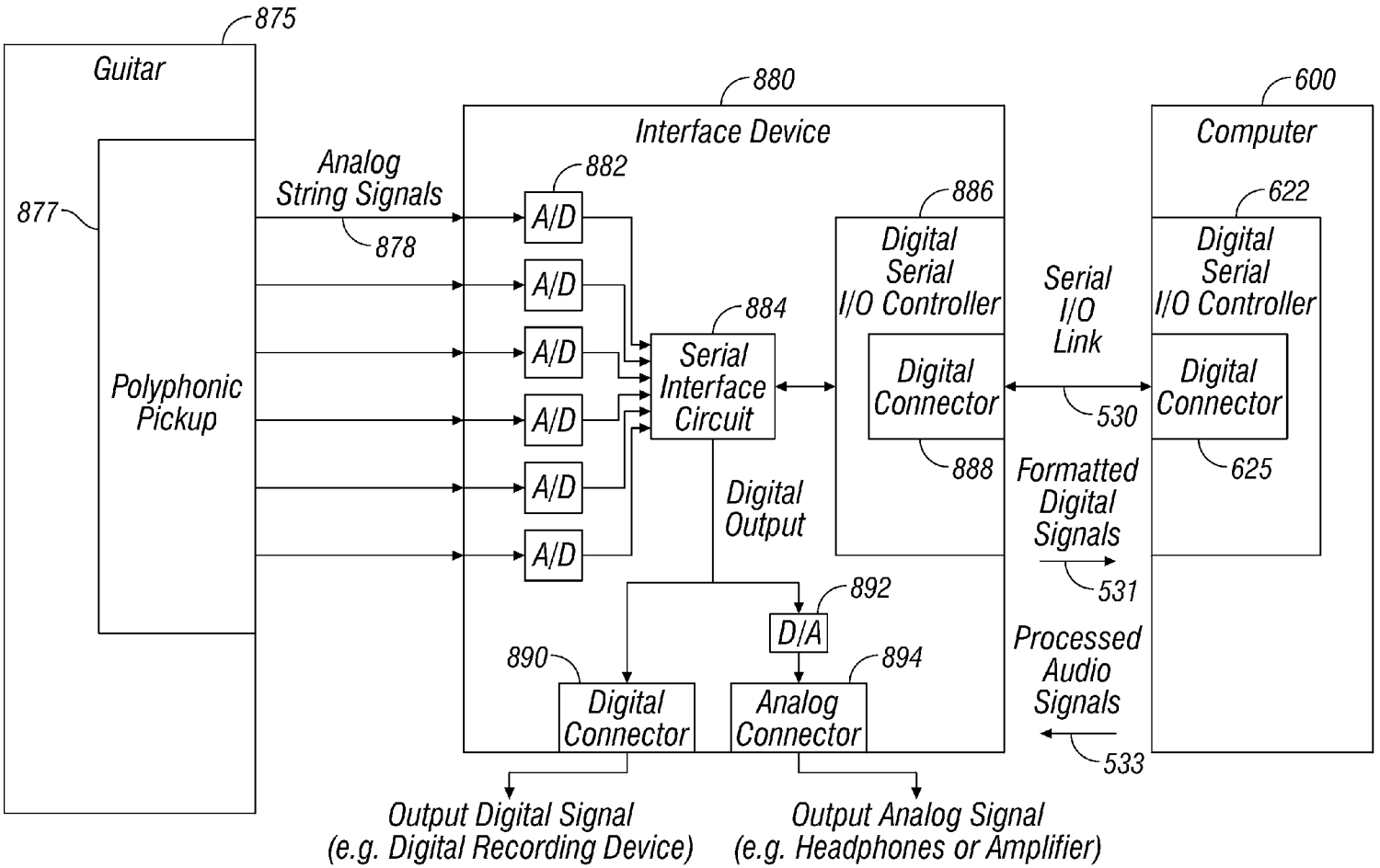
FIG. 8D is a diagram illustrating an example of an interface device coupled between a guitar and computer, according to one embodiment of the present invention.

Turning now FIG. 8D, FIG. 8D is a diagram illustrating an example of an interface device 880 coupled between a guitar 875 having a polyphonic pickup 877 and computer 600, according to one embodiment of the present invention.

It should be appreciated that guitar 875 may be a typical guitar, or any other sort of stringed instrument, having a polyphonic pickup 877. For example, guitar 875 may include a plurality of strings and a polyphonic pickup 877 to which each of the plurality of strings is respectively coupled. In this example, the pickup may be a polyphonic pickup 877 located at the bridge or at other locations. The polyphonic pickup 877 may be a piezoelectric type of pickup to detect the vibration signal for each string.

Alternatively, any other type of suitable sensor to detect the vibration signals for each string may be utilized, such as magnetic or optical pick-ups. The sensors likewise need not be integrated into the bridge assembly. Moreover, in other embodiments, the polyphonic pickup 877 may be of any suitable size to accommodate any number of strings for the desired stringed instrument to be emulated.

Thus, in one embodiment, a typical guitar 875, either already having a polyphonic pickup 877 or that is retrofitted with a polyphonic pickup may be utilized. The polyphonic pickup 877 may be utilized to detect a string vibration signal associated with each string as the string is played. As each string is played, an associated analog string signal 878 is generated and is transmitted to the interface device 880.

It should be appreciated that polyphonic pickup 877 of guitar 875 may be connected to interface device 880 by a cable that is suitable for transmitting analog string signals 878 to interface device 880. Polyphonic pickups 877 and associated cables to transmit the analog string signals are well known. For example, ROLAND produces a GK-3 polyphonic pickup (e.g. often referred to as a Divided Pickup) and a GKC 13-pin cable that may be utilized to provide a typical guitar 875 with a polyphonic pickup and a connection cable to another device, such as interface device 880.

Interface device 880 includes a converter circuit that includes a plurality of analog to digital (A/D) converters 882 coupled to a serial interface circuit 884. The analog string vibration signals detected by polyphonic pickup 877 of guitar 875 are transmitted to the A/D converters 882 of interface device 880 over a suitable cable 878 such that each detected analog string vibration signal is converted into a corresponding digital string vibration signal.

As shown in FIG. 8D, each A/D converter 882 is connected to serial interface circuit 884. By utilizing a polyphonic pickup 877 and A/D converters 882, each of the detected string vibration signals from the guitar 875 is converted into a digital string vibration signal and is passed on to the serial interface circuit 884. Also, additional analog signals from magnetic pickups (not shown) of guitar 875 may either be digitized or sent in straight analog form from interface device 880 to computer 600 for processing in addition to, or in lieu of, the digitized string vibration signals from the polyphonic pickup.

In this example, there are six A/D converters 882 in the interface device 880, one for each string of the guitar 875. Thus, polyphonic pickup 877 is used to detect a vibration signal for each of the six strings (e.g. when a string is played by a musician) and the detected vibration signal is coupled to a respective A/D converter 882, via a suitable cable, where it is converted into a digital string vibration signal, which is then passed on to serial interface circuit 884.

It should be noted that the interface device embodiment 880 disclosed in FIG. 8D is similar to the guitar embodiment 502 described in FIGS. 5 and 8A, in that the specialized electronics of the guitar embodiment 502, including the A/D converters, serial interface circuit, digital and analog output connectors and the digital serial I/O controller are included in the interface device 880—instead of the guitar itself. Therefore, much of the description as to these components remains the same, and will not be repeated for brevity's sake. In this embodiment, a typical guitar 875 that either includes or has been retrofitted with a polyphonic pickup 877 may be interfaced with computer 600 via interface device 880 to take advantage of all the modeling features provide by computer 600, as previously described. The electronics of the interface device 880 may be mounted and interconnected in a circuit board and the interface device 880 may include a suitable housing to house these components.

Similar to the guitar embodiment of FIGS. 5 and 8A, a serial interface circuit 884 is utilized in the interface device 880. Serial interface circuit 884 is coupled between the A/D converters 882 and digital serial I/O controller 886. Serial interface circuit 884 is utilized to format each digital string vibration signal into a digital serial protocol and to transmit each serial formatted digital string signal to digital serial I/O controller 886.

Computer 600 is coupled by serial input/output (I/O) link 530 to a digital connector 888 of digital serial I/O controller 886 of interface device 880 such that computer 600 receives each serial formatted digital string signal over serial link 530 at a corresponding digital connector 625 of a digital serial I/O controller 622 of computer 600, as previously described in detail.

Further, as previously described, computer 600 operates at least one audio DSP-based software module to process each received serially formatted digital string signal. Each serially formatted digital string signal is processed by computer 600, utilizing one or more of audio DSP-based software modules, in order to emulate a corresponding string tone of one of a plurality of selectable stringed instruments to create an emulated digital string tone signal. These emulated digital string tone signals are then transmitted back over the serial link 530 to the interface device 880 for playback.

Particularly, these emulated digital tone signals may be coupled back through digital connector 888, serial interface circuit 884, and through a digital-to-analog (D/A) converter circuit 892, which converts the emulated digital string tone signals into analog form, and through an analog connector output 894 of interface device 880 to headphones or an amplifier such that a musician can hear the outputted analog signal. It should be appreciated that headphones via a suitable cable or an amplifier via a suitable cable may be plugged into analog output connector 894 of the interface device 880 so that a musician can hear the outputted analog signal that has been processed by computer 600 to emulate a desired instrument selected by the user, such as a selected electric guitar, acoustic guitar, or other instrument.

In another embodiment, the emulated digital string tone signals may be directly coupled through a digital output connector 890 such that the digital signals from computer 600 may be utilized by a digital recording device or a digital amplifier, for example. As one example, a S/PDIF (Sony/Phillips Digital Interface Format) digital connector may be utilized. However, it should be appreciated that other types of digital connectors may also be used. As is known, the S/PDIF format provides a collection of hardware and low-level protocol specifications for carrying digital audio signals between devices and stereo components.

In this embodiment, the processed digital signals transmitted back from computer 600 to interface device 880 may be outputted through the S/PDIF digital connector. The processed digital signals may be outputted through the S/PDIF digital connector through a suitable cable to digital devices, such as digital recording devices, other computers, etc., to further process, record and/or playback the processed digital signals, and/or to other digital amplifier devices for playback.

As has been previously discussed, digital serial I/O controller 886 with digital connector 888 and computer 600 having a digital serial I/O controller 622 and a digital connector 625 and the serial I/O link 530 therebetween, may be of a suitable serial protocol such as USB, USB-2, etc. Although embodiments of the invention are described in which the digital serial 110 protocol is a USB-2 protocol, it should be appreciated that any high-speed serial protocol may be utilized.

Further, the particular details of the serial I/O link 530 have been previously described and will not be repeated for brevity's sake. In particular, formatted digital signals 531 outputted from the interface device 880 to computer 600 and processed audio signals 533 returning from computer 600 back to the interface device 880 have been previously described in detail with reference to FIG. 6.

As previously discussed, a separate channel for each serially formatted digital string signal is utilized in the transmission from interface device 880 over serial link 530 to computer 600 for processing. Each serially formatted string signal (e.g., string 1, string 2, string 3, string 4, string 5, and string 6)

may be individually transmitted over the serial link in its own channel in a high-speed serial protocol (e.g. USB-2) to computer 600. Further, a separate channel for user control information may also be transmitted to the computer.

Additionally, a channel may be utilized for sending digitized mono signals from additional electromagnetic pickups or straight analog signals from guitar 875 to computer 600. These signals may be passed through interface device 880 to serial I/O link 530. These additional signals may be mixed with the otherwise processed signals.

Furthermore, as previously described in detail, computer 600 may include a plurality of different software modules 800 to implement various functionality for a user of computer 600 in conjunction with guitar 875 and interface box 880, such as: application software module 801, a user interface display software module 802, a device driver software module 804, an audio playback software module 806, and a plurality of different types of audio DSP software modules 810. These audio DSP software modules include software modules related to: electric guitar modeling 812, acoustic guitar modeling 814, general stringed instrument modeling 816, synthesized instrument modeling 818, amplifier/cabinet modeling 820, audio effects 825, pitch transposition 830, and post-editing 835 (see FIG. 8A). The functionality of these software modules as implemented by computer 600, and in particular the DSP-based modeling capabilities provided by these software modules, has been previously discussed in detail, and will not be repeated for brevity's sake.

Continuing with the interface device embodiment 880, after the string signals have been processed by one or more of the various software modules of computer 600, as has been previously described, a left stereo mix of emulated digital tone signals in a first channel and a right stereo mix of emulated digital string tone signals in a second channel may be transmitted back over the serial link 530 (as processed audio signals 533) to interface device 880 for playback. The left and right stereo mix of emulated digital string tone signals received by interface device 880 may be converted by the D/A converter 892 into a left and right stereo mix of emulated analog string tone signals which are outputted through analog output connector 894 of the interface device 880 to one of headphones or an amplifier for playback. Moreover, as previously described, this left and right stereo mix of emulated digital string tone signals may be received at the interface device 880 and may be directly outputted from the interface device through digital output connector 890. It should be appreciated that the processed audio signals 533 could be one or more channels, providing, for example, a monophonic mix or a multi-channel surround sound mix.

It should be appreciated that the processed audio signals 533 could alternatively or additionally be routed out of any analog or digital output available on the personal computer 600 or any other connected audio interface for processing. Further, processed audio signals 533 could also remain within personal computer 600 for storage or processing by suitable software applications.

Accordingly, interface device 880 performs much of the same functionality as previously described with respect to the specialized guitar 502, except that this functionality is implemented with electronics contained in the stand alone interface device 880, instead of the guitar. This allows interface device 880 to be utilized with a typical guitar 875 having a polyphonic pickup 877. It should be appreciated that in most all other respects, computer 600 performs the same sorts of functionality and audio DSP-based modeling including electric guitar modeling and acoustic guitar modeling, as well as other types of modeling, and that interface device 880 simply provides an alternative embodiment for implementing aspects of the invention.

Thus, a computer-enabled guitar has been described which accurately simulates the sounds of electric and acoustic guitars, as well as other stringed and/or synthesized instruments, along with a wide range of amp and cabinet sounds and selectable audio effects. The data acquisition, formatting, and data-transfer electronics are integrated into the instrument, while a personal computer 600 performs and/or enables modeling, audio effects, transposing, and automation. Particularly, aspects of the previously-described invention utilize a personal computer's vast computational resources to support a broad range of guitar, stringed instrument, and synthesized instrument modeling, as well as amplifier and audio effects modeling.

Thus, the previously-described guitar 502 connected to computer 600, or a standard guitar 875 connected via interface device 880 to computer 600, allows computer 600 to provide enormous processing power to effectuate a broad range of digital signal processing to a guitarist who plugs in a guitar via a high-speed serial link 530 (e.g. USB-2) who may then obtain the full benefit of authentic stringed instrument modeling, guitar modeling, synthesized instrument modeling, amplifier modeling, and sound effects. In addition, the personal computer may be utilized to provide powerful musical production capabilities, automated parameter changes, pitch transposition, re-stringing, and unlimited post recording editing.

In particular, audio DSP software modules 810 include a electric guitar modeling software module 812 and an acoustic guitar modeling software module 814 that implements very particular and accurate modeling techniques that will be hereinafter described. Thus, a guitarist can utilize his or her personal computer to obtain very accurate electric and acoustic guitar modeling via these techniques as will be hereinafter described.

Details of some of the DSP algorithms associated with electric guitar modeling will now be discussed. Particularly, finite impulse response (FIR) filters, system block diagrams, and other charts will be discussed to show how some aspects of the string tone of an electric guitar is properly modeled in order to provide a stringed instrument that can properly emulate a plurality of different types of electric guitars.

The following discussion will refer to a guitar string for guitar, however, as previously discussed the DSP modeling can apply to any string of any stringed instrument. In one embodiment of the invention, the emulation of one aspect of the corresponding string tone of the selected guitar is achieved utilizing a finite impulse response (FIR) filter, as will be discussed.

Moreover, embodiments of the invention further provide for emulating the pickup height of an electromagnetic pickup (e.g. along the vertical or 'y' axis) for the corresponding string of the emulated guitar, as well as emulating the guitar string's response along the x-axis. In this way, the overall tone of the guitar in response to a string vibration signal detected by an electromagnetic pickup at a particular location relative to the string is emulated along both the 'x' and 'y' axis, and thus the sound of a desired guitar can be truly emulated. However, it should be appreciated that the 'x' and 'y' axis calculations can be determined for any type of electrified string instrument in order to more accurately emulate the stringed instrument.

But first, a discussion will be provided to discuss how the pickup height of an electromagnetic pickup of an electric guitar affects the shape of the magnetic aperture of the string, which directly affects the tone of the string of the guitar.

Figure 9A:
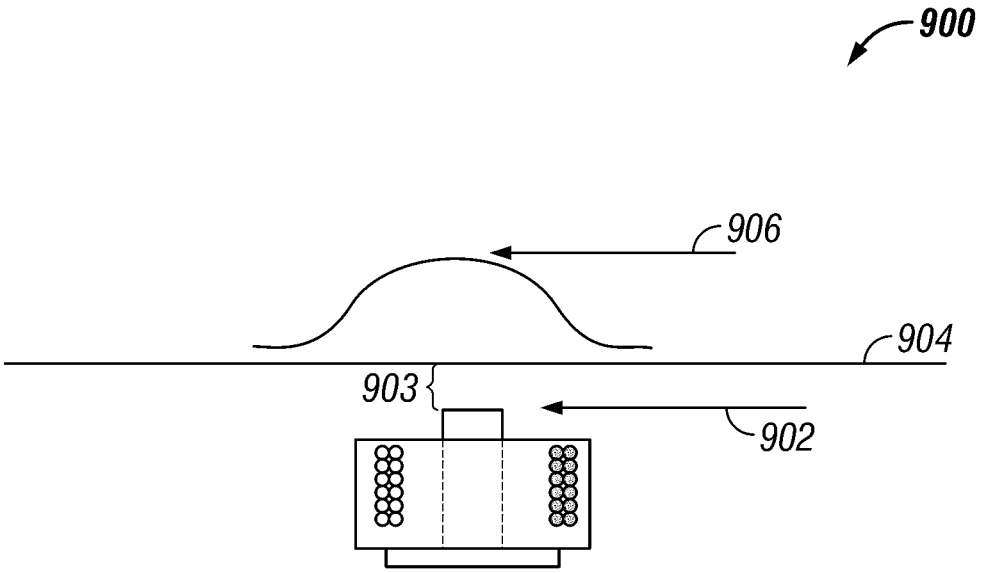
FIG. 9A shows an electromagnetic pickup located relatively distant (i.e. having a relatively large pickup height) from a guitar string and the resulting magnetic aperture.

Turning now to FIG. 9A, FIG. 9A shows an electromagnetic pickup 902 (e.g. located in the body or neck of a guitar) located relatively distant (i.e. having a relatively large pickup height 903) from a guitar string 904 and the resulting magnetic aperture 906. The strength of the magnetic field along the length of the string, is known as the "magnetic aperture" or "sensing window" of the electromagnetic pickup. The magnetic aperture is directly dependent on the pickup height 903. As depicted in FIG. 9A, when the electromagnetic pickup 902 is relatively distant from the guitar string the shape of the magnetic aperture 906 is broad with a lower amplitude.

Figure 9B:
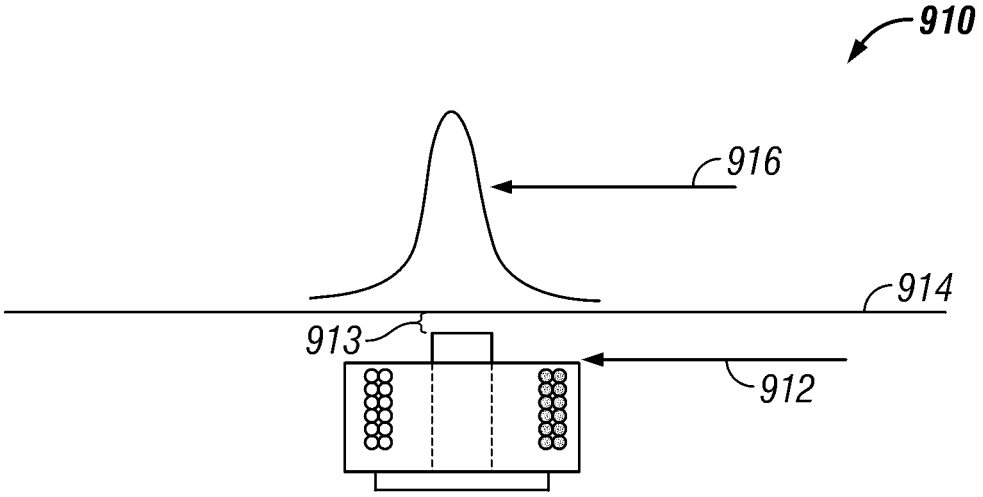
FIG. 9B shows an electromagnetic pickup located relatively close (i.e. having a relatively small pickup height) from a guitar string and the resulting magnetic aperture.

On the other hand, looking to FIG. 9B, FIG. 9B shows an electromagnetic pickup 912 located relatively close (i.e. having a relatively small pickup height 913) from a guitar string 914 and the resulting magnetic aperture 916. As shown in FIG. 9B, a relatively small pickup height 913 results in a magnetic aperture 916 that is narrower with a higher amplitude. Also, depending on the pickup configuration, the magnetic aperture need not be symmetrical.

The second way that the pickup height affects the tone of a guitar string of a guitar is in the degree of non-linearity of the output signal in response to a string vibration signal. The magnetic field strength in the vertical axis or 'y' axis is strongest right above the electromagnetic pickup, and it is weaker as the vertical distance increases. Therefore, when a string is played, the string's oscillation brings the string closer to and farther from the electromagnetic pickup such that a nonlinear gain needs to be applied to model the non-linear distortion associated with the pickup height of the electromagnetic pickup and to therefore properly model or emulate the true sound of the guitar string. Of course, depending on the pickup height, the amount of non-linearity will vary. This will be discussed in more detail later.

Discussion will now proceed as to how a guitar string of a particular guitar with a certain configuration of electromagnetic pickups is modeled to generate an appropriate digital system characterization for implementation by digital signal processing (DSP), and particularly by audio DSP-based software modeling implemented on a personal computer, according to embodiments of the present invention. Particularly, modeling coefficients for finite impulse response (FIR) filters can be determined by the process to be described hereinafter for a plurality of different guitars and other stringed instruments such that plurality of different guitars and other stringed instruments can be digitally emulated and offered as choices to a user.

Figure 9C:
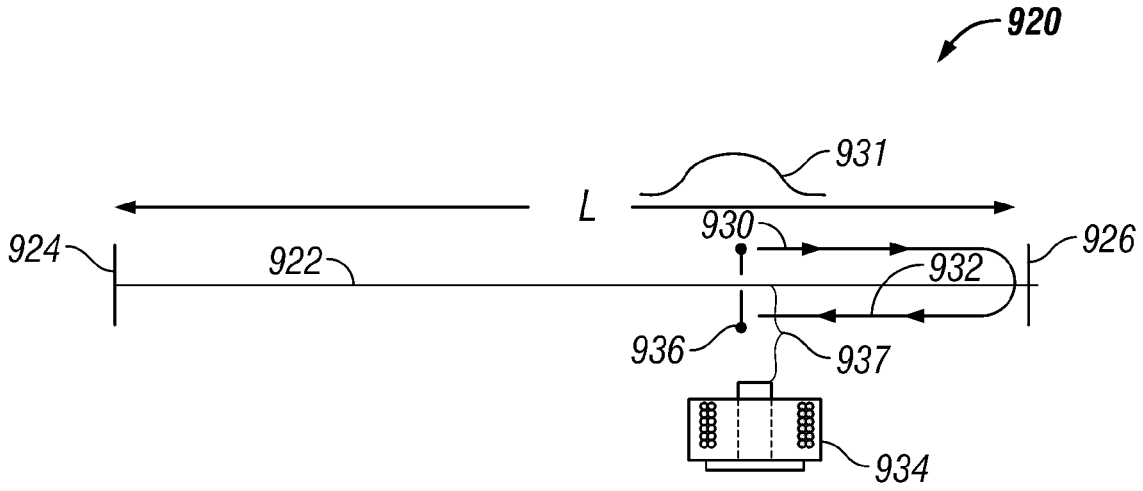
FIG. 9C shows a diagram illustrating a process for digitally modeling a magnetic aperture of a guitar string of a particular guitar having an electromagnetic pickup at a particular location, according to one embodiment of the present invention.

Turning now to FIG. 9C, FIG. 9C shows a diagram illustrating a process 920 for digitally modeling a magnetic aperture of a guitar string of a particular guitar with an electromagnetic pickup at a particular location. As shown in FIG. 9C, a guitar string 922 is coupled between a tuning nut 924 and a bridge 926 and has a length L. An initial impulse wave 930 travels along the guitar string 922 with an electromagnetic pickup 934 underneath the string at a distance x 936 from the bridge 924. Further, the electromagnetic pickup 934 has a corresponding pickup height y 937. The shape of the magnetic aperture 931 becomes the shape of the electromagnetic pickup output in response to the initial impulse wave 930. When the initial impulse wave 930 reaches the bridge 926, the impulse wave is inverted becoming the reflected impulse wave 939 and travels back along the guitar string 922 in the opposite direction, with a corresponding response that is inverted and mirrored from the response in the forward direction. Thus, a total impulse response can be calculated to be a summation of the initial impulse wave 930 and the reflected impulse wave 939 responses.

The time delay between these two responses is the time it takes the initial impulse wave 930 to travel a distance of 2*x. This can be calculated as:

$$\tau = \frac{x}{L \cdot f_0}$$

where $f_0$ is the guitar string's open frequency.

In a sampled or digital system, this time delay is achieved by a delay of N samples such that:

$$N = \frac{x \cdot f_s}{L \cdot f_0}$$

where fs is the time sampling frequency of the system.

Figure 9D:
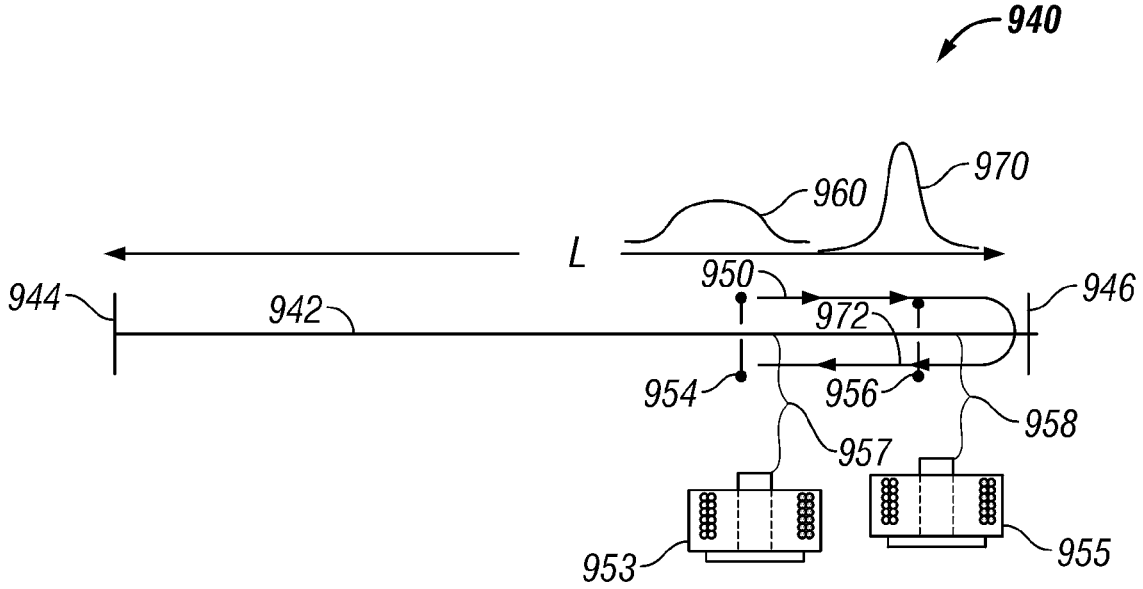
FIG. 9D shows a diagram illustrating process for the digitally modeling magnetic apertures for a guitar string of a particular guitar with a first electromagnetic pickup at a first location and a second electromagnetic pickup at a second location, according to one embodiment of the present invention.

Turning now to FIG. 9D, FIG. 9D shows a diagram illustrating a process 940 for digitally modeling magnetic apertures for a guitar string of a particular guitar with a first electromagnetic pickup at a first location and a second electromagnetic pickup at a second location. As shown in FIG. 9D, a guitar string 942 is coupled between a tuning nut 944 and a bridge 946 and has a length L. An initial impulse wave 950 travels along the guitar string 943 with a first electromagnetic pickup 953 underneath the string at a distance x1 954 from the bridge 946 and a second electromagnetic pickup 955 underneath the string at a distance x2 954 from the bridge 946. Further, the first electromagnetic pickup 953 has a corresponding pickup height y1 957 and the second electromagnetic pickup 955 has a corresponding pickup height y2 958.

The shape of the first magnetic aperture 960 becomes the shape of the output of the first electromagnetic pickup 953 in response to the initial impulse wave 950. Again, when the initial impulse wave 950 reaches the bridge 946, the impulse wave is inverted becoming the reflected impulse wave 972 and travels back along the guitar string 942 in the opposite direction, with a corresponding response that is inverted and mirrored from the response in the forward direction. Thus, a total impulse response for the first magnetic aperture 960 for the first electromagnetic pickup 953 can be calculated to be a summation of the initial impulse wave 950 and the reflected impulse wave 972 responses for the first electromagnetic pickup 953.

Similarly, the shape of the second magnetic aperture 970 becomes the shape of the output of the second electromagnetic pickup 955 in response to the initial impulse wave 950. Again, when the initial impulse wave 950 reaches the bridge 946, the impulse wave is inverted becoming the reflected impulse wave 972 and travels back along the guitar string 942 in the opposite direction, with a corresponding response that is inverted and mirrored from the response in the forward direction. Thus, a total impulse response for the second magnetic aperture 970 for the second electromagnetic pickup 955 can be calculated to be a summation of the initial impulse wave 950 and the reflected impulse wave 972 responses for the second electromagnetic pickup 955.

Further, in the case of multiple electromagnetic pickups 953 and 955 sensing the string vibration signal, N (the delay) is computed in the same way for each electromagnetic pickup. Also, it should be noted that the response of the second electromagnetic pickup 955 is closer to the bridge and is therefore delayed relative to response of the first electromagnetic pickup 953 farthest from the bridge. The delay D between the responses is calculated based on the same principles of wave velocity and distance and leads to the general solution for n electromagnetic pickups:

$$N_n = \frac{X_n \cdot f_s}{L \cdot f_0};\ D_n = \frac{(N_1 - N_n)}{2};\ n = 1, 2, 3\ldots$$

The magnetic apertures 960 and 970 can be represented as finite impulse response (FIR) filters, respectively, whose coefficients are the measured field strength along the string, sampled at a distance interval, d, determined by the wave velocity $f_0$, the time-sampling frequency $f_s$, and the length of the string, L.

$$d=2 \cdot f_0/f_s$$

As is known in the art, FIR filters have the mathematical form $y_n=h_0x_0+h_1x_1+h_2x_2+\ldots h_Nx_N$; where $h_n$ are fixed filter coefficients from 0 to N, and $x_0$ to $x_N$ are the data samples (in this case the sampled digital string vibration signals from the polyphonic pickup). By performing the above process 940 to calculate the impulse responses for the electromagnetic pickups 953 and 955 all of the fixed $h_n$ modeling coefficients can be calculated and a digital transfer function can be calculated for the guitar string of the desired guitar to be emulated. The coefficients for each string of each selectable guitar or other stringed instrument can be stored in memory of the personal computer. Also, it should be appreciated that when the inverted impulse travels back along the string, the modeling coefficients are mirrored about the center. Thus, the same coefficients can be read in reverse order, eliminating the need for extra storage space for the inverted impulse filter. Accordingly, tables of modeling coefficients that represent the magnetic aperture for various configurations of electromagnetic pickups having various pickup heights (y-axis) can be stored in the memory of the personal computer to effectively emulate each string of a multitude of different types of guitars (e.g. electric, acoustic, etc.), as well as other stringed instruments for selection by a user.

Figure 10:
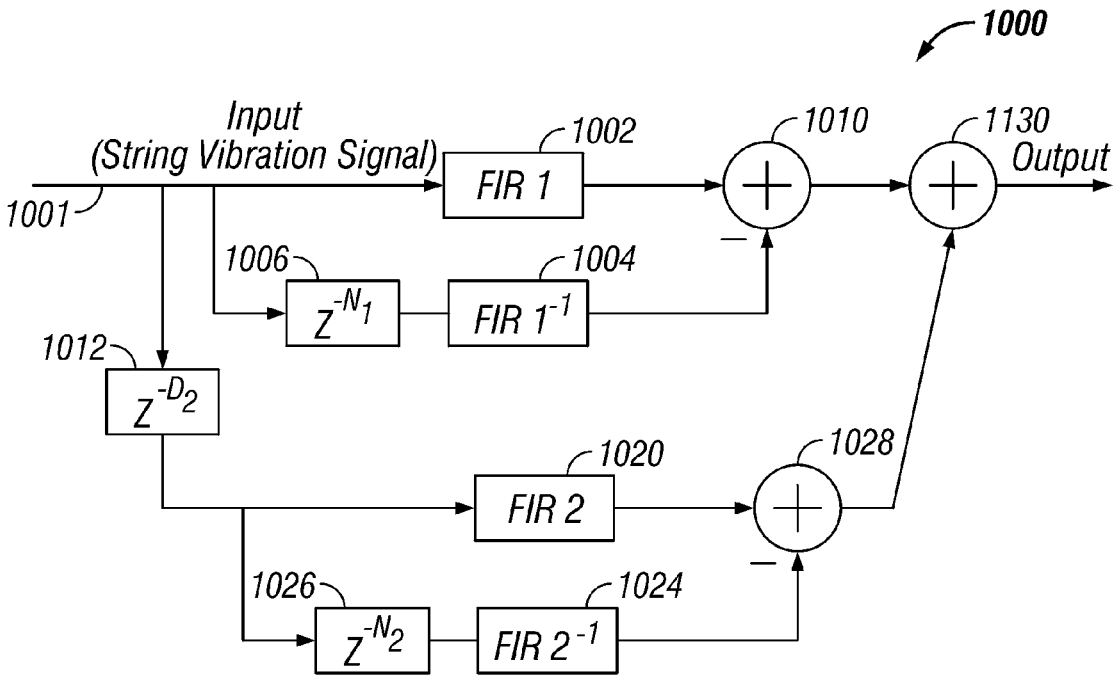
FIG. 10 shows an example of a block diagram of a generalized DSP algorithm for emulating the guitar that was previously modeled having two electromagnetic pickups located at particular x (horizontal) locations and at particular y (pickup height) displacements along the string of the guitar, wherein the resulting magnetic apertures are emulated with FIR filters, according to one embodiment of the present invention.

With reference now to FIG. 10, FIG. 10 shows an example of a block diagram of a generalized DSP algorithm 1000 for emulating the guitar that was previously modeled having two electromagnetic pickups 953 and 955 located at particular x (horizontal) locations and at particular y (pickup height) displacements along the string 942 of the guitar (FIG. 7), wherein the resulting magnetic apertures 960 and 970 are emulated with FIR filters. As shown in FIG. 10, an input digital string vibration signal 1001 for the string enters the DSP block diagram 1000. It should be appreciated that the generalized DSP block diagram is a representation of the digital transfer function for the emulation of the previously modeled guitar string 942 of the desired guitar to be emulated having the particular configuration of electromagnetic pickups 953 and 955, as previously discussed. However, it should be appreciated that this generalized DSP block can be applied to any string of any guitar having two electromagnetic pickups, or any other stringed instrument as the equations will remain the same and different values for the variables for the particular guitar or stringed instrument to be modeled can be used.

By way of illustration, the input digital string vibration signal 1001 is processed by FIR1 1002 emulating the magnetic aperture filter response for electromagnetic pickup 953 in response to the initial vibration signal and by FIR1$^{-1}$ 1004 which is the inverse of FIR1 representing the magnetic aperture filter response for electromagnetic pickup 953 in response to the reflected vibration signal (i.e. reflected from the bridge). Further, the input digital vibration signal 1001 is delayed by $z^{-N}{}_1$ such that the reflected vibration signal is emulated as being delayed by $N_1$ samples. Also, as is known in digital system theory $z^{-N}$ represents the sampled digitized equivalent of the true input vibration signal 1001 delayed by N samples. Moreover, the initial and reflected magnetic aperture FIR responses of FIR1 1002 and FIR1$^{-1}$ 1004 to the input vibration signal 1001 are then summed with adder 1010 to generate an emulated digital string tone signal of emulated electromagnetic pickup 953.

Similarly, after the input vibration signal 1001 is delayed by $z^{-D}{}_2$ 1012 such that the response of the second electromagnetic pickup 955, which is closer to the bridge, is properly delayed relative to the response of the first electromagnetic pickup 953 farthest from the bridge, the input digital string vibration signal 1001 is processed by FIR2 1020 emulating the magnetic aperture filter response for electromagnetic pickup 955 in response to the initial vibration signal and by FIR2$^{-}$1024 which is the inverse of FIR2 representing the magnetic aperture filter response for electromagnetic pickup 955 in response to the reflected vibration signal (i.e. reflected from the bridge). Further, the delayed input vibration signal from the output of delay 1012 is delayed by $z^{-N}{}_2$ 1026 such that the reflected vibration signal is emulated as being delayed by $N_2$ samples. Moreover, the initial and reflected magnetic aperture FIR responses of FIR2 1020 and FIR2$^{-1}$ 1024 to the input vibration signal 1001 are then summed with adder 1026 to generate an emulated digital string vibration signal of emulated electromagnetic pickup 955.

Lastly, both the emulated digital string tone signal of emulated electromagnetic pickup 953 and emulated digital string tone signal of emulated electromagnetic pickup 955 are summed by adder 1030 such that an emulated digital tone signal for the corresponding string of the desired guitar that the user has chosen to be emulated (which as in this example has the particular configuration of electromagnetic pickups 953 and 955) is created. This emulated digital tone signal can then be further processed by additional tone-shaping blocks or converted to analog format and outputted to an amplifier which can then playback the emulated tone such that the guitar operating in conjunction with a personal computer implementing audio DSP modeling software sounds like the desired guitar chosen by the user.

Thus, a digital transfer function represented by generalized DSP block diagram 1000 incorporating predetermined FIR filters having predetermined modeling coefficients, based on impulse responses of the modeled electromagnetic pickups, and calculated delays, is created. This digital transfer function can be used emulate the output signal of a guitar string for the particular guitar chosen by a user (having a given configuration of electromagnetic pickups previously modeled) in response to a digital input signal from a played string.

In other words, based on a digital string vibration signal detected by the pickup, the personal computer operating DSP modeling software implements the particular digital transfer function (with predetermined modeling coefficients) of the generalized DSP block diagram 1000 to process the digital string vibration signal to emulate the corresponding string tone of a previously modeled guitar (which has a particular configuration of electromagnetic pickups (e.g. in this case two pickups)) to create an emulated digital tone signal for the played string. This emulated digital tone signal can then be converted to analog format and outputted to an amplifier which can then playback the emulated tone such that the guitar operating in conjunction with a personal computer implementing audio DSP modeling software sounds like the guitar selected by the user. It should be appreciated by those skilled in the art that the above-described DSP algorithms model pickup locations in two dimensions and that further processing is generally required to ultimately generate an output signal.

Although the previously described generalized DSP block diagram 1000 shows one example of a DSP block diagram for a guitar having two electromagnetic pickups for a particular guitar string, it should be appreciated by those skilled in the art that the previously described processes and methods of characterizing the guitar string of the guitar with a particular configuration of electromagnetic pickups can be done for any guitar string of any guitar having any number of electromagnetic pickup configurations and any number of strings. Thus, any guitar, or any stringed instrument can be modeled and then emulated utilizing the previously described processes and methods.

Therefore, using embodiments of the invention, a digital transfer function incorporating predetermined FIR filters having predetermined modeling coefficients, based on impulse responses of modeled electromagnetic pickups, and calculated delays, can be created for any guitar or stringed instrument having a given configuration of electromagnetic pickups and any number of strings. Accordingly, a digital transfer function and corresponding DSP block diagram model can be created and used to emulate an output signal for any guitar or stringed instrument in response to a digital input signal from a played string. In other words, based on a digital string vibration signal detected by the bridge, the personal computer operating audio DSP software modules, and particularly electric guitar modeling software, implements a particular digital transfer function (with predetermined modeling coefficients) to process the digital string vibration signal to emulate a corresponding string's tone of a desired guitar that the user has chosen to be emulated to create an emulated digital tone signal of the selected guitar. This emulated digital tone signal can then be converted to analog format and outputted to an amplifier which can then playback the emulated tone such that the guitar sounds like the desired guitar chosen by the user. Moreover, this methodology can be applied to any stringed instrument, e.g., acoustic guitars, mandolins, basses, etc.

Also, important to accurately modeling the tone of a guitar is the way the pickup height affects the tone of the guitar by introducing non-linear distortion into the output signal of the guitar in response to the string vibrating. The magnetic field strength in the vertical axis or 'y' axis is strongest right above the electromagnetic pickup, and it is weaker as the vertical distance increases. Therefore, when a string is played, the string's oscillation brings the string closer to and farther from the electromagnetic pickup such that non-linear distortion is introduced into the guitar output and therefore a nonlinear gain needs to be applied to properly model or emulate the true sound of the guitar string. Of course, depending on the pickup height, the amount of non-linearity will vary.

Embodiments of the invention further provide for emulating the pickup height of an electromagnetic pickup (e.g. along the vertical or 'y' for the axis) for the corresponding string of the emulated guitar. More particularly, emulating the pickup height of the electromagnetic pickup also includes applying a non-linear gain to model non-linear distortion associated with the pickup height of the electromagnetic pickup for the corresponding string of the emulated stringed instrument, e.g. a guitar, in the processing of the digital string vibration signal. In this way, the overall tone of the guitar in response to a string vibration signal is emulated along both the 'x' and 'y' axis, and thus the sound of a selected guitar to be emulated, can be more truly emulated.

Figure 11A:
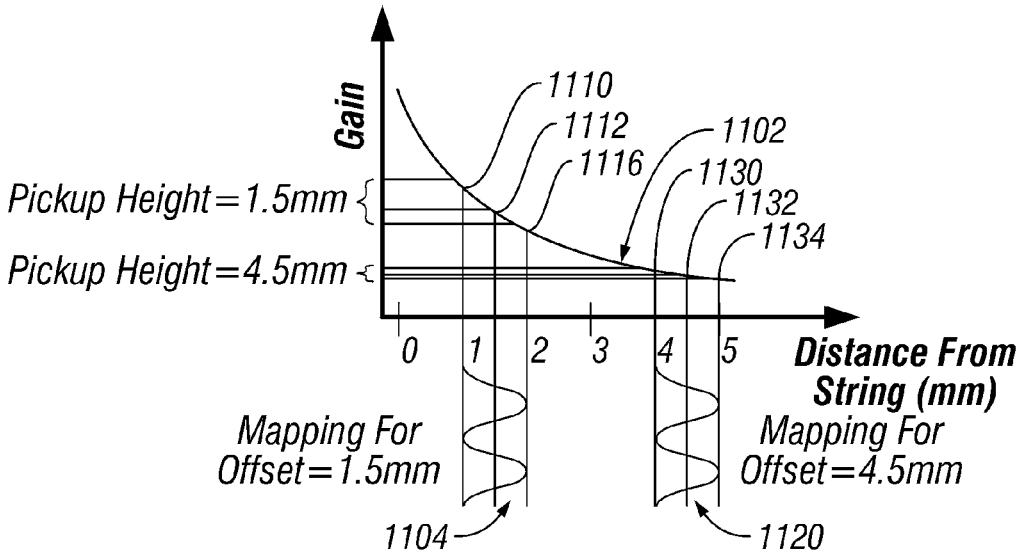
FIG. 11A shows a non-linear gain curve for different pickup heights in relation to a vibrating string, according to one embodiment of the present invention.

In order to model the non-linearity of a vibrating string with respect to differing pickup heights of an electromagnetic pickup, a string vibration signal that represents the distance traveled by a string to or from an electromagnetic pickup (along the y axis), from the at rest 'bias' point of the string, can be used with reference to a non-linear gain curve. Referring now to FIG. 11A, FIG. 11A shows a non-linear gain curve 1102 for different pickup heights in relation to a vibrating string. Particularly, a string vibration signal is mapped to the non-linear gain curve 1102, where the maximum attainable amplitude of the string vibration signal corresponds to the maximum amount of string travel from observation. As will be discussed, an offset can then be added to the digital string vibration signal to obtain the proper gain and hence simulate the effect of the pickup height and the degree of non-linearity that is introduced due to the pickup height in relation to the vibrating string.

Figure 11B:
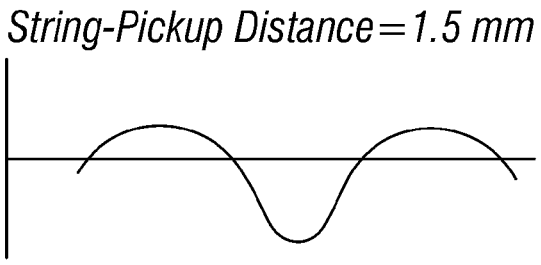
FIG. 11B shows an example of the distorted output of a vibrating string (e.g. output in voltage) due to non-linear gain for a first relatively close pickup height.

FIG. 11A demonstrates this effect for a sinusoidally vibrating string vibrating with an amplitude of 1 millimeter (mm) peak-to-peak over the region of a virtual electromagnetic pickup (i.e. over the pickup height, the bias point, when the string is at rest). The variable gain is shown at min, max, and mid string vibration for these two locations. As a first example, a sinusoidally vibrating string 1104 is shown vibrating about a virtual electromagnetic pickup, wherein the pickup height is 1.5 mm (i.e. this is the bias point when the string is at rest) and the string vibrates between a 1 mm pickup height and a 2 mm pickup height. Correspondingly on the non-linear gain curve 1102 an associated gain at a minimum 1110 (i.e. pickup height=1 mm) can be found, an associated gain at middle 1112 (i.e. pickup height=1.5 mm, the bias point), and an associated gain at maximum 1116 (i.e. pickup height=2 mm). FIG. 11B shows an example of the distorted output of vibrating string 1104 (e.g. output in voltage) due to non-linear gain.

Figure 11C:
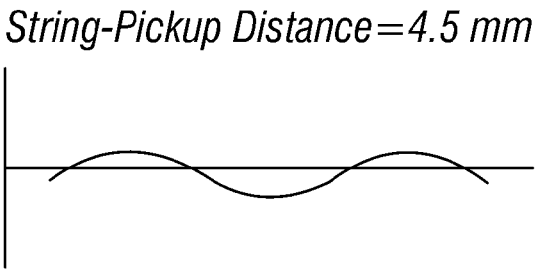
FIG. 11C shows the distorted output of a vibrating string (e.g. output in voltage) due to non-linear gain for a second relatively distant pickup height.

As a second example, a sinusoidally vibrating string 1120 is shown vibrating about a virtual electromagnetic pickup, wherein the pickup height is 4.5 mm (i.e. this is the bias point when the string is at rest) and the string vibrates between a 4 mm pickup height and a 5 mm pickup height. Correspondingly on the non-linear gain curve 1102 an associated gain at a minimum 1130 (i.e. pickup height=4 mm) can be found, an associated gain at middle 1132 (i.e. pickup height=4.5 mm, the bias point), and an associated gain at maximum 1134 (i.e. pickup height=5 mm). FIG. 11C shows the distorted voltage output of vibrating string 1120 (e.g. output in voltage) due to non-linear gain.

As can be seen in FIGS. 11B and 11C, the output of the same vibrating string signal gets more heavily distorted as the pickup gets closer to the string. Thus, in FIG. 11B where the pickup is relatively close (i.e. pickup height=1.5 mm) the output signal is more heavily distorted than in FIG. 11C where the pickup is relatively farther away (i.e. pickup height=4.5 mm). This can be modeled as shown in FIG. 11A by a non-linear gain curve that provides a relatively high variation in gain for a pickup height of 1.5 mm, as compared to the more consistent gain for a pickup height at 4.5 mm. Accordingly, the non-linear gain curve 1102 can be used provide offsets or gain for differing pickup heights (e.g. 1.5 mm and 4.5 mm) to simulate the non-linearity of the pickup response for an electromagnetic pickup having pickup heights at these distances.

This non-linear distortion effect for a given electromagnetic pickup at given pickup heights can be compensated for by utilizing, for example, a lookup table that describes the non-linear gain of the pickup as previously characterized with a non-linear gain curve 1102 as shown in FIG. 11A. Moreover, multiple lookup tables can hold non-linear gain curves for each of a wide variety of different electromagnetic pickups that are to be emulated.

Figure 11D:
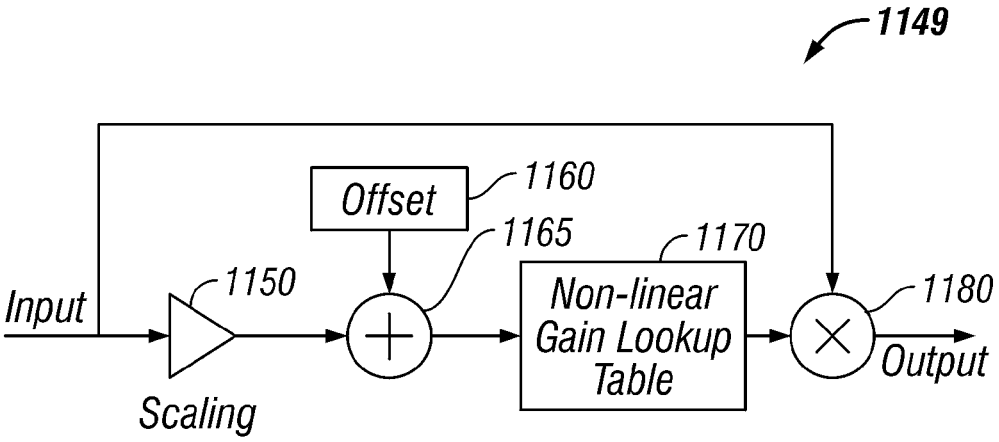
FIG. 11D shows a block diagram of a DSP algorithm that can be utilized for implementing non-linear gain modeling of a string in relation to an electromagnetic pickup at given pickup heights, according to one embodiment of the present invention.

Looking now to FIG. 11D, FIG. 11D shows a block diagram of a DSP algorithm 1149 that can be utilized for implementing the non-linear gain modeling of a string in relation to an electromagnetic pickup at given pickup heights, as previously discussed. First, an input digital string vibration signal is scaled by scaling block 1150. The input digital string vibration signal is also directly routed to multiplier block 1180. Particularly, the value of the input digital string vibration signal (e.g. a digital representation of a voltage) is converted to a scaled physical vibration distance amplitude. The vibrating strings 1104 and 1120 have been scaled to an amplitude of 1 mm.

An offset from offset block 1160 is added by adder block 1165 to simulate the distance from the pickup height being modeled. This offset is added to the scaled physical vibration distance amplitude and provides the input to the non-linear gain lookup table 1170 to find a resultant non-linear gain that should be applied to properly emulate the non-linear distortion of the tone of the string in relation to the height of the particular electromagnetic pickup being modeled. The gain value is multiplied at multiplier block 1180 with the original input digital signal to obtain the emulated digital tone signal being emulated as if it were actually distorted by the real non-linear gain effect of the particular electromagnetic pickup at the specific pickup height.

For example, if the input digital vibration signal of string 1104 is scaled to an amplitude of 1 mm and has a scaled vibration distance amplitude reading of 0.3 mm and the pickup height or offset is 1.5 mm, a resultant gain would be found in the non-linear gain lookup table 1170 for a corresponding non-linear gain value for the particular electromagnetic pickup being modeled by getting the value of the gain that corresponds to 1.8 mm (1.5 mm+0.3 mm). The gain value will be multiplied at multiplier block 1180 with the original digital input signal to obtain the emulated digital tone signal, which is emulated as if it were actually distorted by the real non-linear gain effect of the particular electromagnetic pickup at the specific pickup height.

Figure 12:
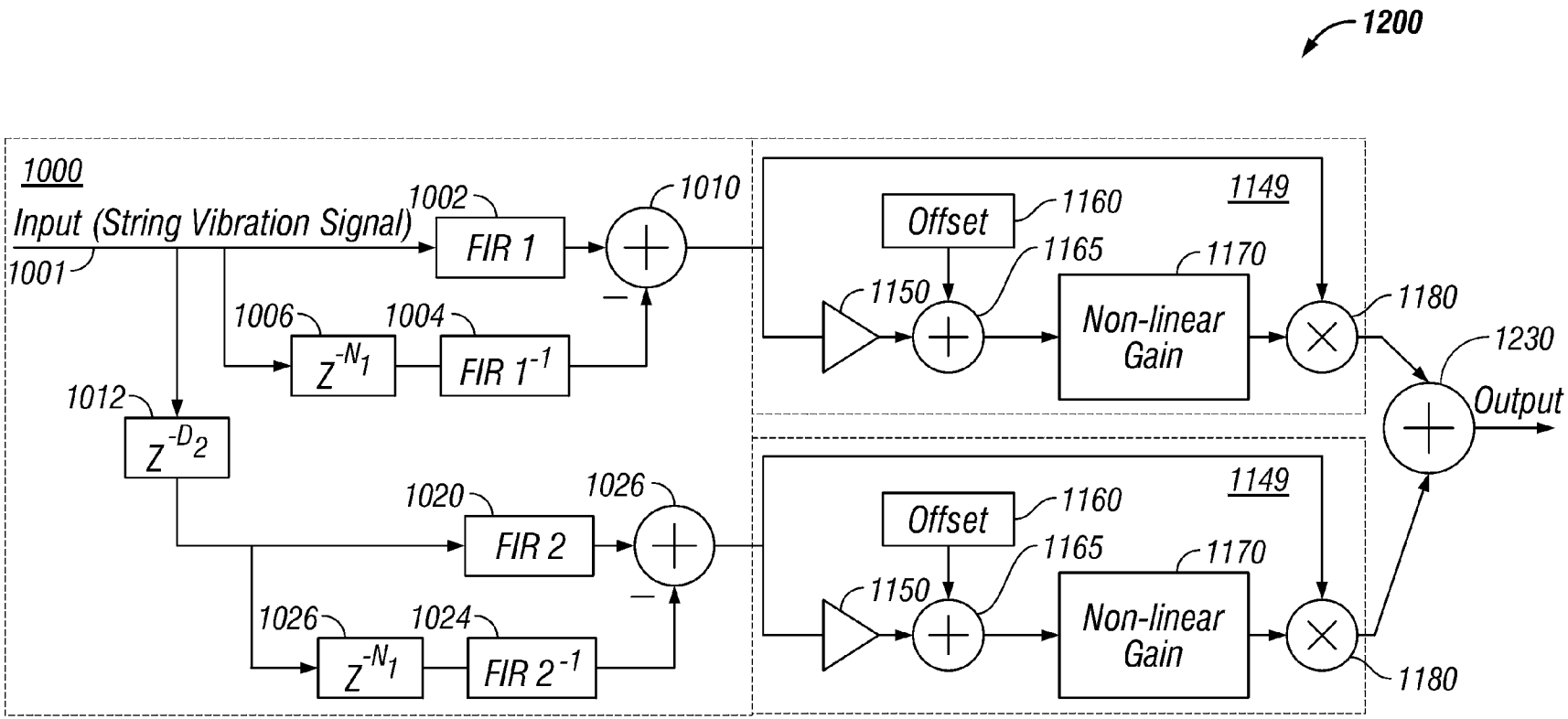
FIG. 12 shows a complete two dimensional example of a generalized block diagram of a DSP algorithm for emulating two electromagnetic pickups located at particular x (horizontal) locations and at particular y (pickup height) displacements along the string of a guitar of a particular guitar to be emulated and further including implementing non-linear gain modeling of the string, according to one embodiment of the present invention.

With reference now to FIG. 12, FIG. 12 shows a complete two dimensional example of a block diagram of a DSP algorithm 1200 for emulating two electromagnetic pickups located at particular x (horizontal) locations and at particular y (pickup height) displacements along the string of a guitar of a particular guitar to be emulated and further including implementing the previously described non-linear gain modeling of a string. As shown in FIG. 12, a input digital string vibration signal 1001 for the string enters the DSP block diagram 1000. It should be appreciated that DSP block diagram is a representation of the digital transfer function for the emulation of a guitar string of a desired guitar to be emulated with the particular configuration of electromagnetic pickups, previously discussed. However, this DSP block diagram can be generalized to any string of any guitar having two electromagnetic pickups, or any other stringed instrument.

By way of illustration, the input digital string vibration signal 1001 is processed by FIR1 1002 emulating the magnetic aperture filter response for a first electromagnetic pickup in response to an initial vibration signal and by FIR$\mathbf{1}^{-1}$ 1004 which is the inverse of FIR1 representing the magnetic aperture filter response for electromagnetic pickup in response to the reflected vibration signal (i.e. reflected from the bridge). Further, the input digital vibration signal is delayed by $z^{-N_1}$ 1006 such that the reflected vibration signal is emulated as being delayed by $N_1$ samples. Moreover, the initial and reflected magnetic aperture FIR responses of FIR 1 1002 and FIR $\mathbf{1}^{-1}$ 1004 to the input vibration signal 1001 are then summed with adder 1010 to generate a first emulated digital string vibration signal of the first emulated electromagnetic pickup.

Similarly, after the input vibration signal 1001 is delayed by $z^{-D_2}$ 1012 such that the response of the second electromagnetic pickup, which is closer to the bridge, is properly delayed relative to the response of the first electromagnetic pickup farthest from the bridge, the input digital string vibration signal 1001 is processed by FIR2 1020 emulating the magnetic aperture filter response for the second electromagnetic pickup in response to the initial vibration signal and by FIR$\mathbf{2}^{-1}$ 1024 which is the inverse of FIR2 representing the magnetic aperture filter response for second electromagnetic pickup in response to the reflected vibration signal (i.e. reflected from the bridge). Further, the delayed input vibration signal from the output of delay 1012 is delayed by $z^{-N_2}$ 1026 such that the reflected vibration signal is modeled as being delayed by $N_2$ samples. Moreover, the initial and reflected magnetic aperture FIR responses of FIR2 1020 and FIR$\mathbf{2}^{-1}$ 1024 to the input vibration signal 1001 are then summed with adder 1026 to generate a second emulated digital string vibration signal of the second emulated electromagnetic pickup.

Now both the first and second emulated digital string vibrations of the first and second emulated electromagnetic pickups, respectively, are each processed through DSP algorithm blocks 1149 to implement non-linear gain modeling of the string in relation to each electromagnetic pickup at its given pickup height, respectively. Both the first and second emulated digital string vibration signal of the first and second emulated electromagnetic pickups, are scaled by scaling block 1150, respectfully. Each of the first and second emulated digital string vibration signals of the first and second emulated electromagnetic pickups, respectively, are also each directly routed to multiplier block 1180. Particularly, the values of each of the first and second emulated digital string vibration signals of the first and second emulated electromagnetic pickups, respectively, are each converted to a scaled physical vibration distance amplitude, as previously discussed.

An offset from offset block 1160 is added by adder block 1165 to simulate the distance from the pickup height being modeled for each of the first and second emulated digital string vibration signals. This offset is added to the scaled physical vibration distance amplitude and provides the input to the non-linear gain lookup table 1170 to find a resultant non-linear gain that should be applied to properly emulate the non-linear distortion of the tone of the string in relation to the height of the particular electromagnetic pickup being modeled. A gain value is multiplied at multiplier block 1180 with each of the first and second emulated digital string tone signals of the first and second emulated electromagnetic pickups, respectively, to obtain first and second emulated digital string tone signals that are emulated as if they were both actually distorted by the real non-linear gain effect of the first and second electromagnetic pickups at their particular pickup heights, respectively.

Lastly, both the first emulated digital string tone signal of the first emulated electromagnetic pickup and the second emulated digital string tone signal of the second emulated electromagnetic pickup are summed by adder 1230 such that an emulated digital tone signal for the corresponding string of the desired guitar that the user has chosen to be emulated is created. This emulated digital tone signal emulates the string as detected by an electromagnetic pickup at a particular location relative to the string of the desired guitar in both the 'x' and 'y' directions including non-linear gain modeling.

This emulated digital tone signal emulated by the personal computer operating audio electric guitar modeling DSP software can be sent back over the serial link to the guitar where it is converted to analog format and outputted to an amplifier which can then playback the emulated tone such that the guitar like the desired guitar chosen by the user.

Thus, a digital transfer function represented by combined DSP block diagram 1200 incorporating predetermined FIR filters having predetermined modeling coefficients, based on impulse responses of the modeled electromagnetic pickups, and calculated delays and non-linear modeling in the 'y' axis by DSP block diagrams 1149 is created. This digital transfer function can be used emulate the output signal of the guitar string for the particular guitar chosen by a user in response to a digital input signal from a played string.

In other words, based on a digital string vibration signal detected by the bridge of the guitar and sent over the serial link to the personal computer, the personal computer operating audio electric guitar modeling DSP software implements particular digital transfer functions (with predetermined modeling coefficients for the particular guitar to be emulated) of combined DSP block diagram 1200 to process the digital string vibration signal to emulate the corresponding string as detected by an electromagnetic pickup at a particular location relative to the string of the modeled guitar (which has a particular configuration of electromagnetic pickups previously modeled) to create an emulated digital tone signal that is modeled in both the 'x' and 'y' axis domains. This emulated digital tone signal is then sent back over the serial link to the guitar or headphones where it is converted to analog format and outputted to an amplifier which can then playback the emulated tone such that the guitar with sounds like the guitar selected by the user. Again, as previously discussed, it should be appreciated by those skilled in the art that the above-described DSP algorithms are used to model pickup locations in two dimensions and that further processing is generally required to ultimately generate an output signal.

Although the previously described combined DSP block diagram 1200 illustrates only one particular example of a DSP block diagram for a guitar having two electromagnetic pickups for a particular guitar string, it should be appreciated by those skilled in the art that the previously described processes and methods of characterizing the guitar string as detected by an electromagnetic pickup at a particular location relative to the string of the guitar with a particular configuration of electromagnetic pickups (in both the 'x' and 'y' axis domains) can be done for any guitar string of any guitar having any number of electromagnetic pickup configurations and strings. Moreover, although described with reference to an electric guitar, it should be appreciated that utilizing the previous described methods and techniques, any stringed instrument can be modeled. Thus, any electrified stringed instrument can be modeled and then emulated utilizing the previously described processes and methods.

Therefore, using embodiments of the invention, a digital transfer function incorporating predetermined FIR filters having predetermined modeling coefficients, based on impulse responses of modeled electromagnetic pickups, and calculated delays, can be created for any guitar or stringed instrument having a given configuration of electromagnetic pickups and any number of strings, and further non-linear gain can be applied to further emulate the non-linear distortion effects of particular electromagnetic pickups at particular pickup heights. Accordingly, a digital transfer function and corresponding DSP block diagram model can be created and used to emulate a output signal for any guitar or stringed instrument in response to a digital input signal from a played string.

In other words, based on a digital string vibration signal detected by the bridge and sent to the personal computer over the serial link, the personal computer operating audio electric guitar modeling DSP software implements particular digital transfer functions to process the digital string vibration signal to emulate a corresponding string tone of a desired guitar (in both the 'x' and 'y' axis domains) that the user has chosen to be emulated to create an emulated digital tone signal of the selected guitar. This emulated digital tone signal is then sent back to the guitar over the serial link where it is converted to analog format and outputted to an amplifier or headphones which can then playback the emulated tone such that the guitar sounds like the desired guitar chosen by the user.

Moreover, these techniques further allow for the modeling of any stringed instrument, e.g., acoustic guitars, mandolins, basses, etc. For example, in the case of acoustic instruments, standard techniques utilized to model the body resonances of acoustic instruments can be utilized. One such example is the acoustic modeling techniques disclosed in "More Acoustic Sounding Timbre from Guitar Pickups" by Karjalainen, Penttinen, and Valimaki, presented at the Proceedings of the 2$^{nd}$ COST G-6 Workshop on Digital Audio Effects (DAFx99), NTNU, Trondheim, Dec. 9-11, 1999, hereby incorporated by reference.

Another embodiment of the invention relates to personal computer operating audio acoustic guitar modeling DSP software that simulates the sounds of acoustic stringed instruments, such as, various types of acoustic guitars. The acoustic guitar DSP modeling is performed by a personal computer operating audio acoustic guitar modeling DSP software upon serially formatted digital signals received from a guitar over a serial link, as previously discussed.

In the acoustic modeling guitar embodiment of the invention, a plurality of different types of acoustic guitars are selectable by the user. For example, classic types of acoustic guitars that have associated classic "sounds" or tones may be emulated including various types of brands of acoustic guitars such as MARTIN, IBANEZ, TAYLOR, etc., as well as various types of configurations of these acoustic guitars: steel string, nylon string, hollow body, semi-solid body, etc.

As previously described, the polyphonic pickup of the guitar is used to detect the vibration signal of each string (i.e. when a string is played by a musician). The detected vibration signal of the string is then coupled to a respective A/D converter. The respective A/D converter converts the detected vibration signal of the string into a digital string vibration signal which is then serially formatted and then sent to the personal computer for acoustic modeling.

The personal computer operating audio acoustic guitar DSP software modeling processes the digital string vibration signal such that the corresponding string tone of the selected acoustic guitar is properly emulated based on pre-determined modeling coefficients for the selected acoustic guitar.

The personal computer utilizes the proper pre-determined modeling coefficients with the audio acoustic DSP software module for the particular acoustic guitar selected by the user to be emulated. In this way, the personal computer performs the proper transformations on the digital string vibration signal to properly emulate the corresponding sonic qualities of the particular acoustic guitar chosen by the user to be played. As will be discussed hereinafter, various types of filtering and modeling coefficients are applied to the digital string vibration signal in order to realistically emulate the desired acoustic guitar.

It also should be noted that all of the various types of filters, modeling systems, and processing to be hereinafter discussed in detail are based on pre-determined modeling coefficients and parameters that have been previously determined for each selected acoustic guitar to be emulated based on prior testing and modeling and these values have then been programmed to memory for subsequent use.

The properly emulated digital acoustic tone signal is then sent back from the personal computer over the serial link to the guitar where it is converted to analog form by the D/A converter to create an output emulated analog acoustic tone signal for output to an amplification device such as an amplifier or headphones, as previously discussed.

Figure 13:
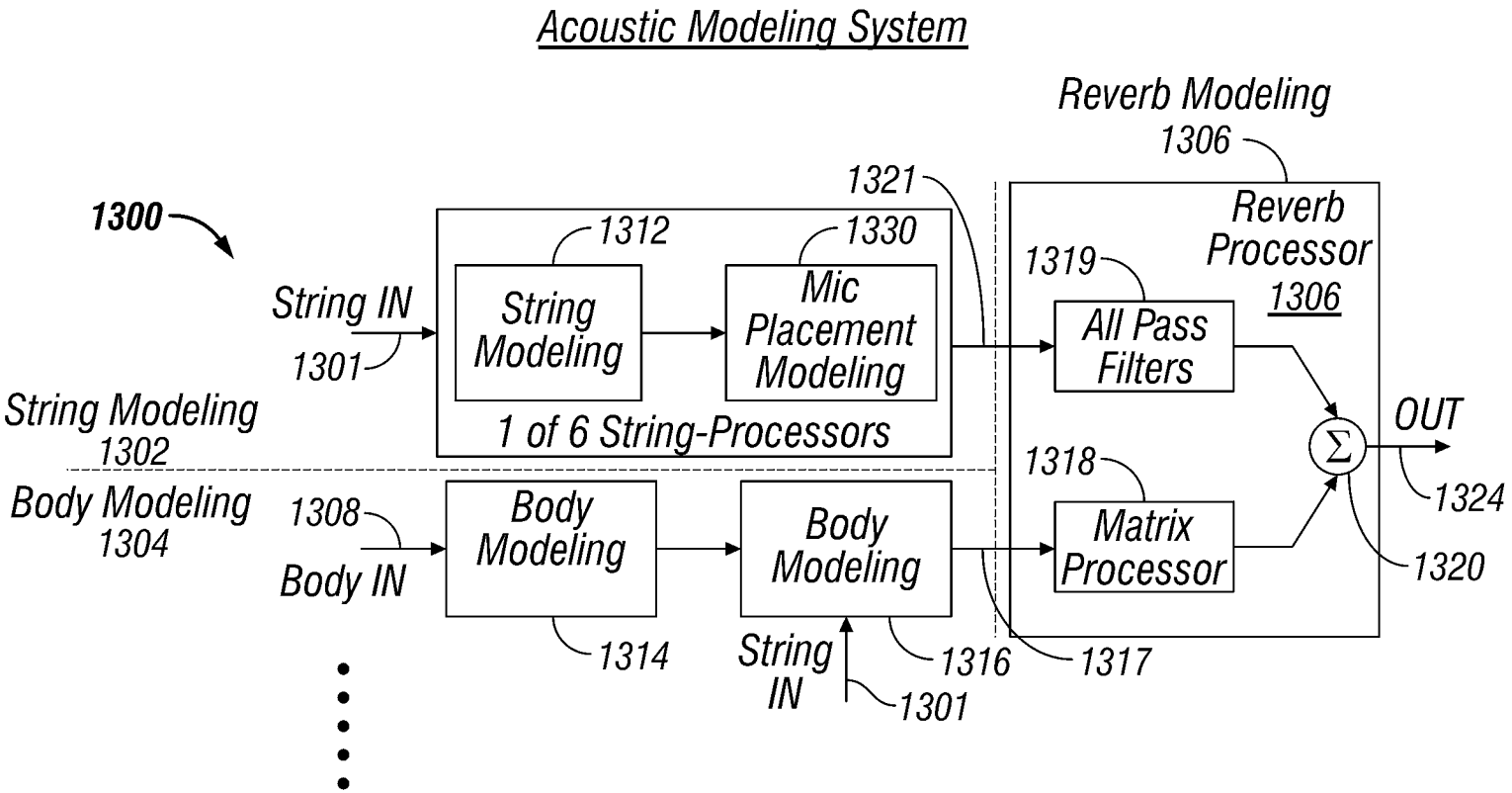
FIG. 13 is a block diagram of an acoustic modeling system, according to one embodiment of the invention.

With reference now to FIG. 13, FIG. 13 is a block diagram of an acoustic modeling system 1300, according to one embodiment of the invention. Particularly, the acoustic modeling system 1300 implements a variety of modeling stages in order to accurately model an acoustic stringed instrument or guitar. It should be appreciated that the following description of the modeling and filtering of string and body components to accurately emulate an acoustic stringed instrument may be implemented in the previously described personal computer operating the audio acoustic DSP software module.

As shown in FIG. 13, the acoustic modeling system 1300 implemented by the audio acoustic DSP software module implements string modeling 1302, body modeling 1304, microphone placement modeling 1330, and reverb modeling 1306 responsive to both a string input 1301 and a body input 1308 in order to accurately emulate a selected acoustic guitar. Particularly, string input 1301 is the digital string vibration signal that has been serially formatted and sent over the serial link from the guitar which is the result of a user picking a string of the guitar.

The body input signal 1308 identifies the body of the acoustic stringed instrument selected by the user to be emulated via the user interface. Based on this body input signal 1308, particular body modeling coefficients 1314 are selected for use in body modeling 1316.

The audio acoustic DSP software module operating on the personal computer implements acoustic modeling system 1300 to process the digital string vibration signal (string IN 1301) to emulate a corresponding string tone of one or a plurality of acoustic guitars selected by a user resulting in output emulated acoustic digital string signal 1324. The output emulated acoustic digital string signal 1324 may then be sent back over the serial link to the guitar where it is converted to analog form to create an emulated analog acoustic string signal for output via a standard guitar cable to an amplification device.

As previously discussed, the user interface located on the body of the guitar allows a user to select one or a plurality of acoustic guitars to be emulated.

As will be discussed, the emulation of a corresponding string tone for a selected acoustic guitar to be emulated includes body modeling 1316 in which a body of the acoustic guitar is emulated and filtering is applied to the digital string vibration signal 1301 based on a model of the body of the acoustic guitar to be emulated. The body modeling of the acoustic guitar may include modeling the body of the acoustic guitar as a bandpass filter based on the mechanical impedance of the soundboard of the body of the acoustic guitar to be emulated and filtering the digital string vibration signal with the bandpass filter. In one embodiment, the bandpass filter used to model the mechanical impedance may be a multi band parametric equalization filter.

Further, body modeling 1316 of the acoustic guitar may further model the relationship of the string to the soundboard of the body of the acoustic guitar to be emulated based on the mechanical admittance of the string to the soundboard measured at the bridge and filtering the digital string vibration signal based on the mechanical admittance.

The emulation of a corresponding string tone of an acoustic guitar may further include microphone placement modeling 1330 in which the digital string vibration signal (string input 1301) is filtered to emulate the string tone being processed through a stationary microphone. As will be discussed, this may include filtering the digital string vibration signal with a comb filter having a randomly varying delay.

Also, in one embodiment, the string tone for a selected acoustic guitar may further include modeling the sound of pick hitting a string. As will be discussed, in order to model the sound of a pick hitting a string, the filtering of the digital string vibration signal in string modeling 1312 may include adding a dynamic equalizer to boost high-frequency energy for short periods of time to model the sound of a pick hitting a string.

It also should be noted that all of the various types of filters, modeling systems, and processing to be hereinafter discussed in detail are based on pre-determined modeling coefficients and parameters that have been previously determined for each selected acoustic guitar to be emulated based on prior testing and modeling and these values may be utilized by the personal computer implementing the audio acoustic DSP software module.

It should also be appreciated that acoustic modeling system 1300 of FIG. 13 only shows the modeling of one played string (i.e. string input 1301), and that, typically, six played strings would be utilized with the acoustic modeling guitar 100. In that case the acoustic modeling system 1300 shown in FIG. 13 would be repeated six times, once for each string. However, for brevity's sake, only the modeling of one string is shown.

Thus, the acoustic modeling system 1300 is applied to each string to create a highly realistic sound for a selected acoustic guitar to be emulated by utilizing string and body modeling 1312 and 1316, microphone placement modeling 1330, and reverb modeling 1306, as will be discussed hereinafter. The acoustic modeling system 1300 provides a very high level of sonic accuracy and realism by implementing filtering and modeling techniques to emulate dynamic string and body interaction, random microphone movement, and pick-sound simulation.

String modeling 1302 will now be particularly discussed. Each digital input vibration string signal 1301 undergoes string modeling 1312. String modeling 1312 is typically performed by well known string equalization techniques.

Basically, for the selected acoustic guitar to be emulated, each string of the corresponding acoustic guitar to be emulated has a complicated frequency response. The frequency responses for strings of specific guitars are previously determined and modeled and modeling coefficients to re-create the frequency response utilizing DSP processes are provided by the acoustic DSP software modeling and are stored in memory. Particularly, the frequency response for each string is emulated by string modeling 1312 by utilizing pre-determined modeling coefficients and DSP processing such that the played string of the acoustic modeling guitar, i.e., digital string input vibration signal 1301, conforms to the model frequency response for the given string of the acoustic guitar to be emulated. Such string modeling frequency responses are well known in the art.

Typically, there will be one to six string inputs 1301, which are digital string input vibration signals, based on a user playing the acoustic modeling guitar 100, each of which undergoes string modeling 1312 to accurately model the corresponding strings of the acoustic guitar to be emulated.

Further, for the acoustic guitar selected to be emulated, body modeling 1316 is also applied. In one embodiment, body modeling 1316 applies a tunable parametric equalization filter that has been previously determined to accurately model the mechanical impedance of the soundboard of the selected acoustic guitar. It should be noted that the soundboard refers to the front face of the acoustic guitar. Further, the frequency responses for soundboards of a plurality of different types of acoustic guitars are previously modeled and body modeling coefficients 1314 corresponding thereto are stored and selected based on the body input signal 1308. The body input signal 1308 corresponds to the selected acoustic guitar to be emulated and these body modeling coefficients 1314 are transmitted to body modeling process 1316.

These body modeling coefficients 1314 are utilized by body modeling process 1316 to re-create the frequency response of the soundboard utilizing DSP processes. More particularly, body input signal 1308 corresponds to the acoustic guitar selected to be modeled by the user (e.g. by the user interface), which in turn, selects particular parametric equalization filters for use in re-creating the frequency response of the soundboards in body modeling process 1316. In one embodiment, a 12-band parametric equalization filter is utilized to reconstruct the frequency response of the soundboard.

The tunable 12-band parametric equalization filter has been found to suitably model the mechanical impedance of the soundboard of an acoustic guitar. Basically, the mechanical impedance of the soundboard may be modeled as a suspension system, and more particularly, as a parallel second order response system, such that the soundboard may be modeled as a classical spring-mass mechanical system and/or a resistance-inductance-capacitance (RLC) equivalent circuit. Thus, the mechanical impedance of the soundboard may be accurately modeled by a tunable multi band parametric equalization filter.

Body modeling processing 1316 also receives digital string input vibration signal 1301 and based upon the selected multi band parametric equalization filter for the soundboard of the acoustic guitar to be emulated applies the parametric filter (i.e. bandpass filter) to the inputted digital string input signal 1301 to bandpass filter the input. In this way, certain frequencies are selected to aid in body modeling. As a result body modeled digital signal 1317 is transmitted to reverb processor 1307 for reverb modeling.

Both the digital string acoustic input signal 1301 after processing by string modeling 1312 (previously discussed) and after microphone placement modeling 1330 (as will be hereinafter discussed) and body modeled digital signal 1317 from body modeling processing 1316 are both subjected to reverb modeling 1306 by a reverb processor 1307 and combined at summer 1320. The resultant output 1324 is a digital composite acoustic output signal that has been processed to emulate particular qualities of a selected acoustic guitar, the particular acoustic characteristics of the body of the acoustic guitar, as well as string interaction with the body, microphone placement modeling, pick-sound modeling, as well as other modeling, that will be hereinafter described. This modeled digital output signal 1324 is then sent from the personal computer back over the serial link to the guitar where it is converted to analog form and outputted to an amplifier or other device for playback to the user.

In the reverb processor 1307 the body modeled digital signal 1317 is injected into parallel delay lines constituting a matrix reverb processor 1318. The parallel delay lines provide delay looping to add reverb to the body modeled digital signal 1317. In this implementation, the reverb delays are selected to be relatively short to reproduce the volume and shape of a specific acoustic guitar body as opposed to simulating the volume of an entire room.

Further, the digital string signal 1321 undergoes reverb modeling 1306 by reverb processor 1307 by being processed through a series of all pass filters 1319. These two signals that have been subjected to reverb modeling are summed at summer 1320 to produce an output digital acoustic string signal that has been digitally modeled and filtered to emulate a particular string of a particular type of acoustic guitar including such factors as the acoustic guitar's body, microphone simulation and the string's interaction with the guitar's body.

In one embodiment, the acoustic modeling system 1300 also provides for microphone placement modeling 1330. This type of modeling models the characteristic sound produced by a performer's movement relative to a stationary microphone attached to or located near the guitar. This can be effectively modeled by utilizing various digital signal processing (DSP) techniques, as will be discussed.

In one embodiment, a comb filter may be utilized to implement the modeling of the sound produced by a performer's movement of an acoustic guitar relative to a stationary microphone.

Figure 14:
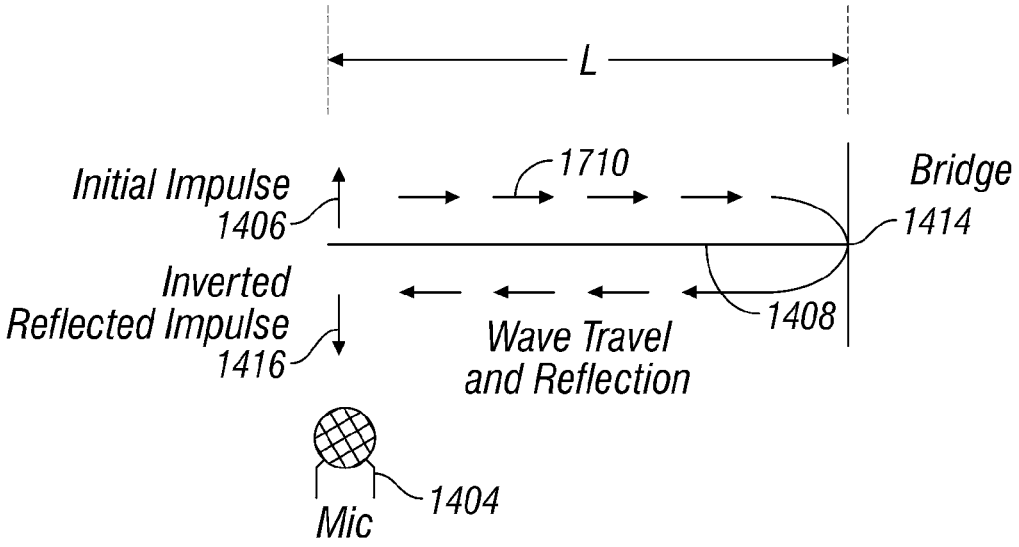
FIG. 14 is a diagram depicting the physics of microphone placement modeling and particularly illustrates how sound impulses are presented to a stationary microphone.

In order to illustrate these microphone placement modeling techniques, FIG. 14 is a diagram depicting the physics of microphone placement modeling and particularly illustrates how sound impulses are presented to a stationary microphone 1404.

The initial impulse, depicted by the vertical upward pointing arrow 1406, is produced when the performer plucks or strums a particular string 1408. The horizontal arrows 1410 depict the sound wave traveling the length (L) of the string 1404 and being reflected at the bridge 1414 and traveling back down the length of the string and eventually arriving at the microphone 1404 out-of-phase from the initial impulse 1406. This reflection of the sound wave may be modeled utilizing a comb filter. Further, in one embodiment of the invention, the delay implemented by the comb filter is dynamically varied, which has the effect of appearing to move the acoustic guitar around a stationary microphone thereby producing a convincing random microphone movement effect that realistically emulates how an acoustic guitar and/or performer move relative to a stationary microphone.

Figure 15:
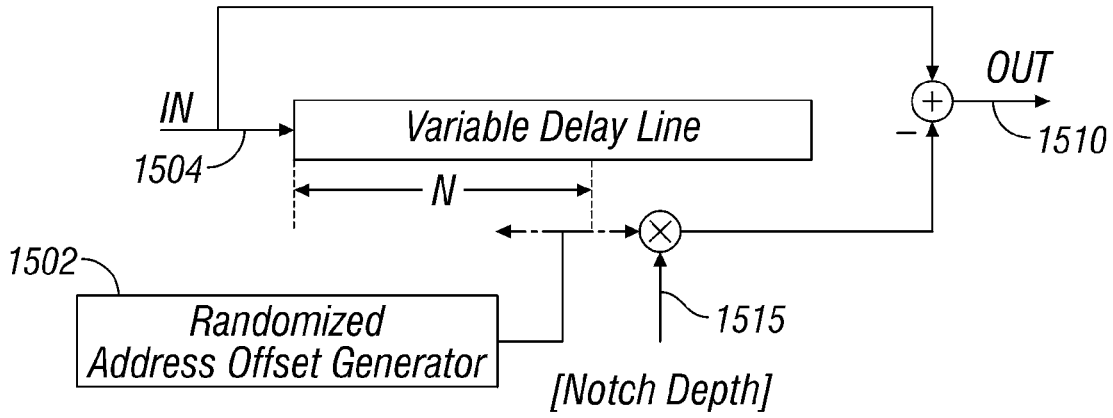
FIG. 15 is a block diagram illustrating an example of how a randomized address offset generator may be utilized in the acoustic modeling system, according to one embodiment of the invention.

In order to accomplish this, a randomized address offset generator may be utilized. With reference to FIG. 15, FIG. 15 is a block diagram illustrating an example of how a randomized address offset generator 1502 may be utilized in the acoustic modeling system, according to one embodiment of the invention.

Referring briefly back to FIG. 14, the microphone 1404 picks up a sound at a particular point along the length of the string 1408 to capture the initial impulse, which is reflected at the bridge 1414 and inverted, and appears to the microphone 1404 as an inverted impulse at a time (T). This time T is determined by the length (L) of the string and the wave speed (denoted as C). By taking the length L and dividing it by the wave speed C, the time delay between the positive impulse 1406 and its reflection in the opposite phase (i.e. inverted reflected impulse 1416) can be determined. This relationship may be expressed simply as:

$$T=L/C$$

Where C=(scale length)*(open string frequency)*2

With reference back to FIG. 15, the length of the delay N may be chosen to approximate T in terms of initial audio samples. However, in order to accomplish microphone placement modeling, the actual N value may be dynamically altered by the randomized address offset generator 1502 in order to provide continuous changes which are consistent with producing a realistic random-microphone effect.

As shown in FIG. 15, an input digital acoustic string signal 1504 may be varied by N along variable delay line 1506 responsive to a randomized address offset generator 1502. This input digital acoustic string signal that is varied along variable delay line 1506 may then be subtracted from the input digital acoustic string signal to produce an output digital acoustic string signal 1510 that has been randomized to approximate continuous changes consistent with the acoustic guitar being emulated being amplified by a stationary microphone and modeling the effect of a performer's movement relative to the stationary microphone.

Also, as shown in FIG. 15, a notch depth 1515 may also be introduced into this system. The notch depth 1515 is a predetermined coefficient for the particular acoustic guitar selected by the user. Notch depths are pre-determined and modeled to provide a more realistic sound for a particular microphone and acoustic guitar combination. As will be discussed, the notch depth effects the amplitude of the resulting signal.

Figure 16:
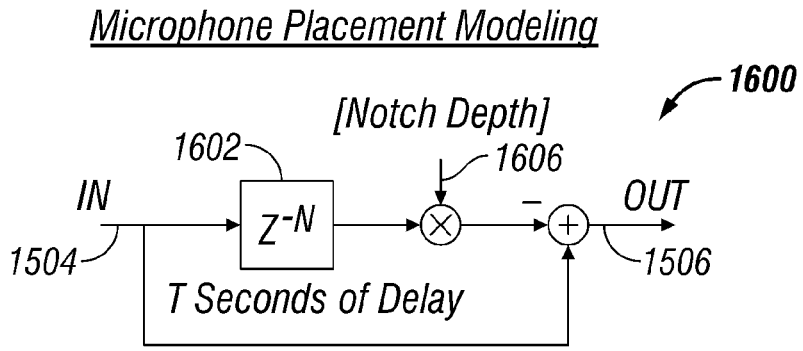
FIG. 16 is a block diagram illustrating a sample-based comb filter, according to one embodiment of the invention.

With reference to FIG. 16, FIG. 16 is a block diagram illustrating a sample-based comb filter 1600 where the delay time is a function of how many samples are stored to memory, according to one embodiment of the invention. T seconds of delay may be represented by memory bank 1602. Here the comb filter ($Z^{-N}$) delay may be varied by N which is dynamically altered utilizing the previously-discussed random address generation. In addition to varying the delays of the associated comb filters, the "notch" produced by the comb filters is also variable as shown by notch depth input 1606. Thus, the input digital acoustic string signal 1504 is randomized to model the effect of a performer's movement relative to a stationary microphone resulting in output digital acoustic string signal 1510.

Figure 17:
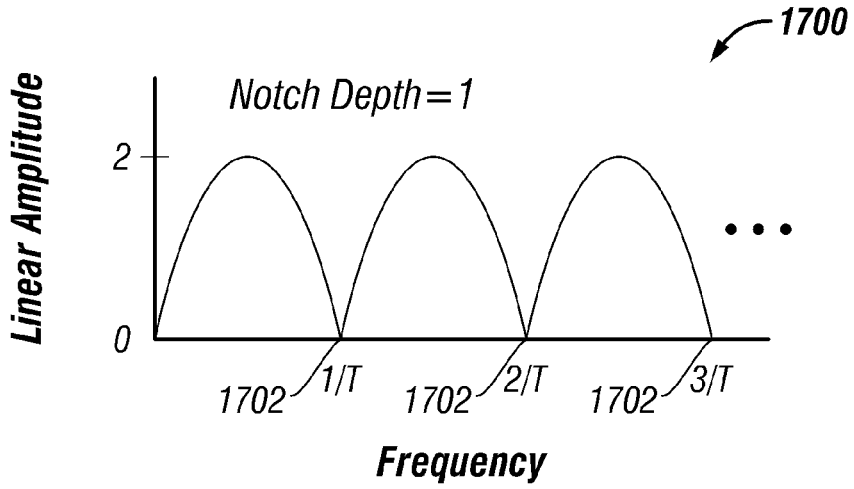
FIG. 17 is a graph showing linear amplitude versus frequency with a notch depth set to 1.

Turning to FIG. 17, FIG. 17 is a graph 1700 showing linear amplitude versus frequency with a notch depth set to 1, for an outputted digital acoustic string signal. As illustrated with a notch depth equal to 1, notches 1702 are shown at their respective delay times (1/T, 2/T, 3/T, etc.) in conjunction with their frequency relationship. Further, the linear amplitude gain is seen to vary between 0 and 2. The notches would theoretically be infinite, but in order to produce a convincing random microphone effect, in most cases, the magnitude of notches should be limited.

Figure 18:
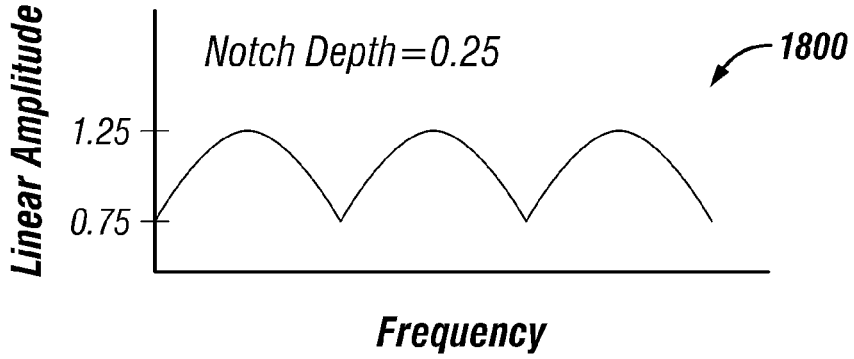
FIG. 18 is a graph showing linear amplitude versus frequency with a notch depth set to a value less than 1.

An example of this may be seen with reference to FIG. 18. FIG. 18 shows an example of a graph 1800 illustrating linear amplitude versus frequency with a notch depth set to a value less than 1, (e.g. notch depth coefficient is set to 0.25), for an outputted digital acoustic string signal. In this example, the linear amplitude varies between 0.75 and 1.25. This provides for a more realistic sounding acoustic guitar/microphone combination.

In one embodiment of the acoustic modeling system 1300, string modeling 1312 may also include digital signal processing in order to model the sound of a pick hitting a string. Although the guitar provides a completely integrated system that has a bridge pickup to detect input digital signals from a picked string, unfortunately, the short percussive attacks commonly associated with a guitar pick hitting a string that are picked up by the microphone are not picked up by the bridge pickup. Thus, in order to preserve this desired characteristic and appealing sound quality, embodiments of the invention take this factor into account and actually model this feature.

Particularly, in real world terms, when striking a guitar string with a pick, or even with a performer's fingers, this initial attack creates a short high-frequency transient which a microphone faithfully captures, but a bridge pickup does not. In order to preserve this very noticeable characteristic, the energy levels at which the strings are attacked is monitored and a dynamic equalizer is added to boost high-frequency energy for short periods corresponding to the string attack. More particularly, by properly tuning an equalizer model, the high frequency bands similar to the frequency bands produced when a pick hits a string are increased. Thus, this approach can be used to replicate the percussive sound of a pick striking a string. This effect is useful for modeling the strumming of chords and for finger picking and adds a sense of realism for virtually every playing style.

Figure 19:
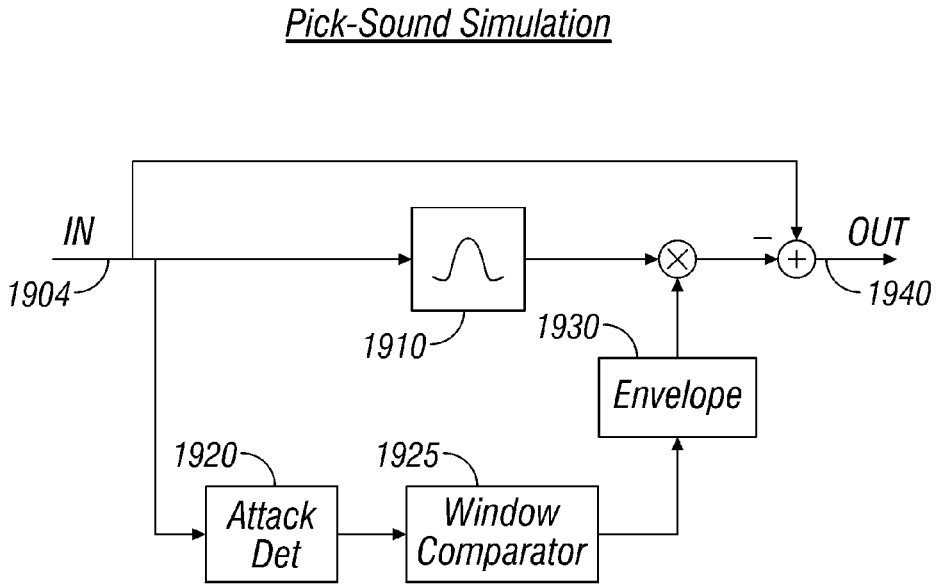
FIG. 19 shows a block diagram illustrating a pick-sound simulation system, according to one embodiment of the invention.

With reference to FIG. 19, FIG. 19 shows a block diagram illustrating a pick-sound simulation model, according to one embodiment of the invention. A digital string input signal 1904 is modified by an adjustable second order bandpass filter 1910. The output of the bandpass filter 1910 is conditionally modified dependent upon the activation of an attack dependent envelope generator 1920. To create the proper percussive sound, the bandpass filter 1910 is typically tuned to very high audible frequencies, for example, around 10K hertz (Hz), while its Q is fairly high (e.g., nominal values of Q around 10).

Figure 20:
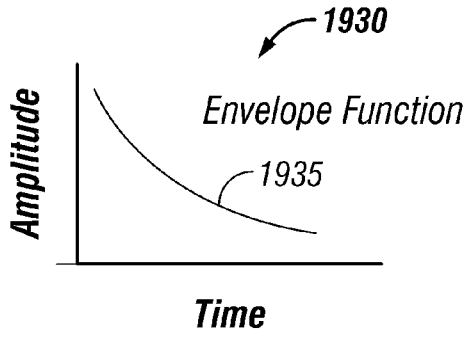
FIG. 20 is a graph illustrating an envelope function that consists of a first order decaying exponential.

The attack detector 1920 works in conjunction with a specialized window comparator 1925 to impose realistic envelopes on the bandpass filter's 1910 gain. In one embodiment, the window comparator 1925 may impose an envelope 1930 that consists of a first order decaying exponential. For example, as shown in FIG. 20, an envelope function 1930 may be seen that consists of a first order decaying exponential 1935, with typical decay times ranging, for example, from 20 to 100 milliseconds (ms).

There are typically two factors that dictate the sensitivity and effectiveness of envelope triggering. One is window length and the other is amplitude magnitude. Once an attack has been recognized by the attack detector 1920, a predetermined time window implemented by the window comparator 1925 must expire before acknowledging any additional prospective trigger events.

In addition, the recorded attack must be of sufficient magnitude, typically a factor of 2× higher than the last recognized peak in order to qualify as a new trigger event. This may be accomplished utilizing the window comparator 1925. However, if over a given window's duration, a new trigger event is not detected, then the window's highest recorded amplitude may be recorded as the "amplitude value of record," for which the next window is compared.

Thus, when a performer hits a string with sufficient force such that the attack detector 1920 recognizes an attack and further the window comparator 1925 recognizes an attack, the envelope 1935 function may be applied to the output of the bandpass filter 1910. In this way, the percussive of sound a pick hitting a string is added to input digital string signal 1904 and is accurately replicated in output digital string signal 1940.

Further, in one embodiment, additional body modeling 1316 for the acoustic modeling system 1300 may also be provided to cover an important sound characteristic relating to how strings interact with the soundboard of a particular acoustic guitar. This type of modeling may be referred to as dynamic string-tone modeling or filtering. The additional body modeling incorporating dynamic string-tone filtering provides a very high degree of realism in acoustic guitar modeling.

The primary purpose of dynamic string-tone filtering is to accurately simulate the evolving tonality of a string of a particular selected acoustic guitar to be emulated as it interacts with the specific soundboard of the particular selected acoustic guitar and the movement at the bridge, both of which are functions of the selected acoustic guitar body. It is important to note that in dynamic string-tone filtering, each string is considered separately, and that the string/soundboard relationship evolves over time.

In order to accurately model and quantify the relationship of the string to the soundboard, the mechanical admittance of the system, measured at the bridge, is characterized as:

Admittance=velocity/force.

It should be noted that for any guitar body (or for that matter any stringed instrument body), at a given frequency, that applying a specific amount of force (wherein the string force is transferred to the soundboard via the bridge) results in a specific sound board velocity.

For example, an acoustic guitar body (e.g., a hollow body) has a much higher velocity than does a solid body. Looking at a theoretical case for a solid body, if the body and bridge were infinitely rigid, at a given frequency, ideally, that frequency would have infinite sustain. Conversely, a string's energy decays most rapidly at those frequencies where the body exhibits the greatest admittance (i.e., where its motion is largest). At these frequencies, the energy is depleted from the string at a comparatively higher rate than those frequencies exhibiting less admittance, hence the affected frequencies have limited sustain.

Each type of acoustic guitar body has a unique and dynamic relationship in how the strings react to and interact with the soundboard. As will be discussed, embodiments of the invention related to dynamic string-tone filtering accurately model the crucial aspects of this interaction between the string and the soundboard.

Figure 21:
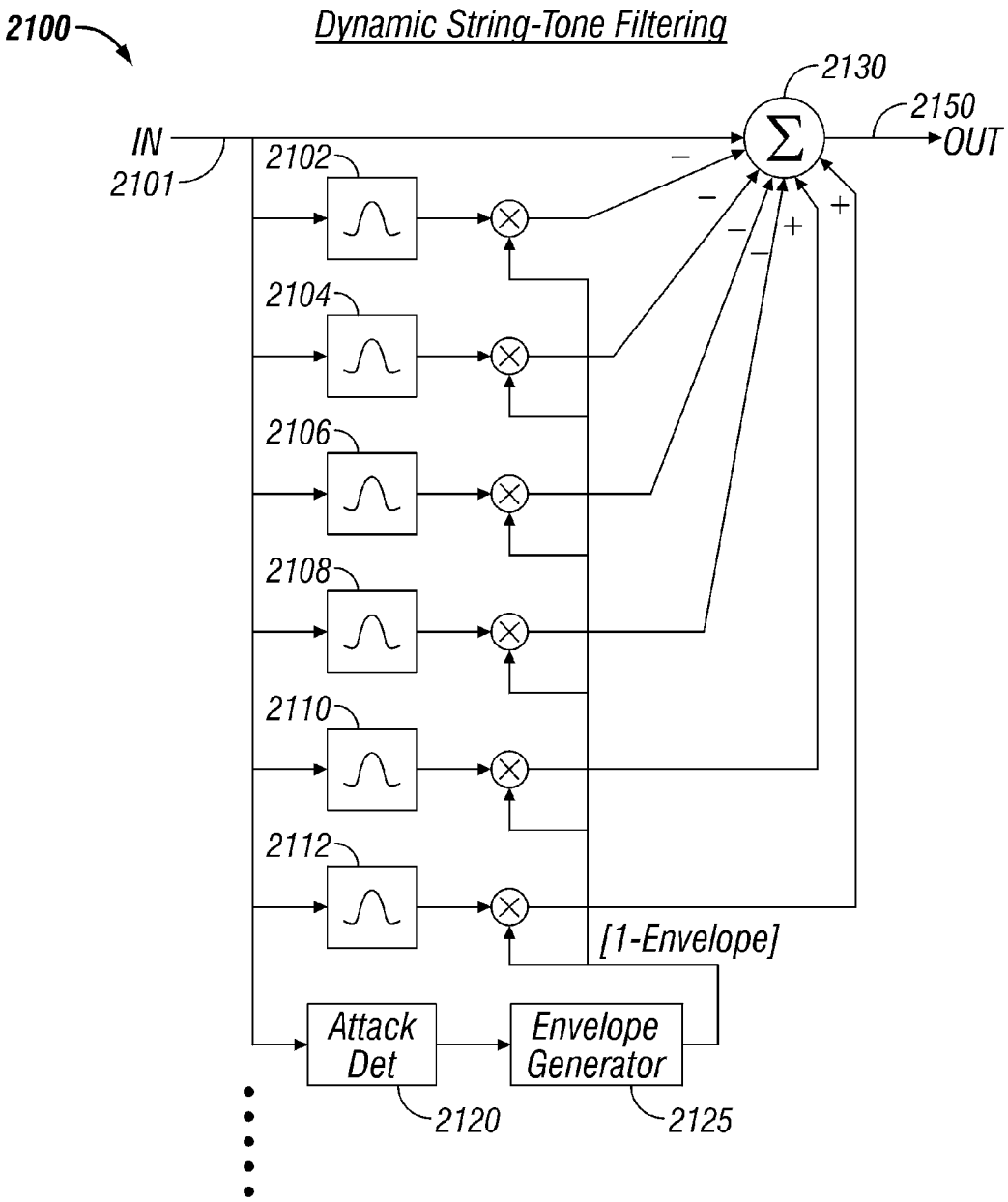
FIG. 21 is a block diagram illustrating the components of a dynamic string-tone filtering system, according to one embodiment of the invention.

With reference to FIG. 21, FIG. 21 shows a block diagram illustrating the components of a dynamic string-tone filtering system 2100, according to one embodiment of the invention. It should be noted that the dynamic string-tone filtering system 2100 for brevity's sake only shows dynamic string-tone filtering as applied to one string to illustrate how the string interacts with the body of the acoustic guitar and that dynamic string-tone filtering is typically applied to each of the six strings of a typical acoustic guitar to be modeled. Thus the dynamic string-tone filtering system 2100 would typically be repeated for each string of the acoustic guitar to be modeled.

In this embodiment, the dynamic string-tone filtering system 2100 utilizes a total of six stages of bandpass equalization 2102, 2104, 2106, 2108, 2110, and 2112. The first four bands of subtractive equalization 2102, 2104, 2106, and 2108 provide subtractive equalization to simulate the previously-described string-energy loss at specific frequencies. The two bands of additive equalization 2110 and 2112 are specifically designed to simulate the host guitar body's low-admittance frequency bands, which require reinforcement for proper matching.

Dynamic string-tone filtering system 2100 as shown in FIG. 21 also utilizes an attack detector 2120 and an envelope generator 2125 both of which are similar to those utilized in the previously-described pick-sound simulation (e.g. see FIGS. 1920 and 1930), however they vary in a few aspects. Particularly, the dynamic string-tone filtering system's envelope generator 2125 incorporates a timed "hold" prior to instigating an exponential decay. The envelope generator 2125 utilizes a single envelope generator to process each string on an individual basis but can be further extended as processing power permits. For example, each of the individual filters may have their own dedicated envelope generators to add higher levels of dynamic character.

The attack detector 2120 functions similarly to the attack detector 1920 discussed with reference to FIG. 19.

Figure 22A:
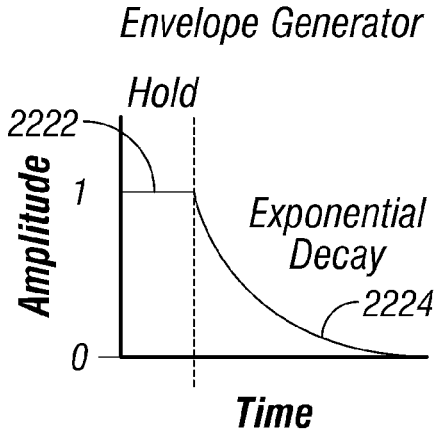
FIG. 22A is a graph illustrating an envelope generator function including a hold function.
Figure 22B:
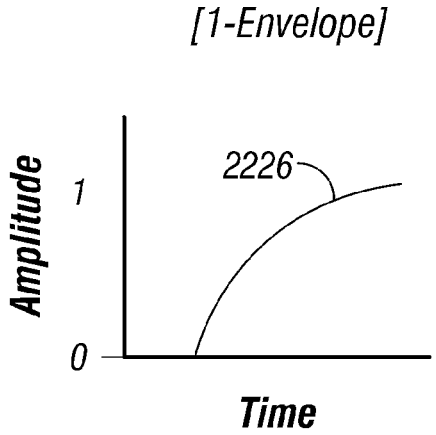
FIG. 22B illustrates the function [1−envelope].

Looking briefly at FIG. 22A, FIG. 22A illustrates the envelope generator function. Particularly, as seen in FIG. 22A the envelope generator 2125 imparts a hold function 2222 at an amplitude of "1" and then imparts an exponential decay that decays with time. Looking to FIG. 22B, FIG. 22B illustrates the function [1−envelope], this function curve 2226 is shown as a function of time rising between an amplitude of zero up towards an amplitude of "1".

Figure 23:
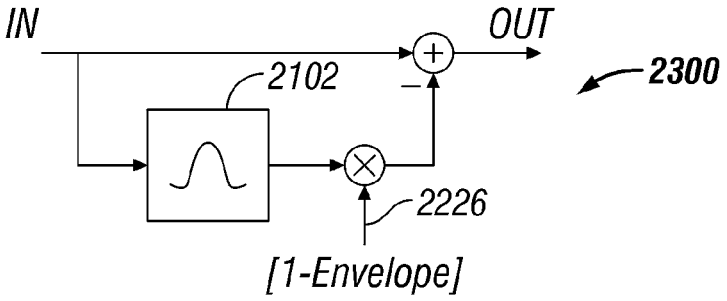
FIG. 23 is a graph showing a single stage of the dynamic string-tone filtering equalization system and demonstrates how the envelope increases the bandpass equalization filter's effect over time.

Turning now to FIG. 23, FIG. 23 shows a single stage 2300 of the dynamic string-tone filtering equalization system 2100 and demonstrates how the envelope increases the bandpass equalization filter's effect over time.

Figure 24:
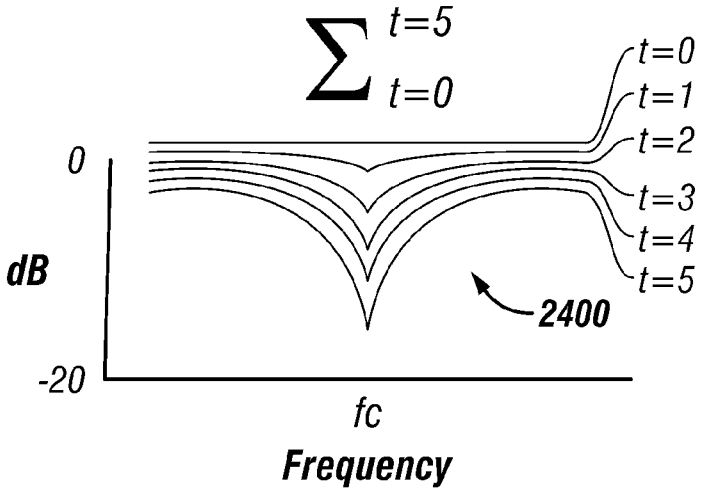
FIG. 24 is a diagram showing resulting output responses as a function of time for the dynamic string-tone filtering system, and specifically shows how the output responses 2400 evolve to match the dynamic admittance characteristics of a particular selected acoustic guitar when measured at a specific frequency (fc).

Looking to FIG. 24, FIG. 24 shows resulting output responses as a function of time for the dynamic string-tone filtering system, and specifically shows how the output responses 2400 evolve to match the dynamic admittance characteristics of a particular selected acoustic guitar when measured at a specific frequency (fc). As the output response curves 2400 show, the top curve, at t=0, i.e. the hold function, delays the filter effects for a predetermined time, and at a subsequent times t=1, t=2, t=3, t=4, and t=5, about frequency fc, the filter's effect gradually increases thereby decreasing the amplitude of the digital acoustic string output signal Thus, by implementing dynamic string tone filtering 2100, a digital string input signal 2101 from the guitar that is sufficient enough to trigger attack detector 2120, undergoes four stages of subtractive bandpass equalization 2102, 2104, 2106, and 2108 (subtracted at summation block 2130) modified by the previously-described [1−envelope] function to simulate the string-energy loss at specific frequencies and further undergoes two stages of additive bandpass equalization 2110 and 2112 (added at summation block 2130) also modified by the previously-described [1−envelope] function to simulate the host guitar body's low-admittance frequency band. The resultant digital string acoustic output signal 2150 is thereby modeled to accurately simulate the evolving tonality of the string as it interacts with the soundboard of the particular selected acoustic guitar and the movement at the bridge thereof.

Additionally, in one embodiment, integrated selectable custom tuning functionality as part of string modeling 1312 is provided.

Although there is a wide performance repertoire based on "standard tuning," there is also a large body of music based on "custom tuning" to suit various genres, tonalities, and timber. While "custom tuning" increases instrument versatility and performance possibilities, it also adds a high degree of complication due to the amount of time required to manually custom tune an acoustic guitar.

Further, because strings need a certain amount of time to "settle," it is very difficult to substantially change tuning without impacting the continuity of a given performance. In other words, since the strings take some time to become stable (i.e., retain accurate pitch after substantially changing tension), it becomes difficult and inconvenient to vary tunings during a given performance. Even if the performer waits for the strings to stabilize, which requires several minutes at best, there is still a tendency for the strings to continue a slow drift, or to slowly detune. In this case, the performer is required to retune the instrument, usually between each selection.

Other custom tunings require the use of mechanical devices such as capos, which, while not presenting string-settling problems, nonetheless impose pauses in the performance to replace and remove these devices.

Rather than by physically retuning the strings by altering their respective tension or by utilizing a capo, embodiments of the invention through the use of string modeling 1312 allow the performer to utilize sophisticated pitch detection and pitch shifting algorithms to change to virtually any tuning instantly.

By utilizing the user interface of the guitar or the personal computer, previously discussed, a user can select from a variety of pre-programmed tunings that can be easily accessed at any time. Various pitch detection and pitch shifting algorithms to alter tunings are well known in the art and can be implemented by the acoustic DSP software module of the personal computer, as previously discussed.

Moreover, as previously discussed, for both the electric and acoustic DSP software modules, previously discussed, it should be appreciated that the appropriate DSP software module provides the proper modeling coefficients to the processor of the personal computer for the particular electric or acoustic guitar selected by the user to be emulated. In this way, the personal computer may perform the proper transformations on the digital string vibration signal to implement the previously described electric and acoustic modeling systems and filtering algorithms, as previously discussed, to perform the proper transformations on the digital string vibration signal to properly emulate the corresponding string tone of the particular electric or acoustic guitar chosen to be played by the user.

While the present invention and its various functional components have been described in particular embodiments, it should be appreciated the embodiments of the present invention can be implemented in hardware, software, firmware, middleware or a combination thereof and utilized in systems, subsystems, components, or sub-components thereof. When implemented in software (e.g. as a software module), the elements of the present invention are the instructions/code segments to perform the necessary tasks. The program or code segments can be stored in a machine readable medium, such as a processor readable medium or a computer program product, or transmitted by a computer data signal embodied in a carrier wave, or a signal modulated by a carrier, over a transmission medium or communication link. The machine-readable medium or processor-readable medium may include any medium that can store or transfer information in a form readable and executable by a machine (e.g. a processor, a computer, etc.). Examples of the machine/processor-readable medium include an electronic circuit, a semiconductor memory device, a ROM, a flash memory, an erasable programmable ROM (EPROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. A processor-readable medium having stored thereon instructions, which when executed by a processor of a computer, causes the computer to perform operations comprising:

receiving serially formatted digital string signals over a serial link, the received serially formatted digital string signals associated with detected string vibration signals of played strings of a stringed instrument transmitted to the computer over the serial link; and processing each serially formatted digital string signal utilizing a DSP-based software module in order to emulate a corresponding string tone of a model of a stringed instrument selected by a user from a plurality of selectable models of stringed instruments to create an emulated digital sting tone signal, wherein electric guitar DSP-based modeling is performed by the DSP-based software module that implements a digital filter to emulate electromagnetic pickup locations for an electric guitar model selected by a user to be emulated.

2. The processor-readable medium of claim 1, further comprising instructions to transmit each emulated digital string tone signal back over the serial link to the stringed instrument for playback through the stringed instrument.

3. The processor-readable medium of claim 2, wherein, the serial link includes a separate channel for each serially formatted digital string signal transmitted from the stringed instrument to the computer.

4. The processor-readable medium of claim 3, further comprising instructions to perform operations to create a left stereo mix of the emulated digital string tone signals and a right stereo mix of the emulated digital string tone signals, and transmitting both the left and right stereo mix of emulated digital string tone signals back over the serial link to the stringed instrument for playback.

5. The processor-readable medium of claim 1, further comprising instructions to perform acoustic guitar DSP-based modeling to process each received serially formatted digital string signal in order to emulate a corresponding string tone of one of a plurality of different acoustic guitars to create an emulated acoustic guitar digital string tone signal, each emulated acoustic guitar digital string tone signal being transmitted back over the serial link to the stringed instrument for playback.

6. The processor-readable medium of claim 1, further comprising instructions to perform pitch transposition to process each serially formatted digital string signal in order to alter the pitch of each received serially formatted digital string signal.

7. The processor-readable medium of claim 1, further comprising instructions to store each serially formatted digital string signal at the computer and to process each serially formatted digital string signal later in time during post-editing in order to emulate a corresponding string tone of one of a plurality of stringed instruments to create an emulated digital string tone signal.

8. The processor-readable medium of claim 1, further comprising instructions to extract signal information including at least a pitch of each serially formatted digital string signal.

9. The processor-readable medium of claim 8, further comprising instructions to implement a synthesizer engine to create synthesized sounds, wherein based upon the extracted signal information, associated synthesized sounds are triggered and rendered for playback.

10. The processor-readable medium of claim 8, further comprising instructions to implement a wavetable playback engine to create sounds, wherein based upon the extracted signal information, associated pre-recorded sounds in wave file format are triggered and rendered for playback.

11. A processor-readable medium having stored thereon instructions, which when executed by a processor of a computer, causes the computer to perform operations comprising:

receiving a plurality of digitized string vibration signals; and processing each digitized string vibration signal;

wherein each digitized string vibration signal is processed utilizing a DSP-based software module to emulate a corresponding string tone of a model of a stringed instrument selected by a user from a plurality of selectable models of stringed instruments to create an emulated digital sting tone signal such that a complete stringed instrument is emulated, wherein electric guitar DSP-based modeling is performed by the DSP-based software module that implements a digital filter to emulate electromagnetic pick-up locations for an electric guitar model selected by a user to be emulated.

12. The processor-readable medium of claim 11, wherein each received digitized string signal is transduced from a pickup of a guitar.

13. The processor-readable medium of claim 11, wherein the received digitized string signal are received in real-time as a plurality of strings of a stringed instrument are played, the digitized string vibration signals being associated with the played strings.

14. The processor-readable medium of claim 11, wherein the received digitized string signals are transmitted from a pre-recorded file.

15. The processor-readable medium of claim 11, further comprising instructions to perform acoustic guitar DSP-based modeling to process each received digitized string signal in order to emulate a corresponding string tone of one of a plurality of different acoustic guitars to create an emulated acoustic guitar digital string tone signal.

16. The processor-readable medium of claim 11, further comprising instructions to perform pitch transposition to process each digitized string signal in order to alter the pitch of each received digitized string signal.

17. The processor-readable medium of claim 11, further comprising instructions to extract signal information including at least a pitch of each digitized string signal.

18. The processor-readable medium of claim 17, further comprising instructions to implement a synthesizer engine to create synthesized sounds, wherein based upon the extracted signal information, associated synthesized sounds are triggered and rendered for playback.

19. The processor-readable medium of claim 17, further comprising instructions to implement a wavetable playback engine to create sounds, wherein based upon the extracted signal information, associated pre-recorded sounds in wave file format are triggered and rendered for playback.

20. The processor-readable medium of claim 11, wherein the processed digitized string vibration signal undergoes further processing to emulate one of a plurality of amplifiers and cabinet setups.

21. A processor-readable medium having stored thereon instructions, which when executed by a processor of a computer, causes the computer to perform operations comprising:

receiving a plurality of digital string vibration signals;

storing the digital string vibration signals; and processing the stored digital string vibration signals, later in time, during post-editing, wherein each digital string vibration signal is processed utilizing a DSP-based software module to emulate a corresponding string tone of a model of a stringed instrument selected by a user from a plurality of selectable models of stringed instruments to create an emulated digital sting tone signal, wherein electric guitar DSP-based modeling is performed by the DSP-based software module that implements a digital filter to emulate electromagnetic pick-up locations for an electric guitar model selected by a user to be emulated.

22. The processor-readable medium of claim 21, wherein the audio DSP-based software module includes an acoustic guitar DSP-based modeling software module to process each stored digital string signal in order to emulate a corresponding string tone of one of a plurality of different acoustic guitars to create an emulated acoustic guitar digital string tone signal.

23. The processor-readable medium of claim 21, wherein each stored digital string signal is processed by a pitch-transposition software module to alter the pitch of each stored digital string signal.

24. The processor-readable medium of claim 21, wherein each stored digital string signal is processed to extract signal information including at least a pitch of the digital string signal.

25. The processor-readable medium of claim 24, further comprising instructions to render synthesized sounds based upon the extracted signal information.

26. The processor-readable medium of claim 24, further comprising instructions to render pre-recorded sounds in an audio file format based upon the extracted signal information.

* * * * *